US006010810A

United States Patent [19]

Uesaka et al.

[11] Patent Number: 6,010,810

[45] Date of Patent: Jan. 4, 2000

[54] ELECTROPHOTOGRAPHIC PHOTORECEPTOR, PROCESS FOR THE PREPARATION THEREOF AND IMAGE FORMING APPARATUS COMPRISING THE SAME

[75] Inventors: Tomozumi Uesaka; Kazuhiro Koseki; Fumio Ojima; Masahiro Iwasaki; Kiyokazu Mashimo, all of Kanagawa, Japan

[73] Assignee: Fuji Xerox Co., Ltd., Tokyo, Japan

[21] Appl. No.: 08/951,666

[22] Filed: Oct. 16, 1997

[30] Foreign Application Priority Data

| | | | |
|---|---|---|---|
| Oct. 16, 1996 | [JP] | Japan | 8-273513 |
| Dec. 11, 1996 | [JP] | Japan | 8-330727 |
| Jan. 29, 1997 | [JP] | Japan | 9-015420 |
| Feb. 14, 1997 | [JP] | Japan | 9-030418 |
| Apr. 11, 1997 | [JP] | Japan | 9-093280 |
| May 22, 1997 | [JP] | Japan | 9-132001 |
| May 22, 1997 | [JP] | Japan | 9-132007 |
| Jul. 17, 1997 | [JP] | Japan | 9-192637 |

[51] Int. Cl.[7] ..... G03G 5/04

[52] U.S. Cl. ..... 430/58.8; 430/66

[58] Field of Search ..... 430/65, 66, 59, 430/58.8

[56] References Cited

U.S. PATENT DOCUMENTS

| | | | |
|---|---|---|---|
| 5,204,202 | 4/1993 | Ishikawa et al. | 430/66 |
| 5,258,252 | 11/1993 | Sakai et al. | 430/66 |
| 5,447,812 | 9/1995 | Fukuda et al. | 430/66 |

FOREIGN PATENT DOCUMENTS

| | | |
|---|---|---|
| A-54-148537 | 11/1979 | Japan . |
| A-57-128344 | 8/1982 | Japan . |
| A-63-18354 | 1/1988 | Japan . |
| A-4-15659 | 1/1992 | Japan . |
| A-5-323630 | 12/1993 | Japan . |
| A-6-202354 | 7/1994 | Japan . |

*Primary Examiner*—John Goodrow

*Attorney, Agent, or Firm*—Oliff & Berridge, PLC

[57] ABSTRACT

An electrophotographic photoreceptor comprising an electrically-conductive substrate having thereon at least a photosensitive layer and a surface protective layer: wherein the surface protective layer has a network structure formed by the reaction of hydroxyl group-containing compounds with an isocyanate group-containing compound; and wherein at least one of the hydroxyl group-containing compounds is an electric charge-transporting material containing a hydroxyl group. Also disclosed are a preparation process of the electrophotographic photoreceptor and an image forming apparatus comprising the electrophotographic photoreceptor.

22 Claims, 2 Drawing Sheets

ELECTROPHOTOGRAPHIC PHOTORECEPTOR, PROCESS FOR THE PREPARATION THEREOF AND IMAGE FORMING APPARATUS COMPRISING THE SAME

FIELD OF THE INVENTION

The present invention relates to an electrophotographic photoreceptor applicable to a wide range of fields such as copying machine, printer and facsimile. The present invention also relates to a preparation process thereof and to an image forming apparatus comprising the same.

BACKGROUND OF THE INVENTION

Previously, in electrophotographic devices such as plain paper copiers (PPCs), laser printers, LED printers and liquid crystal printers, images have been formed on photoreceptors of the rotary drum type through an image forming process comprising charging, exposure and development, and transferred to transfer members, followed by fixing, thus obtaining duplicated copies. As the photoreceptors used in these devices, inorganic photoreceptors such as selenium, arsenic-selenium, cadmium sulfide, zinc oxide and a-Si photoreceptors are employed, but organic photoreceptors (OPCs) inexpensive and excellent in productivity and waste disposal are also actively studied and developed. In particular, so-called function separation type photoreceptors in which charge generating layers are laminated with charge transporting layers are excellent in electrophotographic characteristics such as sensitivity, charge property and repetition stability thereof, so that various function separation type photoreceptors have been proposed and have come in practice.

However, the characteristics required for electrophotographic photoreceptors, particularly the durability has yearly become severe, and to the problems of wear and damage of surface layers due to repeated use, particularly wear and damage of surface layers significantly promoted by the use under contact charging, and oxidation deterioration of surface layers caused by oxidizing gases such as ozone generated from corona charging units, techniques necessary for improvement in the durability have been continuously studied. As a method for solving these problems of surface layers, a method of forming a surface protective layer on a charge transporting layer is proposed, the surface protective layer being mainly composed of a crosslinking hardenable resin such as an organic polysiloxane (JP-A-54-148537 (the term "JP-A" as used herein means an "unexamined published Japanese patent application")).

A proposal has been also made for an approach which comprises forming a surface protective layer comprising an oxidation inhibitor incorporated in a hardening resin depending on the required durability to enhance the chemical durability of the surface layer against ozone, nitrogen oxide, etc. produced by corona discharge (JP-A-63-18354).

However, when the surface protective layer is formed of the crosslinking hardenable resin alone, it becomes an insulating layer, which sacrifices electrophotographic characteristics of a photoreceptor. Specifically, when the surface protective layer becomes an insulating layer, the illuminated part potential on exposure is increased. Accordingly, the development potential margin is narrowed, or the residual potential after charge elimination is elevated. There has been therefore the problem that the image density is lowered, particularly when printing is repeated for a long period of time.

As a method for improving these electrophotographic characteristics, a method is proposed in which a fine conductive metal oxide powder is dispersed in a surface protective layer as a resistance controlling material (JP-A-57-128344).

This method restrains a reduction in the electrophotographic characteristics of a photoreceptor to substantially improve the above-mentioned problem. However, the value of resistance of the metal oxide used as the fine conductive powder largely depends on the humidity of the environment. This method has therefore the substantial problem that the surface resistance of the photoreceptor is reduced, particularly under the circumstances of high temperature and humidity, to blur an electrostatic latent image, which causes the image quality to be largely deteriorated.

Further, as another technique for improving the electrophotographic characteristics, a method is proposed in which a charge transporting material is dispersed in a binder resin, and then, the binder resin is hardened to form a surface protective layer (JP-A-4-15659).

This method removes the humidity dependence of the surface resistance of the photoreceptor, thereby solving the problem of the image quality. However, the addition of the charge transporting material, namely a low molecular weight component, inhibits the hardening reaction of the binder resin to decrease the mechanical strength of the surface protective layer. Accordingly, even if a crosslinking hardenable resin having a high mechanical strength is solely used, a substantial reduction in the mechanical strength of the surface protective layer can not be avoided, so long as the low molecular weight component is contained as the charge transporting material indispensable for improvement in the electrophotographic characteristics.

Then, a methods is proposed in which a functional group-containing charge transporting material is acted on or reacted with a binder resin, thereby improving the mechanical strength of a surface layer (JP-A-6-202354 and JP-A-5-323630).

According to this method, a sufficient mechanical strength can be obtained initially without reducing the electrophotographic characteristics of the photoreceptor. However, the use of the photoreceptor for a long period of time under the contact charging system or the scorotron charging system rapidly decreases the mechanical strength of the above-mentioned surface protective layer. This is considered to be caused by a strong external stress, such as severance of bonds of the resin of the surface protective layer by the application of the alternating current voltage in contact charging, or the oxidative decomposition of the charge transporting layer with ozone generated in scorotron charging.

Further, the prevention of abrasion merely by raising the mechanical strength of the surface protective layer is disadvantageous in that paper powder or toner attached to the surface of the photoreceptor can be easily fixed thereto, resulting in a drastic deterioration of image quality.

Moreover, when such a surface protective layer as described above is employed, the mechanical strength may be improved. However, a problem that a charge-generating material and a charge-transporting material is fatigued to be deteriorated due to a photoelectric current repeatedly passing through the photosensitive layer. This problem becomes marked as the printing resistance is improved and the number of sheets repeatedly printed is increased. Therefore, a charge-generating material and a charge-transporting material which are stable against a photoelectric current should be used to solve the problem.

SUMMARY OF THE INVENTION

It is therefore an object of the present invention to solve the above-mentioned problems and to provide an electrophotographic photoreceptor having a surface protective layer which does not deteriorate the electrophotographic characteristics and the image quality of the photoreceptor, and which has a sufficient mechanical strength and high durability even in the use under a strong external stress for a long period of time.

Another object of the present invention is to provide a preparation process of the photoreceptor.

A further other object of the invention is to provide an image forming apparatus comprising the same.

Other objects and effects of the present invention will become more apparent from the following description.

The inventors made extensive studies of the durability and other properties of electrophotographic photoreceptors. As a result, it was found that the provision of a surface protective layer having a network structure, particularly a three-dimensional network structure, formed by the crosslinked polymerization of a compound containing a specific reactive functional group, the network structure having a specific electric charge-transporting material bonded thereto, provides an electrophotographic photoreceptor exhibits satisfactory mechanical strength as well as satisfactory photoelectric properties required for photoreceptor. The present invention has been achieved based on these findings.

The first aspect of the present invention relates to an electrophotographic photoreceptor comprising an electrically-conductive substrate having thereon at least a photosensitive layer and a surface protective layer, wherein the surface protective layer has a network structure formed by the reaction of hydroxyl group-containing compounds with an isocyanate group-containing compound; and wherein at least one of the hydroxyl group-containing compounds is an electric charge-transporting material containing a hydroxyl group.

The second aspect of the present invention relates to an electrophotographic photoreceptor as described in the above first aspect, wherein the hydroxyl group-containing group comprises at least one combination selected from: a combination of an electric charge-transporting material containing a hydroxyl group and a compound containing two or more hydroxyl groups; a combination of an electric charge-transporting material containing a hydroxyl group and a compound containing a hydroxyl group and a fluorine atom; a combination of an electric charge-transporting material containing a hydroxyl group and at least one of a glycol compound and a bisphenol compound.

The third aspect of the present invention relates to the photoreceptor as described in the above first aspect, wherein the isocyanate group-containing compound has three or more functional groups, and the surface protective layer further comprises at least one compound selected from the group consisting of those having a hindered phenol structural unit and those having a hindered amine structure.

The fourth aspect of the present invention relates to the photoreceptor as described in the above first aspect, wherein the electric charge-transporting material is represented by the following formula (A), (B), (C) or (D):

(A)

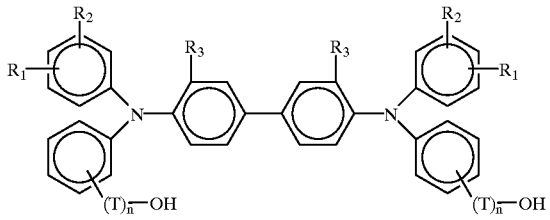

wherein $R_1$, $R_2$ and $R_3$ each represents a hydrogen atom, a halogen atom, an alkyl group, an alkoxy group or a substituted amino group; T represents a $C_{1-10}$ divalent aliphatic hydrocarbon group which may be branched; and n represents an integer of 0 or 1;

(B)

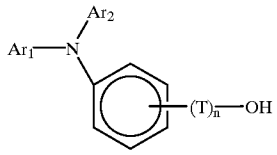

wherein $Ar_1$ and $Ar_2$ each represents a phenyl or condensed group which may be substituted by an alkyl group, a phenyl group, an alkoxy group, or an alkyl-substituted phenyl group; T represents a $C_{1-10}$ divalent aliphatic hydrocarbon group which may be branched; and n represents an integer of 0 or 1;

(C)

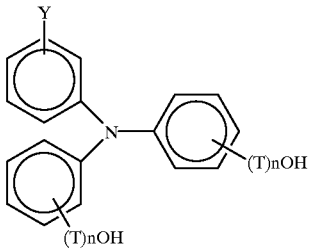

wherein Y represents a hydrogen atom, a halogen atom, an alkyl group having 1 to 5 carbon atoms which may be substituted by a halogen atom, an alkoxyl group having 1 to 5 carbon atoms, or a phenyl group which may be substituted by: a halogen atom; an alkyl group having 1 to 5 carbon atoms which may be substituted by a halogen atom; or a phenyl group which may be substituted by an alkoxyl group having 1 to 5 carbon atoms; T represents a divalent aliphatic group having 1 to 10 carbon atoms which may be branched; and n represents 0 or 1;

(D)

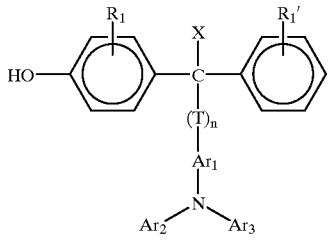

wherein $R_1$ and $R_1'$, which may be the same or different, each represents a hydrogen atom or an alkyl group having 1 to 5 carbon atoms; X represents a hydrogen atom, an alkyl group having 1 to 5 carbon atoms, or a phenyl group which may be substituted; T represents a divalent aliphatic group which may be branched; $Ar_1$, $Ar_2$ and $Ar_3$, which may be the same or different, each represents a phenyl group, a naphthyl group, or an anthracene group; and these substituent groups may each be substituted by one or more of a halogen atom, an alkyl group(s) having 1 to 5 carbon atoms and an alkoxyl group having 1 to 5 carbon atoms.

The fifth aspect of the present invention relates to the photoreceptor as described in the above fourth aspect, wherein the isocyanate group-containing compound has three or more functional groups.

The sixth aspect of the present invention relates to the photoreceptor as described in the above fifth aspect, wherein the network structure of the surface protective layer is formed in an inert binder resin.

The seventh aspect of the present invention relates to the photoreceptor as described in the above fourth aspect, wherein the isocyanate group-containing compound has three or more functional groups, and the surface protective layer further comprises at least one compound selected from the group consisting of those having a hindered phenol structural unit and those having a hindered amine structure.

The eighth aspect of the present invention relates to the photoreceptor as described in the above seventh aspect, wherein the isocyanate group-containing compound is at least one compound selected from the group consisting of adducts of polyol with an isocyanate, burette-modified products of a compound having a urea compound with an isocyanate, alophanate-modified products by the addition of isocyanate to a urethane group, isocyanurate-modified products and carboimide-modified products.

The ninth aspect of the present invention relates to the photoreceptor as described in the above fourth aspect, wherein the surface protective layer comprises a three-dimensional crosslinking polymerized product of at least three of the charge-transporting materials represented by formulae (C) and (D), compounds having two or more hydroxyl groups, isocyanate compounds having three or more functional groups.

The tenth aspect of the present invention relates to the photoreceptor as described in the above ninth aspect, wherein the compounds having two or more hydroxyl groups is a glycol compound or a bisphenol compound.

The eleventh aspect of the present invention relates to the photoreceptor as described in the above ninth aspect, wherein the isocyanate compound having three or more functional groups comprises at least one of the biuret modified product of a hexamethylene diisocyanate represented by the following structural formula (3-II) and the isocyanurate modified product of a hexamethylene diisocyanate represented by the following structural formula (3-III):

(3-II)

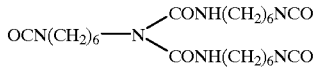

(3-III)

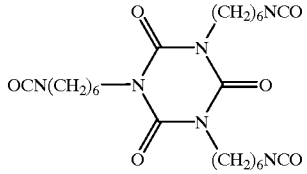

The twelfth aspect of the present invention relates to the photoreceptor as described in the above first aspect, wherein the photosensitive layer comprises a chlorogallium phthalocyanine or a hydroxygallium phthalocyanine.

The thirteenth aspect of the present invention relates to the photoreceptor as described in the above first aspect, wherein the photosensitive layer comprises at least one of benzidine compounds represented by the following general formula (a) and triphenylamine compounds represented by the following general formula (b):

(a)

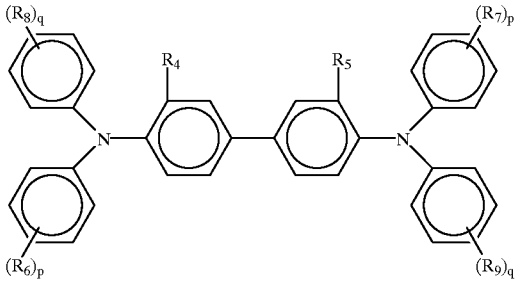

wherein $R_4$ and $R_5$ may be the same or different and each represents a hydrogen atom, a halogen atom or a $C_{1-5}$ alkyl or alkoxy group; $R_6$, $R_7$, $R_8$ and $R_9$ may be the same or different and each represents a hydrogen atom, a halogen atom, a $C_{1-5}$ alkyl or alkoxy group or an amino group substituted by $C_{1-2}$ alkyl group; and p and q each represent an integer of 1 or 2;

(b)

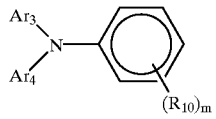

wherein $R_{10}$ represents a hydrogen atom or a methyl group; $Ar_3$ and $Ar_4$ each represents an unsubstituted aryl group or an aryl group substituted by a halogen atom, a $C_{1-5}$ alkyl or alkoxy group, or amino group substituted by a $C_{1-3}$ alkyl group; and m represents an integer or 1 or 2.

The fourteenth aspect of the present invention relates to a preparation process of an electrophotographic photoreceptor comprising the steps of:

providing an electrically conductive substrate having thereon a photosensitive layer;

applying a coating solution containing a hydroxyl group-containing compound and an isocyanate group-containing compound to a photosensitive layer; and then heating the photosensitive layer to effect crosslinking polymerization, to thereby form a surface protective layer on the photosensitive layer.

The fifteenth aspect of the present invention relates to a preparation process as described in the above fourteenth aspect, wherein the hydroxyl group-containing compound in the coating solution comprises at least one combination selected from: a combination of an electric charge-transporting material containing a hydroxyl group and a compound containing a hydroxyl group and a fluorine atom; a combination of an electric charge-transporting material containing a hydroxyl group and a bisphenol compound; a combination of a compound having two or more hydroxyl group and a compound represented by the following formula (C) or (D):

(C)

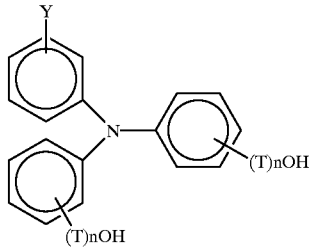

wherein Y represents a hydrogen atom, a halogen atom, an alkyl group having 1 to 5 carbon atoms which may be substituted by a halogen atom, an alkoxyl group having 1 to 5 carbon atoms, a phenyl group, or which may be substituted by: a halogen atom; an alkyl group having 1 to 5 carbon atoms which may be substituted by a halogen atom; or a phenyl group which may be substituted by an alkoxyl group having 1 to 5 carbon atoms; T represents a divalent aliphatic group having 1 to 10 carbon atoms which may be branched; and n represents 0 or 1;

(D)

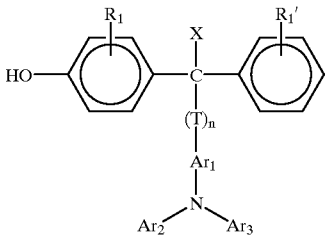

wherein $R_1$ and $R_1'$, which may be the same or different, each represents a hydrogen atom or an alkyl group having 1 to 5 carbon atoms; X represents a hydrogen atom, an alkyl group having 1 to 5 carbon atoms, or a phenyl group which may be substituted; T represents a divalent aliphatic group which may be branched; $Ar_1$, $Ar_2$ and $Ar_3$, which may be the same or different, each represents a phenyl group, a naphthyl group, or an anthracene group; and these substituent groups may each be substituted by one or more of a halogen atom, an alkyl group(s) having 1 to 5 carbon atoms and an alkoxyl group having 1 to 5 carbon atoms; and a combination of a bisphenol or glycol compound and a compound represented by the above described formula (C) or (D).

The sixteenth aspect of the present invention relates to a preparation process as described in the above fourteenth aspect, wherein the coating solution further comprises at least one compound selected from the group consisting of those having a hindered phenol structural unit and those having a hindered amine structure.

The seventeenth aspect of the present invention relates to a preparation process as described in the above fourteenth aspect, wherein the hydroxyl group-containing compound comprises a compound represented by the following formula (C) or (D):

(C)

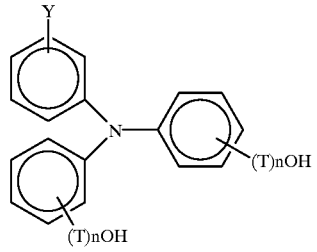

wherein Y represents a hydrogen atom, a halogen atom, an alkyl group having 1 to 5 carbon atoms which may be substituted by a halogen atom, an alkoxyl group having 1 to 5 carbon atoms, or a phenyl group which may be substituted by: a halogen atom; an alkyl group having 1 to 5 carbon atoms which may be substituted by a halogen atom; or a phenyl group which may be substituted by an alkoxyl group having 1 to 5 carbon atoms; T represents a divalent aliphatic group having 1 to 10 carbon atoms which may be branched; and n represents 0 or 1;

(D)

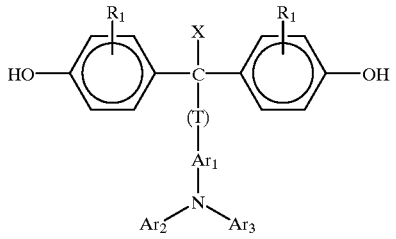

wherein $R_1$ and $R_1'$, which may be the same or different, each represents a hydrogen atom or an alkyl group having 1 to 5 carbon atoms; X represents a hydrogen atom, an alkyl group having 1 to 5 carbon atoms, or a phenyl group which may be substituted; T represents a divalent aliphatic group which may be branched; $Ar_1$, $Ar_2$ and $Ar_3$, which may be the same or different, each represents a phenyl group, a naphthyl group, or an anthracene group; and these substituent groups may each be substituted by one or more of a halogen atom, an alkyl group(s) having 1 to 5 carbon atoms and an alkoxyl group having 1 to 5 carbon atoms; and wherein the isocyanate group-containing compound comprises at least one of the biuret modified product of a hexamethylene diisocyanate represented by the following structural formula (3-II) and the isocyanurate modified product of a hexamethylene diisocyanate represented by the following structural formula (3-III):

(3-II)

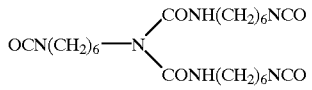

(3-III)

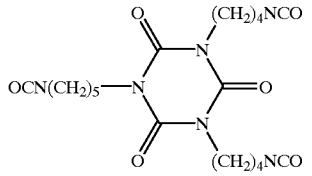

The eighteenth aspect of the present invention relates to an image forming apparatus comprises:

an electrophotographic photoreceptor; and charging means, image forming exposing means, developing means and transferring means around the electrophotographic photoreceptor, wherein the electrophotographic photoreceptor is one defined in the above described fifth aspect.

The nineteenth aspect of the present invention relates to an image forming apparatus as described in the above eighteenth aspect, wherein the charging means is of contact charging type.

Twentieth aspect of the present invention relates to an image forming apparatus as described in the above nineteenth aspect, wherein the charging means is operatable by applying a voltage having an alternating current component.

The twenty-first aspect of the present invention relates to an electrophotographic photoreceptor as described in the above first aspect, wherein the network structure in the surface protective layer has a urethane bonding content ratio A of 1.5 or more:

$$A=x/y$$

wherein x represents an absorbence of the infrared absorption peak at from 1720 to 1740 $cm^{-1}$ attributed to the CO stretching vibration in the urethane bonding, and y represents an absorbence of the infrared absorption peak at 2973 $cm^{-1}$ attributed to the $CH_2$ stretching vibration.

The twenty-second aspect of the present invention relates to a preparation process as described in the above fourteenth aspect, wherein the surface protective layer has a network structure and which network structure has a urethane bonding content ratio A of 1.5 or more:

$$A=x/y$$

wherein x represents an absorbence of the infrared absorption peak at from 1720 to 1740 $cm^{-1}$ attributed to the CO stretching vibration in the urethane bonding, and y represents an absorbence of the infrared absorption peak at 2973 $cm^{-1}$ attributed to the $CH_2$ stretching vibration.

Other representative embodiments are described below.

(1-1) An electrophotographic photoreceptor comprising an electrically-conductive substrate having thereon at least a photosensitive layer and a surface protective layer, wherein the surface protective layer has a network structure formed by the reaction of hydroxyl group-containing compounds with an isocyanate group-containing compound; and wherein at least one of the hydroxyl group-containing compounds is an electric charge-transporting material containing a hydroxyl group.

(1-2) An electrophotographic photoreceptor comprising an electrically-conductive substrate having thereon at least a photosensitive layer and the surface protective layer as described in the above first aspect, wherein the surface protective layer has a network structure formed by the reaction of an electric charge-transporting material containing a hydroxyl group, a compound containing a hydroxyl group and a fluorine atom and an isocyanate group-containing compound.

(1-3) An electrophotographic photoreceptor comprising at least a photosensitive layer and a surface protective layer provided on an electrically-conductive substrate, wherein the surface protective layer has a network structure formed by the reaction of an electric charge-transporting material containing a hydroxyl group, a bisphenol compound and an isocyanate group-containing compound. The present invention also relates to a process for the preparation of a foregoing electrophotographic photoreceptor, which comprises applying a coating solution to a photosensitive layer, and then heating the coating solution to form a surface protective layer, wherein the coating solution comprises an electric charge-transporting material containing a hydroxyl group, a bisphenol compound and an isocyanate group-containing compound.

(2-1) An electrophotographic photoreceptor comprising a conductive support having provided thereon at least one photosensitive layer and a surface protective layer, in which the surface protective layer is composed of a three-dimensional crosslinked polymer of a charge transporting compound represented by the following structural formula (C) and an isocyanate compound having at least three functional groups:

(C)

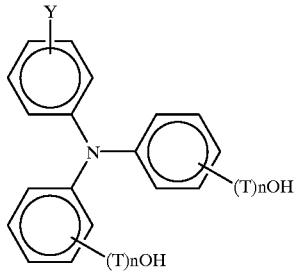

wherein Y represents a hydrogen atom, a halogen atom, an alkyl group having 1 to 5 carbon atoms which may be substituted by a halogen atom, an alkoxyl group, a phenyl group, or which may be substituted a halogen atom; an alkyl group having 1 to 5 carbon atoms which may be substituted by a halogen atom; or a phenyl group which may be substituted by an alkoxyl group having 1 to 5 carbon atoms; T represents a divalent aliphatic group having 1 to 10 carbon atoms which may be branched; and n represents 0 or 1;

(2-2) The electrophotographic photoreceptor described in the above (2-1), in which the surface protective layer is composed of a three-dimensional crosslinked polymer of a charge transporting compound represented by the above-mentioned structural formula (C), a compound having at least two hydroxyl groups and an isocyanate compound having at least three functional groups;

(2-3) The electrophotographic photoreceptor described in the above (2-2), in which the compound having at least two hydroxyl groups is a glycol compound and/or a bisphenol compound;

(2-4) The electrophotographic photoreceptor described in any one of the above (2-1) to (2-3), in which the isocyanate compound having at least three functional groups is a hexamethylene diisocyanate-modified compound of biuret represented by the following structural formula (2-II) or a hexamethylene diisocyanate-modified compound of an isocyanurate represented by the following structural formula (2-III):

(2-II)

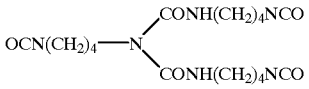

(2-III)

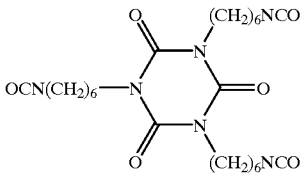

(2-5) The electrophotographic photoreceptor described in any one of the above (2-1) to (2-4), in which the photosensitive layer comprises hydroxygallium phthalocyanine and/or chlorogallium phthalocyanine;

(2-6) The electrophotographic photoreceptor described in any one of the above (2-1) to (2-4), in which the photosensitive layer comprises a benzidine compound represented by the following structural formula (2-IV) and/or a triphenylamine compound represented by the following structural formula (2-V):

(2-IV)

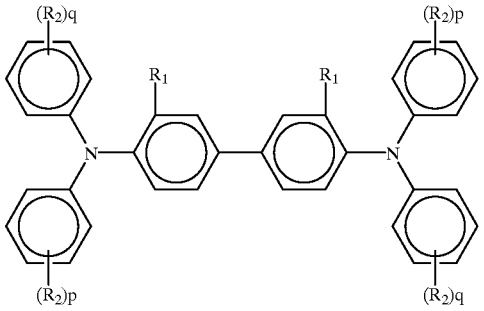

wherein $R_1$ and $R_1'$, which may be the same or different, each represents a hydrogen atom, a halogen atom, an alkyl group having 1 to 5 carbon atoms or an alkoxyl group having 1 to 5 carbon atoms; $R_2$, $R_2'$ $R_3$ and $R_3'$, which may be the same or different, each represents a hydrogen atom, a halogen atom, an alkyl group having 1 to 5 carbon atoms, an alkoxyl group having 1 to 5 carbon atoms or an amino group substituted by an alkyl group having 1 to 2 carbon atoms; and p and q each represents an integer of 0 to 2;

(2-V)

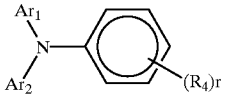

wherein $R_4$ represents a hydrogen atom or a methyl group; r represents 1 or 2; and $Ar_1$ and $Ar_2$ each represents a substituted or unsubstituted aryl group, wherein a substituent group is a halogen atom, an alkyl group having 1 to 5 carbon atom, an alkoxyl group having 1 to 5 carbon atoms or a substituted amino group substituted by an alkyl group having 1 to 3 carbon atoms;

(2-7) A method for producing an electrophotographic photoreceptor comprising a conductive support having provided thereon at least one photosensitive layer and a surface protective layer, which comprises applying a coating solution containing a charge transporting compound represented by the above-mentioned structural formula (C) and an isocyanate compound having at least three functional groups onto the photosensitive layer, followed by heating to conduct three-dimensional crosslinking polymerization of the compounds;

(2-8) The method described in the above (2-7), which comprises applying a coating solution containing a charge transporting compound represented by the above-mentioned structural formula (C), a compound having at least two hydroxyl groups and an isocyanate compound having at least three functional groups onto the photosensitive layer, followed by heating to conduct three-dimensional crosslinking polymerization of the compounds, thereby forming the surface protective layer;

(2-9) The method described in the above (2-8), in which the compound having at least two hydroxyl groups is a glycol compound and/or a bisphenol compound;

(2-10) The method described in any one of the above (2-7) to (2-9), in which the isocyanate compound having at least three functional groups is a hexamethylene diisocyanate-modified compound of biuret represented by the above-mentioned structural formula (2-II) or a hexamethylene diisocyanate-modified compound of an isocyanurate represented by the above-mentioned structural formula (2-III);

(2-11) An image forming apparatus provided with a charging means, an image forming means by exposure, a developing means and a transfer means around an electrophotographic photoreceptor, in which the electrophotographic photoreceptor described in any one of the above (2-1) to (2-6) is used;

(2-12) The image forming apparatus described in the above (2-11), in which a charging means of a contact charging system is employed as the charging means; and (2-13) The image forming apparatus described in the above (2-12), which is provided with a means for applying a voltage having an alternating current component as a means for applying a voltage to the charging means.

(3-1) An electrophotographic photoreceptor comprising a conductive support having provided thereon at least one photosensitive layer and a surface protective layer, in which the surface protective layer is composed of a three-dimensional crosslinked polymer of at least two kinds of compounds, a charge transporting compound represented by the following structural formula (D) and an isocyanate compound having at least three functional groups:

(D)

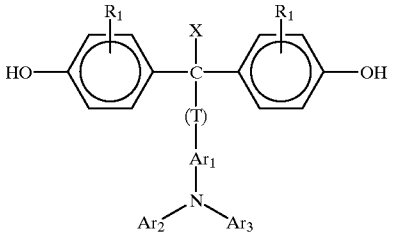

wherein $R_1$ and $R_1'$, which may be the same or different, each represents a hydrogen atom or an alkyl group having 1 to 5 carbon atoms; X represents a hydrogen atom, an alkyl group having 1 to 5 carbon atoms or a phenyl group which may be substituted; T represents a divalent aliphatic group which may be branched; $Ar_1$, $Ar_2$ and $Ar_3$, which may be the same or different, each represents a phenyl group, a naphthyl group, or an anthracene group; and these substituent groups may each be substituted by a halogen atom(s), an alkyl group(s) having 1 to 5 carbon atoms or an alkoxyl group(s) having 1 to 5 carbon atoms;

(3-2) An electrophotographic photoreceptor comprising a conductive support having provided thereon at least one photosensitive layer and a surface protective layer, in which the surface protective layer is composed of a three-dimensional crosslinked polymer of at least three compounds, the charge transporting compound described in the above (3-1), a compound having at least two hydroxyl groups and an isocyanate compound having at least three functional groups;

(3-3) The electrophotographic photoreceptor described in the above (3-2), in which the compound having at least two hydroxyl groups is a glycol compound and/or a bisphenol compound;

(3-4) The electrophotographic photoreceptor described in any one of the above (3-1) to (3-3), in which the isocyanate compound includes a hexamethylene diisocyanate-modified compound of biuret represented by the following structural formula (3-II) and/or a hexamethylene diisocyanate-modified compound of an isocyanurate represented by the following structural formula (3-III):

(3-II)

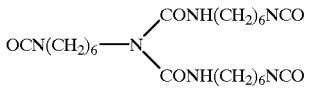

-continued (3-III)

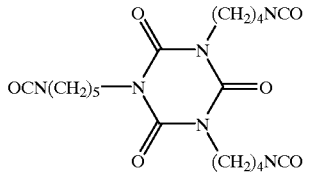

(3-5) The electrophotographic photoreceptor described in any one of the above (3-1) to (3-4), in which the photoreceptor comprises hydroxygallium phthalocyanine and/or chlorogallium phthalocyanine;

(3-6) The electrophotographic photoreceptor described in any one of the above (3-1) to (3-4), in which the photoreceptor comprises a benzidine compound represented by the following structural formula (3-IV) and/or a triphenylamine compound represented by the following structural formula (3-V):

(3-IV)

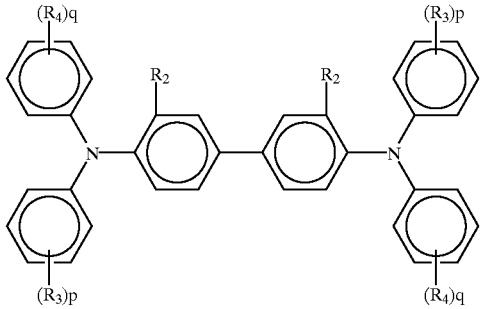

wherein $R_2$ and $R_2'$, which may be the same or different, each represents a hydrogen atom, a halogen atom, an alkyl group having 1 to 5 carbon atoms or an alkoxyl group having 1 to 5 carbon atoms; $R_3$, $R_3'$ $R_4$ and $R_4'$, which may be the same or different, each represents a hydrogen atom, a halogen atom, an alkyl group having 1 to 5 carbon atoms, an alkoxyl group having 1 to 5 carbon atoms or an amino group substituted by an alkyl group having 1 to 2 carbon atoms; and p and q each represents an integer of 0 to 2;

(3-V)

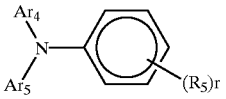

wherein $R_5$ represents a hydrogen atom or a methyl group; r represents 1 or 2; and $Ar_4$ and $Ar_5$, which may be the same or different, each represents a substituted or unsubstituted aryl group, wherein a substituent group is a halogen atom, an alkyl group having 1 to 5 carbon atom, an alkoxyl group having 1 to 5 carbon atoms or an amino group substituted by an alkyl group having 1 to 3 carbon atoms;

(3-7) A method for producing the electrophotographic photoreceptor described in the above (3-1) comprising forming at least one photosensitive layer on a conductive support, and further forming a surface protective layer thereon, in which a coating solution containing at least two kinds of compounds, the charge transporting compound and the isocyanate compound having at least three functional groups described in the above (3-1), is applied onto the photosensitive layer, followed by heating to conduct three-dimensional crosslinking polymerization, thereby forming the protective layer;

(3-8) A method for producing the electrophotographic photoreceptor described in the above (3-2) comprising forming at least one photosensitive layer on a conductive support, and further forming a surface protective layer thereon, in which a coating solution containing at least three kinds of compounds, the charge transporting compound, the compound having at least two hydroxyl groups and the isocyanate compound having at least three functional groups described in the above (3-2), is applied onto the photosensitive layer, followed by heating to conduct three-dimensional crosslinking polymerization, thereby forming the protective layer;

(3-9) The method described in the above (3-8), in which the compound having at least two hydroxyl groups is a glycol compound and/or a bisphenol compound;

(3-10) The method described in any one of the above (3-7) to (3-9), in which the isocyanate compound includes the hexamethylene diisocyanate-modified compound of biuret represented by the above-mentioned structural formula (3-II) and/or the hexamethylene diisocyanate-modified compound of an isocyanurate represented by the above-mentioned structural formula (3-III) described in the above (3-4);

(3-11) An image forming apparatus using the electrophotographic photoreceptor described in any one of the above (3-1) to (3-6);

(3-12) The image forming apparatus described in the above (3-11), in which a contact charging device is used as a charging means of the photoreceptor; and (3-13) The image forming apparatus described in the above (3-12), in which an applied voltage used in the contact charging device has an alternating current component. (4-1) An electrophotographic photoreceptor comprising a photosensitive layer and a surface protective layer provided on an electrically-conductive substrate, characterized in that the surface protective layer is composed of a three-dimensional crosslinked polymerization product of at least two of electric charge-transporting materials containing hydroxyl group and isocyanate compounds having three or more functional groups and contains at least one of compound having a hindered phenol structural unit and compound having a hindered amine structural unit.

(4-2) The electrophotographic photoreceptor according to Clause (4-1), wherein at least one of the electric charge-transporting materials containing hydroxyl group is one represented by any one of the following structural formulae (E) to (G):

(E)

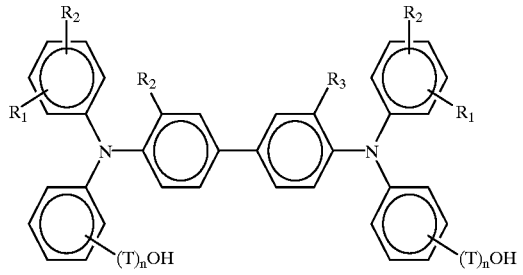

wherein $R_1$, $R_2$ and $R_3$ each represent a hydrogen atom, a halogen atom, a $C_{1-5}$ alkyl or alkoxy group or an amino group substituted by $C_{1-2}$ alkyl group; T represents a divalent hydrocarbon group having a $C_{1-10}$ aliphatic moiety which may be branched; and n represents an integer of 0 or 1;

(F)

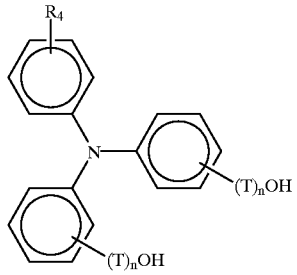

wherein $R_4$ represents a hydrogen atom, a halogen atom, a $C_{1-5}$ alkyl or alkoxy group, a phenyl group or a phenyl group substituted by halogen atom, $C_{1-5}$ alkyl group, alkyl group substituted by halogen atom or $C_{1-5}$ alkoxy group; T represents a divalent hydrocarbon group having a $C_{1-10}$ aliphatic moiety which may be branched; and n represents an integer of 0 or 1;

(G)

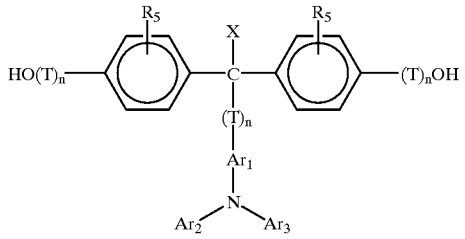

wherein $R_5$ represents a hydrogen atom or $C_{1-5}$ alkyl group; X represents a hydrogen atom, a $C_{1-5}$ alkyl, a phenyl group or a phenyl group substituted by halogen atom, $C_{1-5}$ alkyl group, alkyl group substituted by halogen atom or $C_{1-5}$ alkoxy group; T represents a divalent hydrocarbon group having a $C_{1-5}$ aliphatic moiety which may be branched; and $Ar_1$, $Ar_2$ and $Ar_3$ each represent a phenyl, naphthyl or anthracene group which may be substituted by a plurality of halogen atoms or $C_{1-5}$ alkyl or alkoxy groups.

(4-3) The electrophotographic photoreceptor according to Clause (4-1), wherein at least one of the isocyanate compounds comprises one or more selected from the group consisting of adduct-modified product obtained by adding isocyanate to polyol having three or more functional groups, burette-modified product obtained by modifying a compound having urea bond with isocyanate, alophanate-modified product and isocyanurate-modified product obtained by adding isocyanate to urethane group, and carboimide-modified product.

(4-4) The electrophotographic photoreceptor according to Clause (4-3), wherein at least one of the isocyanate compounds comprises a burette-modified hexamethylene diisocyanate represented by the following structural formula (4-D) or an isocyanurate-modified hexamethylene diisocyanate represented by the following structural formula (4-E):

(4-D)

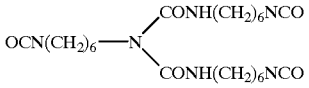

(4-E)

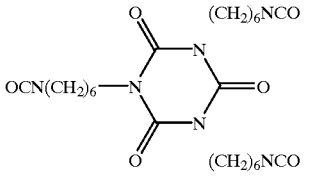

(4-5) The electrophotographic photoreceptor according to any one of Clauses (4-1) to (4-4), wherein the surface protective layer comprises a glycol compound or bisphenol compound incorporated therein.

(4-6) The electrophotographic photoreceptor according to any one of Clauses (4-1) to (4-5), wherein the surface protective layer comprises an electron accepting substance incorporated therein.

(4-7) A process for the preparation of an electrophotographic photoreceptor which comprises forming a photosensitive layer and a surface protective layer in sequence on an electrically-conductive substrate, characterized in that a coating solution comprising an electric charge-transporting material containing hydroxyl group, an isocyanate compound having three or more functional groups and a compound having a hindered phenol structural unit or hindered amine structural unit is applied to the photosensitive layer which is then heated so that the electric charge-transporting material and the isocyanate compound are three-dimensionally crosslinked-polymerized to form the surface protective layer.

(4-8) A process for the formation of an image which comprises uniformly charging the surface of an electrophotographic photoreceptor, exposing the electrophotographic photoreceptor imagewise to light to form a latent image thereon, developing the latent image to form a toner image, and then transferring the toner image to a transferring paper, characterized in that as the charging means there is used a corona charging means and as the electrophotographic photoreceptor there is used one defined in any one of Clauses (4-1) to (4-6).

(4-9) A process for the formation of an image which comprises uniformly charging the surface of an electrophotographic photoreceptor, exposing the electrophotographic photoreceptor imagewise to light to form a latent image thereon, developing the latent image to form a toner image, and then transferring the toner image to a transferring paper, characterized in that as the charging means there is used a contact charging means and as the electrophotographic photoreceptor there is used one defined in any one of Clauses (4-1) to (4-6).

(4-10) The process for the formation of an image according to Clause (4-9), wherein the applied voltage used in the contact charging comprises a.c. component.

In a preferred embodiment of the present invention the above-mentioned problems have been markedly solved by allowing the surface protective layer to have a three-dimensional network structure formed by the crosslinking hardenable binding materials and directly binding the charge transporting compound to the network structure. The photosensitive layer for use in the present invention may have either a monolayer structure or a laminated structure comprising a charge-generating layer and a charge-transporting layer. That is, the charge transporting compound having a plurality of hydroxyl groups at its ends is mixed with the compound having at least three isocyanate groups, and the hydroxyl groups and the isocyanate groups are reacted with each other to form the three-dimensionally crosslinked surface protective layer, thereby making it possible to provide the photoreceptor having more excellent mechanical strength and durability while maintaining the electrophotographic characteristics of the photoreceptor. In particular, the use of the compound represented by the above-mentioned structural formula (C) as the charge transporting material allows the excellent electrophotographic characteristics, image quality, wear resistance and scratch resistance to be ensured.

The charge transporting compound having a plurality of hydroxyl groups undergoes the polyaddition reaction with the compound having at least three isocyanate groups, particularly to such an extent to have a urethane bonding content ratio (A=x/y) of 1.5 or more, to easily form the three-dimensional network structure at a high crosslink density. It is considered that the mechanical strength is not rapidly decreased even if the bonds of the binder resin are partly severed by the strong external stresses such as the application of the alternating current voltage in the contact charging, and ozone generated in the scorotron charging, because of the crosslinked structure of such a high density. Further, the charge transporting compound represented by the above-mentioned structural formula (C) is excellent in compatibility with many isocyanate compounds. It is therefore possible to uniformly introduce the charge transporting compound into the network structure, thereby ensuring the good electrophotographic characteristics.

The conventional charge transporting layers were formed by dissolving low molecular weight charge transporting materials in binder resins. For enhancing the mechanical strength, therefore, the charge transporting materials could not be added too much. However, the surface protective layer of the present invention incorporates the charge transporting material into the network structure in a binded state, so that a larger amount of the charge transporting material can be introduced than in the conventional charge transporting layer, thereby maintaining the electro-photographic characteristics of the photoreceptor.

Polymer compounds three-dimensionally crosslinked as described above are generally insoluble in solvents. It is therefore impossible to apply solutions thereof in solvents and dry them to form films as the conventional layer formation. However, the surface protective layers can be formed by mixing or dissolving compounds prior to crosslinking in solvents, and bringing about the crosslink polymerization reaction by heating after coating and drying. Conversely, polymeric charge transporting materials low in crosslink density can be dissolved in solvents, followed by coating and film formation. However, they are low in mechanical strength because of their low crosslink density and do not have sufficient wear resistance. In particular, the electrophotographic image forming apparatus using the contact charging method have the problem that wear is increased.

DETAILED DESCRIPTION OF THE INVENTION

Figure 1:
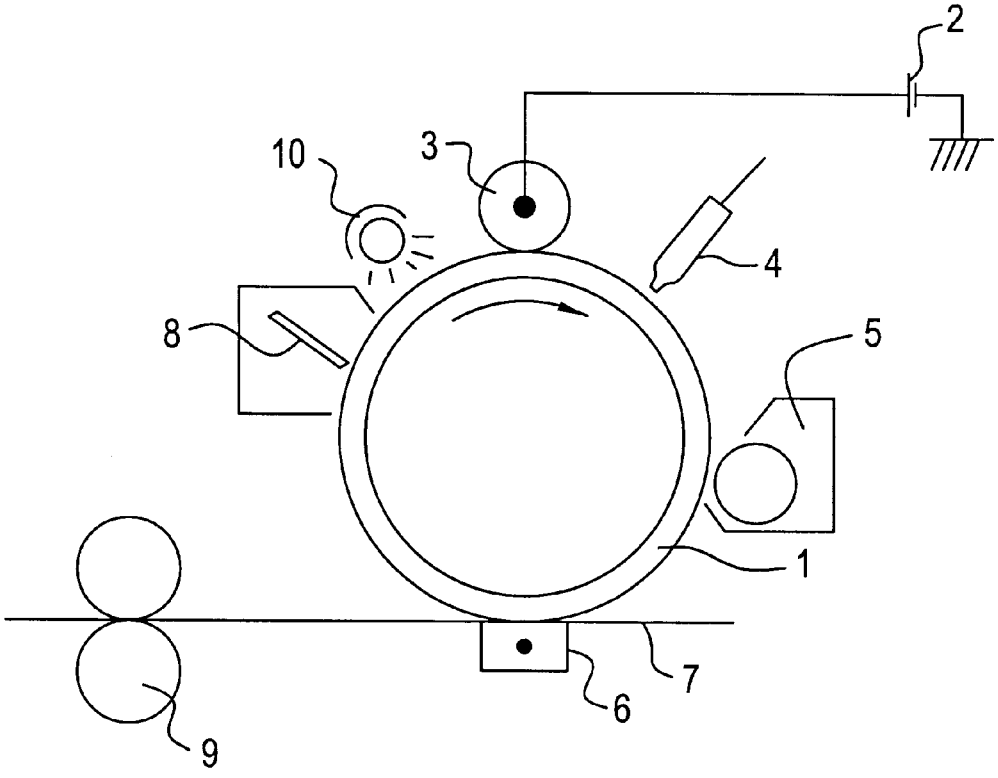
FIG. 1 is a schematic view showing an embodiment of an image forming apparatus of the present invention.
Figure 2:
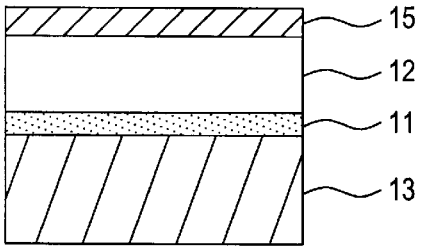
FIGS. 2–5 each is a schematic sectional view showing an embodiment of the structure of the photoreceptor for use in the present invention.
Figure 3:
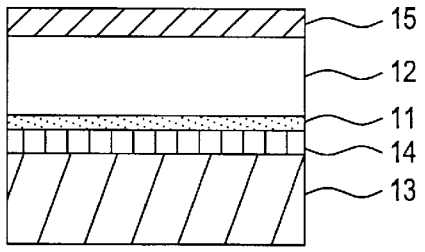
Figure 4:
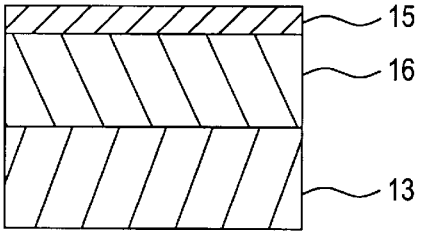
Figure 5:
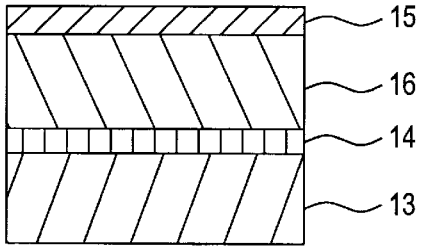

The following description mainly related to the above described embodiments (1-1) to (1-3).

The electrophotographic photoreceptors of the present invention according to the foregoing aspects each comprise at least a photosensitive layer and a surface protective layer provided on an electrically-conductive substrate. If necessary, a subbing layer may be provided interposed between the electrically-conductive substrate and the photosensitive layer for the purpose of inhibiting injection of electric charge and generation of interference band and improving adhesion. The photosensitive layer may be of single layer type or laminated type consisting of electric charge-generating layer and electric charge-transporting layer. In an electrophotographic photoreceptor comprising a laminated type photosensitive layer (hereinafter referred to as "laminated type photoreceptor"), the order of lamination of electric charge-generating layer and electric charge-transporting layer is not limited. In other words, either the electric charge-generating layer or the electric charge-transporting layer may be formed on the electrically-conductive substrate side.

In the present invention, the surface protective layer of the electrophotographic photoreceptor has a network structure (particularly a three-dimensional network structure) formed by the crosslinked polymerization reaction of at least a hydroxyl group-containing compound and a binding material containing a compound having a reactive functional group. The network structure has an electric charge-transporting material bonded thereto.

The surface protective layer of the electrophotographic photoreceptor according to embodiment (1-1) of the present invention forms a film which has been crosslinked reticulately by the polymerization reaction of hydroxyl group-containing compounds with isocyanate group-containing compounds. At least one of these hydroxyl group-containing compounds needs to be an electric charge-transporting material containing hydroxyl group. The electric charge-transporting material containing hydroxyl group preferably contains a compound having two or more hydroxyl groups.

The surface protective layer of the electrophotographic photoreceptor according to embodiment (1-2) of the present invention forms a film which has been crosslinked reticulately by the polymerization reaction of an electric charge-transporting material containing hydroxyl group, a compound containing hydroxyl group and fluorine atom and a binding material containing an isocyanate group-containing compound.

The surface protective layer of the electrophotographic photoreceptor according to embodiment (1-3) of the present invention forms a film which has been crosslinked reticulately by the polymerization reaction of an electric charge-transporting material containing hydroxyl group, a bisphenol compound and an isocyanate group-containing compound.

As mentioned above, the electrophotographic photoreceptor of the present invention comprises a surface protective layer formed by the crosslinked polymerization reaction of an electric charge-transporting material containing hydroxyl group with a binding material containing a compound having a functional group which can react with the electric charge-transporting material to form a bond. In this arrangement, the electrophotographic photoreceptor according to the present invention can maintain desired photoelectric properties while being provided with desired mechanical strength such as high abrasion resistance. It is particularly preferred that the electrophotographic photoreceptor according to the present invention comprise a surface protective layer obtained by the crosslinked polymerization reaction of an electric charge-transporting material containing at least a plurality of hydroxyl groups as reactive functional groups in side chains with a binding material containing a polyisocyanate compound having a plurality of isocyanate groups as a functional group which can react with the electric charge-transporting material.

In order to form a three-dimensional network structure in the surface protective layer of the present invention by reacting a hydroxyl group-containing compound with an isocyanate group-containing compound, it is necessary that an isocyanate compound having 3 or more functional groups be used. In this manner, a finely branched structure can be obtained, making it possible to form a three-dimensional crosslinked film having an excellent abrasion resistance. On the contrary, if an isocyanate compound having two functional groups is used, it merely allows the linear bonding of hydroxyl groups, making it difficult to form a three-dimensional network.

The surface protective layer formed according to these embodiments has a three-dimensional network bond. Therefore, it can be thought that even when the three-dimensional network bond is partly cut under a strong external stress such as application of a.c. voltage in contact charging or ozone generated during scorotron charging, the surface protective layer of the present invention doesn't suffer from rapid drop of mechanical strength.

Heretofore, an electric charge-transporting layer has been normally formed by compatibilizing an electric charge-transporting material comprising a low molecular compound in an inert binder resin. Therefore, the amount of the electric charge-transporting material to be incorporated must be limited to secure the desired mechanical strength. The surface protective layer of the present invention can have a three-dimensional network structure formed by chemical reaction. Therefore, the electric charge-transporting layer can comprise an electric charge-transporting material incorporated therein in a greater amount than in prior art electric charge-transporting layers. The resulting photoreceptor can maintain desired photoelectric properties.

As the electric charge-transporting material containing hydroxyl group employable herein there may be used a conventional electric charge-transporting material containing hydroxyl groups bonded thereto directly or via a proper bonding group. Any electric charge-transporting material having one or more hydroxyl groups may be used. In practice, however, an electric charge-transporting material having two or more hydroxyl groups is preferably used to effect crosslinking resulting in the formation of a three-dimensional network structure.

As the electric charge-transporting material containing hydroxyl group employable herein there may be used the foregoing known material. Particularly preferred are compounds represented by the following general formulae (A) and (B) because they exhibit excellent photoelectric properties and abrasion resistance as photoreceptors:

(A)

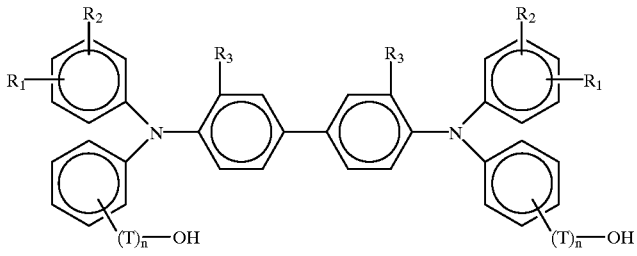

wherein $R_1$, $R_2$ and $R_3$ each represent a hydrogen atom, halogen atom, alkyl group, alkoxy group or substituted amino group; T represents a $C_{1-10}$ divalent aliphatic hydrocarbon group which may be branched; and n represents an integer of 0 or 1;

(B)

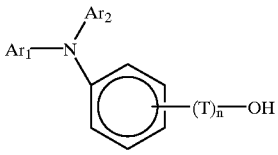

wherein $Ar_1$ and $Ar_2$ each represent a phenyl or condensed group which may be substituted by an alkyl group, a phenyl group, an alkoxy group, or an alkyl-substituted phenyl group; T represents a $C_{1-10}$ divalent aliphatic hydrocarbon group which may be branched; and n represents an integer of 0 or 1.

Specific examples of the $C_{1-10}$ divalent aliphatic hydrocarbon group represented by T in the compounds represented by the foregoing general formulae (A) and (B) are shown below.

T-1

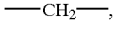

T-2

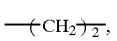

T-3

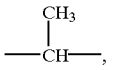

-continued

T-4

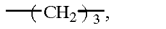

T-5

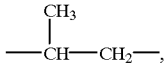

-continued

T-6

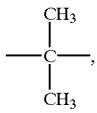

T-7

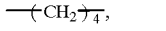

T-8

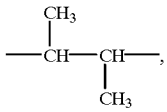

T-9

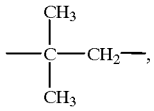

T-10

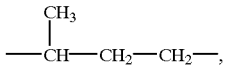

T-11

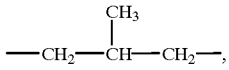

T-12

T-13

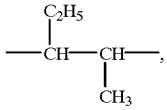

-continued
T-14
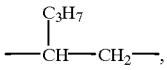
T-15
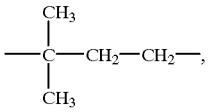
T-16
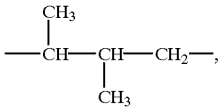
T-17
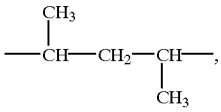
T-18
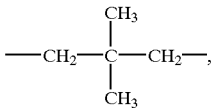
T-19
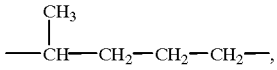
T-20
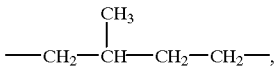
T-21
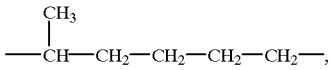
T-22
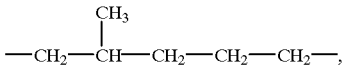
T-23
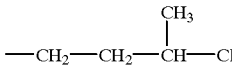
T-24
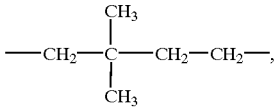
T-25
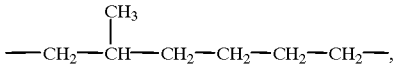
T-26
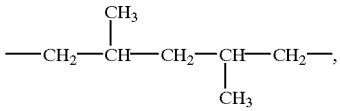
-continued
T-27
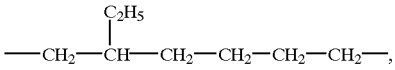
T-28
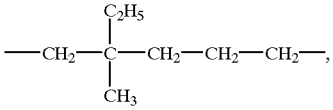
T-29
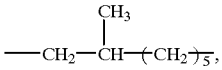
T-30
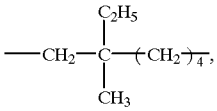
T-31
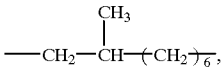
T-32
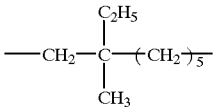
Specific examples of $Ar_1$ and $Ar_2$ in the compound represented by the foregoing general formula (B) are shown below.
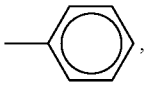
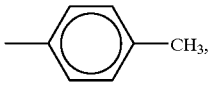
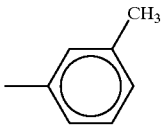
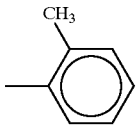
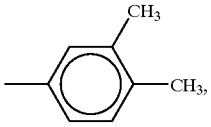
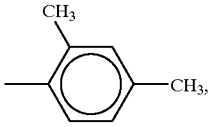
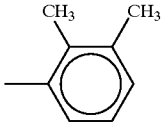
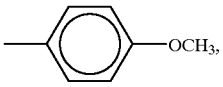
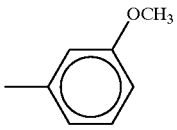
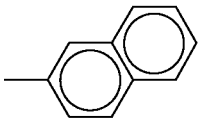

-continued

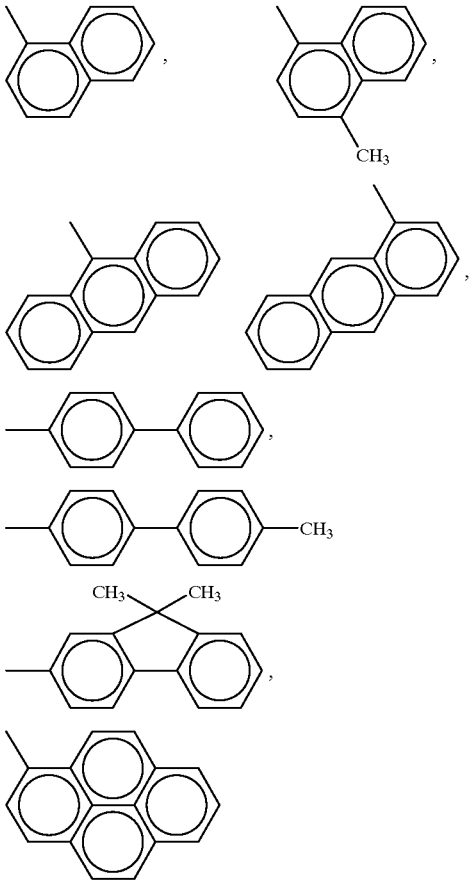

Specific examples of the compound represented by the foregoing general formula (A) are shown in Tables 1-1 and 1-2 below. In these Tables, "P(T)" represents the substituted position of —(T)n—OH.

TABLE 1-1

| No. | $R_1$ | $R_2$ | $R_3$ | p(T) | T | n |
|---|---|---|---|---|---|---|
| A-1 | H | H | H | 3 | — | 0 |
| A-2 | H | H | H | 4 | — | 0 |
| A-3 | H | H | H | 3 | T-1 | 1 |
| A-4 | H | H | H | 4 | T-1 | 1 |

TABLE 1-1-continued

| No. | $R_1$ | $R_2$ | $R_3$ | p(T) | T | n |
|---|---|---|---|---|---|---|
| A-5 | H | H | H | 3 | T-2 | 1 |
| A-6 | H | H | H | 4 | T-2 | 1 |
| A-7 | 2-$CH_3$ | H | H | 3 | — | 0 |
| A-8 | 2-$CH_3$ | H | H | 4 | — | 0 |
| A-9 | 3-$CH_3$ | H | H | 3 | — | 0 |
| A-10 | 4-$CH_3$ | H | H | 3 | — | 0 |
| A-11 | 4-$CH_3$ | H | H | 4 | — | 0 |
| A-12 | 4-$CH_3$ | H | H | 3 | T-1 | 1 |
| A-13 | 4-$CH_3$ | H | H | 4 | T-1 | 1 |
| A-14 | 2-$CH_3$ | 3-$CH_3$ | H | 3 | — | 0 |
| A-15 | 2-$CH_3$ | 3-$CH_3$ | H | 4 | — | 0 |
| A-16 | 2-$CH_3$ | 3-$CH_3$ | H | 3 | T-1 | 1 |
| A-17 | 2-$CH_3$ | 3-$CH_3$ | H | 4 | T-1 | 1 |
| A-18 | 3-$CH_3$ | 4-$CH_3$ | H | 3 | — | 0 |
| A-19 | 3-$CH_3$ | 4-$CH_3$ | H | 4 | — | 0 |
| A-20 | 3-$CH_3$ | 4-$CH_3$ | H | 3 | T-1 | 1 |
| A-21 | 3-$CH_3$ | 4-$CH_3$ | H | 4 | T-1 | 1 |
| A-22 | 3-$CH_3$ | 4-$CH_3$ | H | 4 | T-2 | 1 |
| A-24 | 3-$CH_3$ | 5-$CH_3$ | H | 3 | — | 0 |

TABLE 1-2

| No. | $R_1$ | $R_2$ | $R_3$ | P(T) | T | n |
|---|---|---|---|---|---|---|
| A-24 | 3-$CH_3$ | 5-$CH_3$ | H | 4 | — | 0 |
| A-25 | 4-$CH_3O$ | H | H | 3 | — | 0 |
| A-26 | 4-$CH_3O$ | H | H | 4 | — | 0 |
| A-27 | H | H | $CH_3$ | 3 | — | 0 |
| A-28 | H | H | $CH_3$ | 4 | — | 0 |
| A-29 | H | H | $CH_3$ | 3 | T-1 | 1 |
| A-30 | H | H | $CH_3$ | 4 | T-1 | 1 |
| A-31 | 4-$CH_3$ | H | $CH_3$ | 3 | — | 0 |
| A-32 | 4-$CH_3$ | H | $CH_3$ | 4 | — | 0 |
| A-33 | 4-$CH_3$ | H | $CH_3$ | 3 | T-1 | 1 |
| A-34 | 4-$CH_3$ | H | $CH_3$ | 4 | T-1 | 1 |
| A-35 | 3-$CH_3$ | 4-$CH_3$ | $CH_3$ | 4 | — | 0 |
| A-36 | 3-$CH_3$ | 4-$CH_3$ | $CH_3$ | 4 | T-4 | 1 |
| A-37 | 3-$CH_3$ | 5-$CH_3$ | $CH_3$ | 4 | — | 0 |
| A-38 | 3-$CH_3$ | 5-$CH_3$ | $CH_3$ | 4 | T-1 | 1 |
| A-39 | 3-$C_2H_5$ | H | H | 3 | — | 0 |
| A-40 | 4-$C_2H_5$ | H | H | 3 | — | 0 |
| A-41 | 4-$C_2H_5$ | H | H | 4 | — | 0 |
| A-42 | 4-$C_2H_5$ | H | H | 3 | T-1 | 1 |
| A-43 | 4-$C_2H_5$ | H | H | 4 | T-1 | 1 |
| A-44 | 2-$C_2H_5$ | H | $CH_3$ | 4 | — | 0 |
| A-45 | 3-$C_2H_5$ | H | $CH_3$ | 4 | — | 0 |
| A-46 | 4-$C_2H_5$ | H | $CH_3$ | 4 | — | 0 |

Specific examples of the compound represented by the foregoing general formula (B) are shown in Tables 1-3 to 1-7 below. In these Tables, "P(T)" represents the substituted position of —(T)n—OH.

TABLE 1-3

| No. | $Ar_1$ | $Ar_2$ | P(T) | T | n |
|---|---|---|---|---|---|
| B-1 | 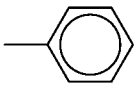 | 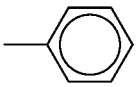 | 3 | — | 0 |
| B-2 | 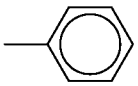 | 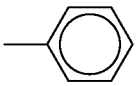 | 4 | — | 0 |

TABLE 1-3-continued
| No. | $Ar_1$ | $Ar_2$ | P(T) | T | n |
|---|---|---|---|---|---|
| B-3 | 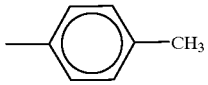 | 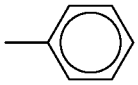 | 3 | — | 0 |
| B-4 | 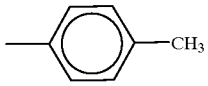 | 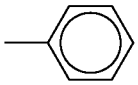 | 4 | — | 0 |
| B-5 | 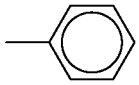 | 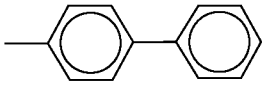 | 3 | — | 0 |
| B-6 | 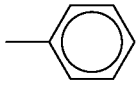 | 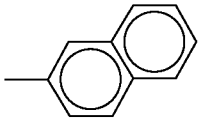 | 3 | — | 0 |
| B-7 | 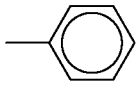 | 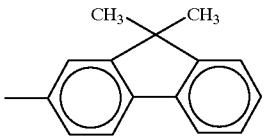 | 3 | — | 0 |
| B-8 | 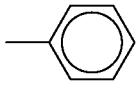 | 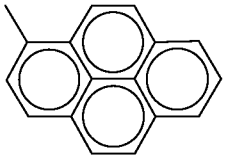 | 3 | — | 0 |
| B-9 | 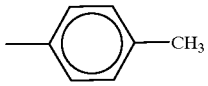 | 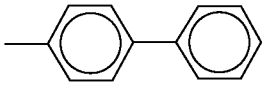 | 3 | — | 0 |
| B-10 | 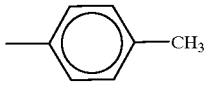 | 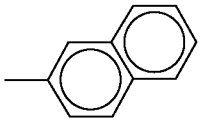 | 3 | — | 0 |
| B-11 | 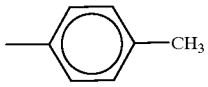 | 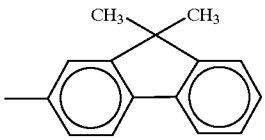 | 3 | — | 0 |
| B-12 | 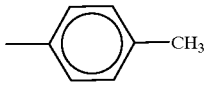 | 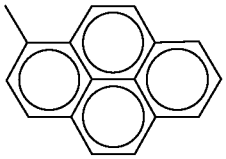 | 3 | — | 0 |

TABLE 1-4
| No. | $Ar_1$ | $Ar_2$ | P(T) | T | n |
|---|---|---|---|---|---|
| B-13 | 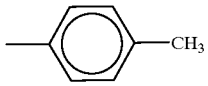 | 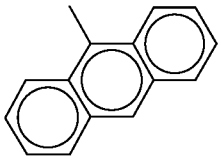 | 3 | — | 0 |
| B-14 | 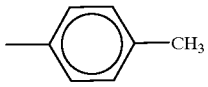 | 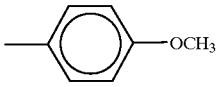 | 3 | — | 0 |
| B-15 | 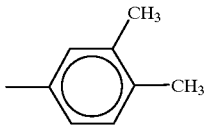 | 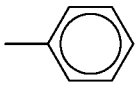 | 2 | — | 0 |
| B-16 | 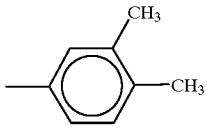 | 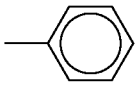 | 3 | — | 0 |
| B-17 | 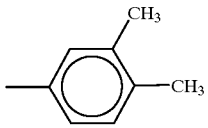 | 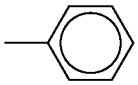 | 4 | — | 0 |
| B-18 | 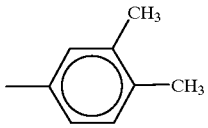 | 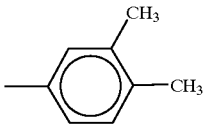 | 3 | — | 0 |
| B-19 | 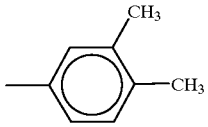 | 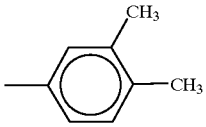 | 4 | — | 0 |
| B-20 | 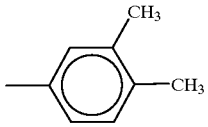 | 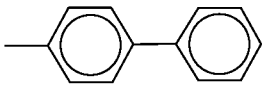 | 3 | — | 0 |
| B-21 | 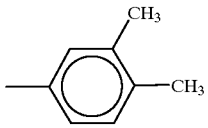 | 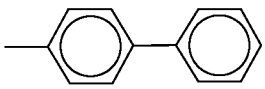 | 4 | — | 0 |
| B-22 | 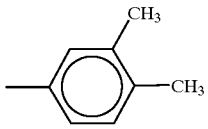 | 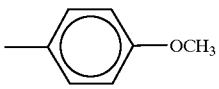 | 3 | — | 0 |

TABLE 1-4-continued
| No. | $Ar_1$ | $Ar_2$ | P(T) | T | n |
|---|---|---|---|---|---|
| B-23 | 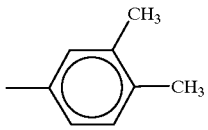 | 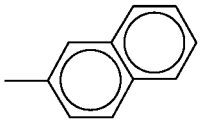 | 3 | — | 0 |
TABLE 1-5
| No. | $Ar_1$ | $Ar_2$ | P(T) | T | n |
|---|---|---|---|---|---|
| B-24 | 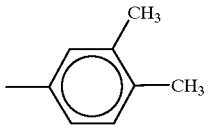 | 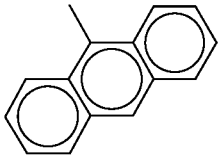 | 3 | — | 0 |
| B-25 | 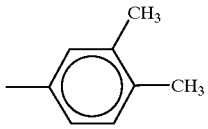 | 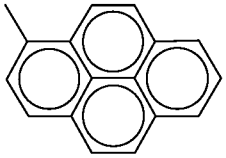 | 3 | — | 0 |
| B-26 | 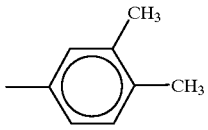 | 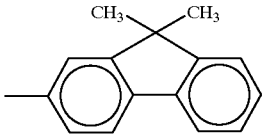 | 3 | — | 0 |
| B-27 | 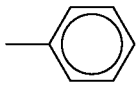 | 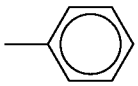 | 3 | T-1 | 1 |
| B-28 | 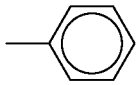 | 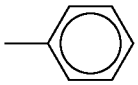 | 4 | T-1 | 1 |
| B-29 | 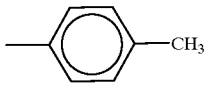 | 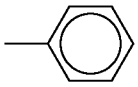 | 3 | T-1 | 1 |
| B-30 | 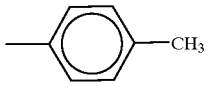 | 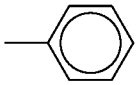 | 4 | T-1 | 1 |
| B-31 | 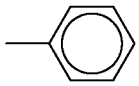 | 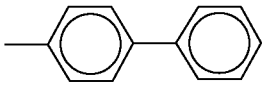 | 3 | T-1 | 1 |
| B-32 | 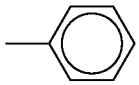 | 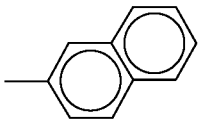 | 3 | T-1 | 1 |

TABLE 1-5-continued
| No. | $Ar_1$ | $Ar_2$ | P(T) | T | n |
|---|---|---|---|---|---|
| B-33 | 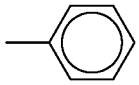 | 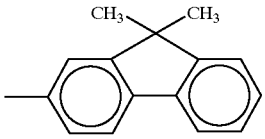 | 3 | T-1 | 1 |
| B-34 | 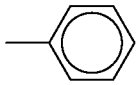 | 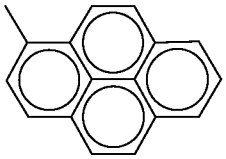 | 3 | T-1 | 1 |
| B-35 | 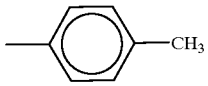 | 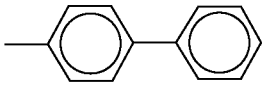 | 3 | T-1 | 1 |
TABLE 1-6
| No. | $Ar_1$ | $Ar_2$ | P(T) | T | n |
|---|---|---|---|---|---|
| B-36 | 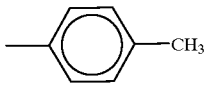 | 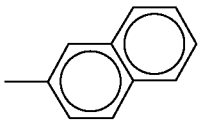 | 3 | T-1 | 1 |
| B-37 | 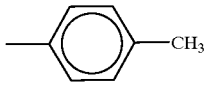 | 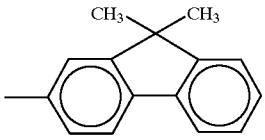 | 3 | T-1 | 1 |
| B-38 | 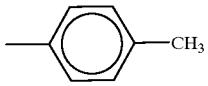 | 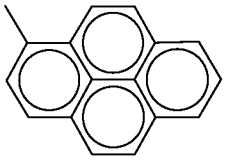 | 3 | T-1 | 1 |
| B-39 | 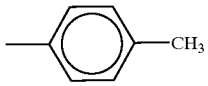 | 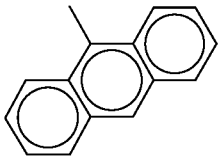 | 3 | T-1 | 1 |
| B-40 | 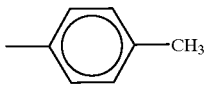 | 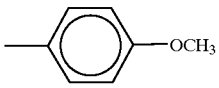 | 3 | T-1 | 1 |
| B-41 | 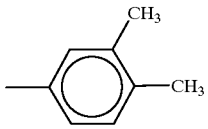 | 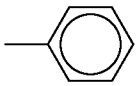 | 3 | T-1 | 1 |

TABLE 1-6-continued
| No. | $Ar_1$ | $Ar_2$ | P(T) | T | n |
|---|---|---|---|---|---|
| B-42 | 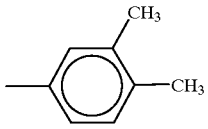 | 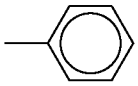 | 4 | T-1 | 1 |
| B-43 | 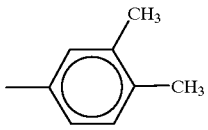 | 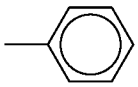 | 3 | T-2 | 1 |
| B-44 | 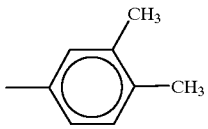 | 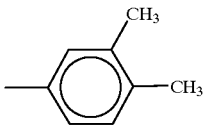 | 3 | T-1 | 1 |
| B-45 | 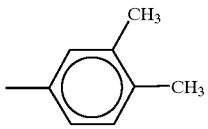 | 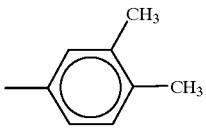 | 3 | T-2 | 1 |
| B-46 | 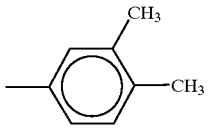 | 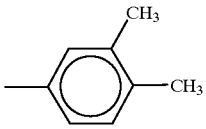 | 4 | T-1 | 1 |
TABLE 1-7
| No. | $Ar_1$ | $Ar_2$ | P(T) | T | n |
|---|---|---|---|---|---|
| B-47 | 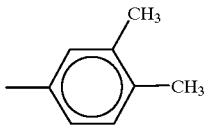 | 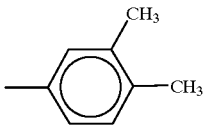 | 4 | T-2 | 1 |
| B-48 | 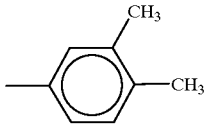 | 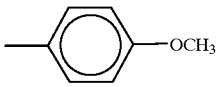 | 3 | T-1 | 1 |
| B-49 | 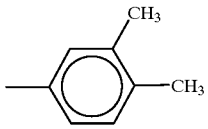 | 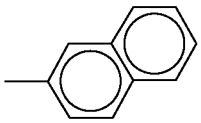 | 3 | T-1 | 1 |
| B-50 | 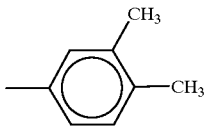 | 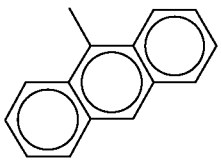 | 3 | T-1 | 1 |

TABLE 1-7-continued

| No. | $Ar_1$ | $Ar_2$ | P(T) | T | n |
|---|---|---|---|---|---|
| B-51 | 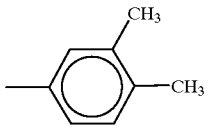 | 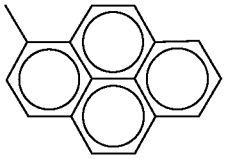 | 3 | T-1 | 1 |
| B-52 | 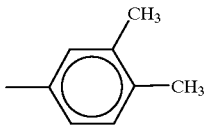 | 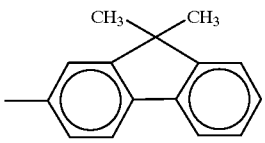 | 3 | T-1 | 1 |
| B-53 | 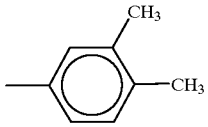 | 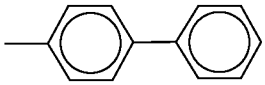 | 3 | T-1 | 1 |
| B-54 | 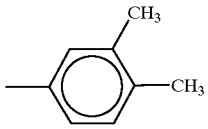 | 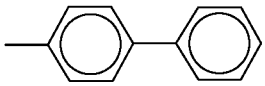 | 3 | T-2 | 1 |

As the hydroxyl group-containing compound employable herein there may be used a compound containing hydroxyl group besides the foregoing electric charge-transporting material containing hydroxyl group. Examples of the compound containing hydroxyl group include a compound containing two or more hydroxyl groups, and oligomer or polymer thereof. Examples of such a compound containing two or more hydroxyl groups and oligomer thereof include glycols such as ethylene glycol and propylene glycol, and polyethylene glycol. Examples of the polymer of such a compound include various polymers containing hydroxyl group such as acryl polyol and polyester polyol.

As the isocyanate group-containing compound to be used to undergo polyaddition reaction with the foregoing hydroxyl group-containing compound that allows bonding resulting in the formation of a three-dimensional network structure in the surface protective layer there may be used a compound having three or more isocyanate groups. Specific examples of such a compound include polyisocyanate monomers such as 1,3,6-hexamethylenetriisocyanate, lysine ester triisocyanate, 1,6,11-undecanetriisocyanate, 1,8-isocyanate-4-isocyanatemethyloctane, triphenylmethanetriisocyanate and tris(isocyanatephenyl)thiophosphate.

Among compounds having three or more isocyanate groups, modification products such as derivative from polyisocyanate monomer and prepolymer are preferably used from the standpoint of film-forming properties, cracking resistance and handling ability of the resulting crosslinked film. Particularly preferred examples of these modification products include urethane-modified products obtained by the modification of polyol with excess isocyanate compound, burette-modified products obtained by the modification of a compound having urea bond with an isocyanate compound, and alophanate-modified products having isocyanate added to urethane group. Other employable examples of these modification products include isocyanurate-modified products, and carbozimide-modified products. Further, block isocyanates obtained by the reaction of a blocking agent for temporarily masking the activity of an isocyanate group, which are included in the foregoing polyisocyanate-modified products, may be preferably used. As the isocyanate group to be used in modification there may be used one having two functional groups. Examples of such an isocyanate include tolylene diisocyanate (TDI), diphenylmethane diisocyanate (MDI), 1,5-naphthylene diisocyanate, tolidine diisocyanate, 1,6-hexamethylene diisocyanate, xylene diisocyanate, lysine diisocyanate, and tetramethylxylene diisocyanate.

The compound containing hydroxyl group and fluorine atom to be incorporated in the surface protective layer of the electrophotographic photoreceptor according to embodiment (1-2) of the present invention undergoes together with an electrophotographic photoreceptor containing hydroxyl group crosslinked polymerization reaction with an isocyanate compound having three or more functional groups to form a film. The surface of the film thus obtained exhibits excellent slip properties and release properties and thus is effective for the prevention of attachment or fixing of paper powder or toner to the surface of the photoreceptor. Examples of the compound containing hydroxyl group and fluorine atom employable herein include those obtained by substituting hydrogen atom in hydroxyl group-containing compounds such as glycols (e.g., ethylene glycol, propylene glycol and polyethylene glycol) and various polymers or prepolymers containing hydroxyl group (e.g., acryl polyol and polyester polyol) by fluorine. These hydroxyl group-containing compounds may have fluorine-substituted alkyl group.

Particularly preferred examples of the compound containing hydroxyl group and fluorine atom employable herein include fluorine-containing bisphenol derivatives represented by the following general formulae C-1 to C-11:

C-1

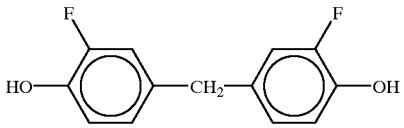

C-2

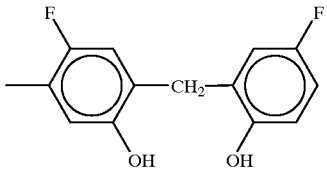

C-3

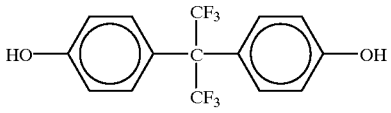

C-4

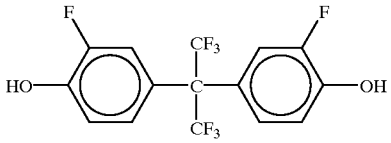

C-5

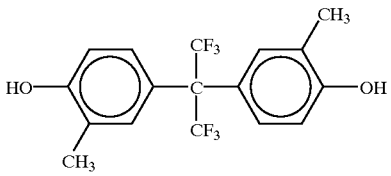

C-6

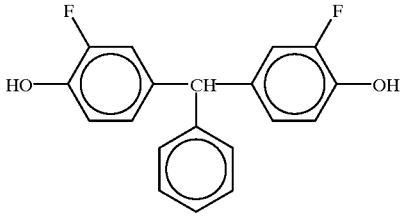

C-7

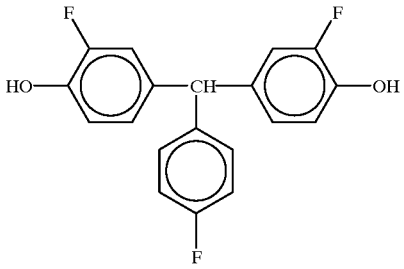

C-8

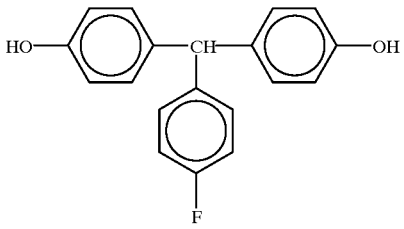

-continued

C-9

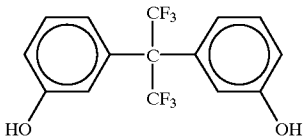

C-10

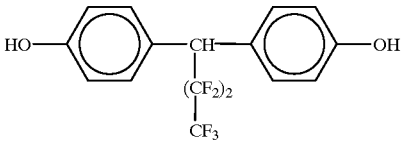

C-11

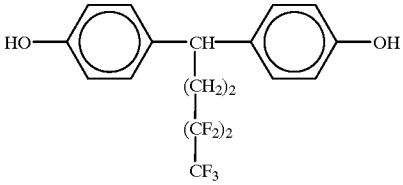

The bisphenol compound to be incorporated in the surface protective layer of the electrophotographic photoreceptor according to embodiment (1-3) of the present invention can undergo together with an electric charge-transporting material containing hydroxyl group polyaddition reaction with a polyisocyanate compound containing three or more isocyanate groups to form a three-dimensional network structure at a high crosslink density without difficulty. Therefore, a photoreceptor having such a surface protective layer exhibits an excellent abrasion resistance and a very high durability even under a strong external stress such as application of a.c. voltage and gas produced by discharge. Further, this bisphenol compound exhibits an excellent compatibility with the electric charge-transporting material containing hydroxyl group, making it possible to uniformly introduce an electric charge-transporting material in the network structure. The resulting photoreceptor can exhibit excellent photoelectric properties.

Particularly preferred examples of the bisphenol compound employable herein include compounds represented by the following general formulae D-1 to D-12, which exhibit excellent abrasion resistance and photoelectric properties.

D-1

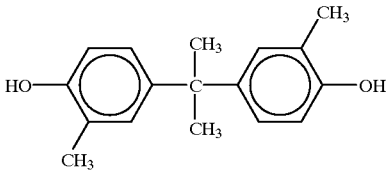

D-2

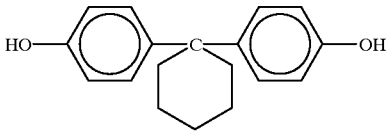

-continued

D-3

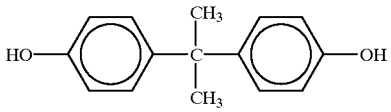

D-4

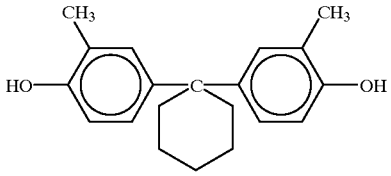

D-5

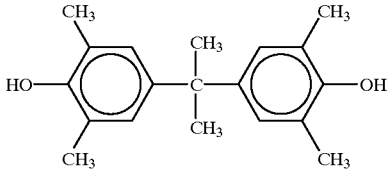

D-6

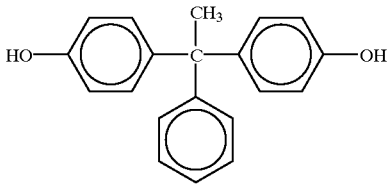

D-7

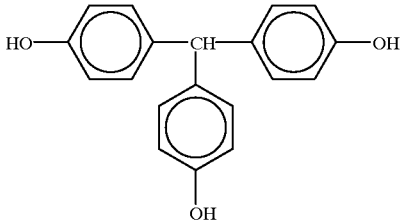

D-8

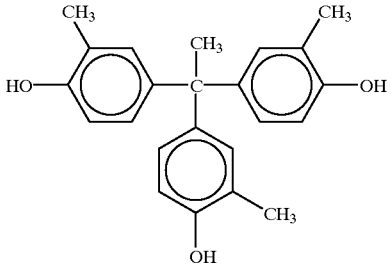

D-9

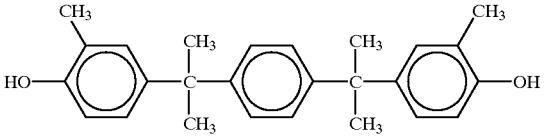

D-10

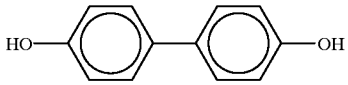

-continued

D-11

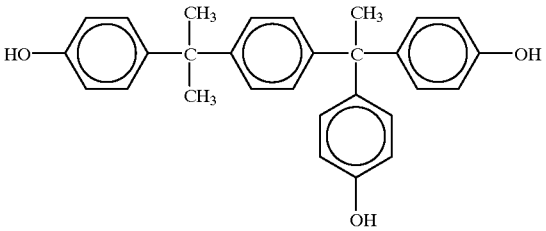

D-12

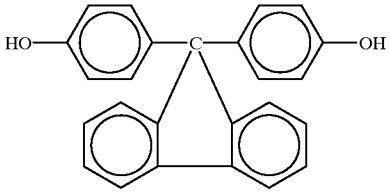

In the electrophotographic photoreceptor of the present invention, the surface protective layer is formed by a process which comprises optionally adding a properly selected solvent to the foregoing binding material to obtain a coating solution, applying the coating solution to the photosensitive layer, and then allowing the coating solution to undergo crosslinked polymerization to form a film.

The foregoing starting materials are preferably mixed in a proportion such that the total number of hydroxyl groups and the total number of isocyanate groups are almost equal to each other. In particular, if excess hydroxyl groups are left unreacted, the hydrophilicity of the surface protective layer is raised, possibly deteriorating the image properties under high temperature and humidity conditions. Therefore, attention should be called to the mixing ratio of starting materials, including reaction conditions. The content of the electric charge-transporting material in the surface protective layer needs to be determined such that the resulting photoreceptor has a desired mechanical strength while maintaining desired electrical properties. In practice, however, the content of the electric charge-transporting material moiety in the entire surface protective layer is preferably determined to a range of from 5 to 90% by weight, more preferably from 25 to 50% by weight. In the present invention, the surface protective layer has an electric charge-transporting material retained by chemical bond and thus can have an electric charge-transporting material incorporated therein in a greater amount than the conventional electric charge-transporting layer.

The surface protective layer of the present invention may comprise various binder resins incorporated therein to improve its film-forming properties and flexibility. As such a binder resin there may be used one having a good compatibility with the film thus crosslink-polymerized. For example, various polymers such as polycarbonate, polyester, acryl, polyvinyl alcohol and polyamide may be used. In practice, however, the content of the binder resin in the surface protective layer is preferably determined to not more than 60% by weight.

The crosslinked polymerization reaction for the formation of the surface protective layer is carried out by a process which comprises applying a coating solution containing a hydroxyl group-containing compound and an isocyanate group-containing compound to the photosensitive layer, and then heating the coated material. The crosslinked polymerization reaction by addition reaction of hydroxyl group with isocyanate group depends on the reactivity of the starting materials used. In general, however, it is not necessary that any catalyst or the like be added. The reaction may be effected only by heating. In order to accelerate this crosslinked polymerization reaction, a catalyst such as organic metal compound (e.g., dibutyltin dilaurate), inorganic metal compound, monoamine, diamine, triamine, cyclic amine, alcohol amine and ether amine may be added to the reaction system by an ordinary method. If a solvent is used during the application of the coating solution, heat treatment may be effected at the same time with or following the drying step.

In the present invention, the surface protective layer may comprise an oxidation inhibitor incorporated therein for the purpose of inhibiting the deterioration by an oxidizing gas such as ozone generated by the charger. As such an oxidation inhibitor there is preferably used a hindered phenol-based or hindered amine-based oxidation inhibitor. For example, known compounds such as organic sulfur-based oxidation inhibitor, phosphite-based oxidation inhibitor, dithiocarbaminate-based oxidation inhibitor, thiourea-based oxidation inhibitor and benzimidazole-based oxidation inhibitor may be used. The amount of the oxidation inhibitor to be added is preferably not more than 15% by weight, more preferably not more than 10% by weight based on the weight of the surface protective layer.

Examples of the electrically-conductive substrate to be used in the electrophotographic photoreceptor of the present invention include metal such as aluminum, nickel, chromium and stainless steel, plastic film having a thin film made of aluminum, titanium, nickel, chromium, stainless steel, gold, vanadium, tin oxide, indium oxide and ITO provided thereon, and paper or plastic film coated or impregnated with an electrical conductivity donative agent. Such an electrically-conductive substrate may be used in a proper form such as drum, sheet and plate, but the present invention is not limited thereto. The surface of the electrically-conductive substrate may be optionally subjected to various treatments so far as the image quality is not impaired. For example, the surface of the electrically-conductive substrate may be subjected to oxidation, chemical treatment, coloring or treatment for providing irregular reflection such as graining.

In the electrophotographic photoreceptor of the present invention, a subbing layer may be provided interposed between the electrically-conductive substrate and the photosensitive layer. The subbing layer prevents electrical charge from being injected into the photosensitive layer from the electrically-conductive substrate during charging of a laminated photosensitive layer. At the same time, the subbing layer acts as an adhesive layer for integrally gluing the photosensitive layer to the electrically-conductive substrate. In some cases, the subbing layer inhibits the reflection of light by the electrically-conductive substrate.

The subbing layer may comprise as a binder resin a known material such as polyethylene resin, polypropylene resin, acrylic resin, methacrylic resin, polyamide resin, vinyl chloride resin, vinyl acetate resin, phenolic resin, polycarbonate resin, polyurethane resin, polyimide resin, vinylidene chloride resin, polyvinyl acetal resin, vinyl chloride-vinyl acetate copolymer, polyvinyl alcohol resin, water-soluble polyester resin, nitrocellulose, casein, gelatin, polyglutamic acid, starch, starch acetate, aminostarch, polyacrylic acid, polyacrylamide, zirconium chelate compound, titanyl chelate compound, titanyl alkoxide compound, organic titanyl compound and silane coupling agent incorporated therein. These materials may be used singly or in combination. These materials may be used in admixture with a particulate material made of titanium oxide, silicon oxide, zirconium oxide, barium titanate, silicone resin or the like.

The thickness of the subbing layer is normally from 0.01 to 10 $\mu$m, preferably from 0.05 to 2 $\mu$m. The application of the subbing layer coating solution can be accomplished by an ordinary method such as blade coating, wire bar coating, spray coating, dip coating, bead coating, air knife coating and curtain coating.

In the present invention, the electric charge-generating layer of the laminated photoreceptor comprises at least an electric charge-generating material and a binder resin incorporated therein. Examples of the electric charge-generating material employable herein include inorganic photoconductive materials such as amorphous selenium, crystalline selenium-tellurium alloy, selenium-arsenic alloy, other selenium compounds and selenium alloys, zinc oxide and titanium oxide, and organic pigments or dyes such as phthalocyanine, squarilium, anthanthron, perylene, azo, anthraquinone, pyrene, pyrylium salt and thipyrylium salt. Preferred among these electric charge-generating materials is phthalocyanine compound from the standpoint of the photosensitivity of the photoreceptor. Preferred examples of such a phthalocyanine compound include metal-free phthalocyanine, titanyl phthalocyanine, chlorogallium phthalocyanine, and hydroxygallium phthalocyanine. Particularly preferred among these phthalocyanine compounds are chlorogallium phthalocyanine having a specific crystal form and showing strong diffraction peaks at 7.4°, 16.6°, 25.5° and 28.3° as Bragg angle (2θ±0.2°) in X-ray diffraction spectrum and hydroxygallium phthalocyanine having a specific crystal form and showing strong diffraction peaks at 7.5°, 9.9°, 12.5°, 16.3°, 18.6°, 25.1° and 28.3° as Bragg angle (2θ±0.2°) in X-ray diffraction spectrum, which exhibits a high efficiency of electric charge generation within a wide wavelength range from visible light to near infrared rays. These phthalocyanine crystals having a specific crystal form can be obtained by the following synthesis examples.

SYNTHESIS EXAMPLE 1-1

30 parts of 1,3-diiminoisoindoline and 9.1 parts of gallium trichloride were added to 230 parts of quinoline. The mixture was then allowed to undergo reaction at a temperature of 200° C. for 3 hours. The resulting reaction product was withdrawn by filtration, and then washed with acetone and methanol. The wet cake thus obtained was then dried to obtain 28 parts of chlorogallium phthalocyanine in the form of crystal. Subsequently, 3 parts of chlorogallium phthalocyanine crystal thus obtained were dry-ground in an automatic mortar (Type UT-21 Lab Mill, available from Yamato Scientific Co., Ltd.). 0.2 parts of chlorogallium phthalocyanine crystal thus ground were then subjected to milling with 60 parts of glass beads (1 mmϕ) in 20 parts of benzyl alcohol at room temperature for 24 hours. The glass beads were then removed by filtration. The filtrate was washed with 10 parts of methanol, and then dried to obtain chlorogallium phthalocyanine crystal showing strong diffraction peaks at 7.4°, 16.6°, 25.5° and 28.3° as Bragg angle (2θ±0.2°) in X-ray diffraction spectrum.

SYNTHESIS EXAMPLE 1-2

3 parts of chlorogallium phthalocyanine crystal obtained in Synthesis Example 1 were dissolved in 60 parts of concentrated sulfuric acid at a temperature of 0° C. The solution thus obtained was then added dropwise to 450 parts of 5° C. distilled water to effect recrystallization. The recrystallized product thus obtained was washed with distilled water and dilute aqueous ammonia, and then dried to obtain 2.5 parts of hydroxygallium phthalocyanine crystal. The crystal thus obtained was then ground in an automobile mortar for 5.5 hours. 0.5 parts of the crystal thus ground were then subjected to milling with 15 parts of dimethylformamide and 30 parts of glass beads (1 mmϕ) for 24 hours. The crystal thus obtained was separated, washed with methanol, and then dried to obtain hydroxygallium phthalocyanine crystal showing strong diffraction peaks at 7.5°, 9.9°, 12.5°, 16.3°, 18.6°, 25.1° and 28.3° as Bragg angle (2θ±0.2°) in CuKα characteristic X-ray diffraction spectrum.

Examples of the binder resin to be incorporated in the electric charge-generating layer employable herein include polyvinyl butyral resin, polyvinyl formal resin, partially-modified polyvinyl acetal resin, polycarbonate resin, polyester resin, acrylic resin, polyvinyl chloride resin, polystyrene resin, polyvinyl acetate resin, vinyl chloride-vinyl acetate copolymer, silicone resin, phenolic resin, and poly-N-vinylcarbazole resin. The present invention is not limited to these binder resins. These binder resins may be used singly or in admixture.

The mixing ratio (by weight) of electric charge-generating layer and binder resin is preferably from 10:1 to 1:10. The thickness of the electric charge-generating layer to be used herein is normally from 0.1 to 5 μm, preferably from 0.2 to 2.0 μm. The application of the electric charge-generating layer coating solution can be accomplished by an ordinary method such as blade coating method, wire bar coating method, spray coating method, dip coating method, bead coating method, air knife coating method and curtain coating method.

As the solvent to be used in the formation of the electric charge-generating layer there may be used an ordinary organic solvent such as methanol, ethanol, n-propanol, n-butanol, benzyl alcohol, methyl cellosolve, ethyl cellosolve, acetone, methyl ethyl ketone, cyclohexanone, methyl acetate, n-butyl acetate, dioxane, tetrahydrofuran, methylene chloride and chloroform. These solvents may be used singly or in admixture.

The electric charge-transporting layer of the laminated photoreceptor of the present invention comprises at least an electric charge-transporting material and a binder resin incorporated therein. The electric charge-transporting layer may be either a low molecular dispersed electric charge-transporting layer or a high molecular electric charge-transporting layer having an electric charge-transporting function itself. Examples of the electric charge-transporting material employable herein include quinone compounds such as p-benzoquinone, chloranil, bromoanil and anthraquinone, fluorenone compounds such as tetracyanoquinodimethane compound and 2,4,7-trinitrofluorenone, electron attractive substances such as xanthone compound, benzophenone compound, cyanovinyl compound and ethylene compound, triarylamine compounds, benzidine compounds, arylalkane compounds, aryl-substituted ethylene compounds, stilbene compounds,-anthracene compounds, and hydrazone compounds. These electric charge-transporting materials may be used singly or in admixture.

Particularly preferred examples of the electric charge-transporting material employable herein are benzidine compounds represented by the following general formula (a) and triphenylamine compounds represented by the following general formula (b), which exhibit a high capability of transporting electric charge (hole) and an excellent stability. These compounds may be used singly or in admixture.

(a)

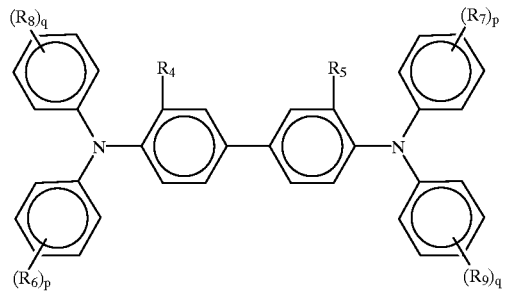

wherein $R_4$ and $R_5$ may be the same or different and each represent a hydrogen atom, halogen atom or $C_{1-5}$ alkyl or alkoxy group; $R_6$, $R_7$, $R_8$ and $R_9$ may be the same or different and each represent a hydrogen atom, halogen atom, $C_{1-5}$ alkyl or alkoxy group or amino group represented by $C_{1-2}$ alkyl group; and p and q each represent an integer of 1 or 2;

(b)

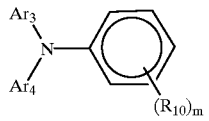

wherein $R_{10}$ represents a hydrogen atom or methyl group; $Ar_3$ and $Ar_4$ each represent an unsubstituted aryl group or an aryl group substituted by halogen atom, $C_{1-5}$ alkyl or alkoxy group or amino group substituted by $C_{1-3}$ alkyl group; and m represents an integer or 1 or 2.

Specific examples of the compound represented by the foregoing general formula (a) are shown in Tables 1-8 to 1-10 below.

TABLE 1-8

| No. | $R_4$, $R_5$ | $R_6$, $R_7$ | p | $R_8$, $R_9$ | q |
|---|---|---|---|---|---|
| 1 | $CH_3$ | H | 1 | H | 1 |
| 2 | $CH_3$ | 2-$CH_3$ | 1 | H | 1 |
| 3 | $CH_3$ | 3-$CH_3$ | 1 | H | 1 |
| 4 | $CH_3$ | 4-$CH_3$ | 1 | H | 1 |
| 5 | $CH_3$ | 4-$CH_3$ | 1 | 2-$CH_3$ | 1 |
| 6 | $CH_3$ | 4-$CH_3$ | 1 | 3-$CH_3$ | 1 |
| 7 | $CH_3$ | 4-$CH_3$ | 1 | 4-$CH_3$ | 1 |
| 8 | $CH_3$ | 3,4-$CH_3$ | 2 | H | 1 |
| 9 | $CH_3$ | 3,4-$CH_3$ | 2 | 3,4-$CH_3$ | 2 |
| 10 | $CH_3$ | 4-$C_2H_5$ | 1 | H | 1 |
| 11 | $CH_3$ | 4-$C_3H_7$ | 1 | H | 1 |
| 12 | $CH_3$ | 4-$C_4H_9$ | 1 | H | 1 |
| 13 | $CH_3$ | 4-$C_2H_5$ | 1 | 2-$CH_3$ | 1 |
| 14 | $CH_3$ | 4-$C_2H_5$ | 1 | 3-$CH_3$ | 1 |
| 15 | $CH_3$ | 4-$C_2H_5$ | 1 | 4-$CH_3$ | 1 |
| 16 | $CH_3$ | 4-$C_2H_5$ | 1 | 3,4-$CH_3$ | 2 |
| 17 | $CH_3$ | 4-$C_3H_7$ | 1 | 3-$CH_3$ | 1 |
| 18 | $CH_3$ | 4-$C_3H_7$ | 1 | 4-$CH_3$ | 1 |
| 19 | $CH_3$ | 4-$C_4H_9$ | 1 | 3-$CH_3$ | 1 |
| 20 | $CH_3$ | 4-$C_4H_9$ | 1 | 4-$CH_3$ | 1 |

TABLE 1-9

| No. | $R_4$, $R_5$ | $R_6$, $R_7$ | p | $R_8$, $R_9$ | q |
|---|---|---|---|---|---|
| 21 | $CH_3$ | 4-$C_2H_5$ | 1 | 4-$C_2H_5$ | 1 |
| 22 | $CH_3$ | 4-$C_2H_5$ | 1 | 4-$OCH_3$ | 1 |
| 23 | $CH_3$ | 4-$C_3H_7$ | 1 | 4-$C_3H_7$ | 1 |
| 24 | $CH_3$ | 4-$C_3H_7$ | 1 | 4-$OCH_3$ | 1 |
| 25 | $CH_3$ | 4-$C_3H_9$ | 1 | 4-$C_4H_9$ | 1 |
| 26 | $CH_3$ | 4-$C_4H_9$ | 1 | 4-$OCH_3$ | 1 |
| 27 | H | 3-$CH_3$ | 1 | H | 1 |
| 28 | Cl | H | 1 | H | 1 |
| 29 | Cl | 2-$CH_3$ | 1 | H | 1 |
| 30 | Cl | 3-$CH_3$ | 1 | H | 1 |
| 31 | Cl | 4-$CH_3$ | 1 | H | 1 |
| 32 | Cl | 4-$CH_3$ | 1 | 2-$CH_3$ | 1 |
| 33 | Cl | 4-$CH_3$ | 1 | 3-$CH_3$ | 1 |
| 34 | Cl | 4-$CH_3$ | 1 | 4-$CH_3$ | 1 |
| 35 | $C_2H_5$ | H | 1 | H | 1 |
| 36 | $C_2H_5$ | 3-$CH_3$ | 1 | H | 1 |
| 37 | $C_2H_5$ | 3-$CH_3$ | 1 | H | 1 |
| 38 | $C_2H_5$ | 4-$CH_3$ | 1 | H | 1 |
| 39 | $C_2H_5$ | 4-$CH_3$ | 1 | 4-$CH_3$ | 1 |
| 40 | $C_2H_5$ | 4-$C_2H_5$ | 1 | 4-$CH_3$ | 1 |

TABLE 1-10

| No. | $R_4$, $R_5$ | $R_6$, $R_7$ | p | $R_8$, $R_9$ | q |
|---|---|---|---|---|---|
| 41 | $C_2H_5$ | 4-$C_3H_7$ | 1 | 4-$CH_3$ | 1 |
| 42 | $C_2H_5$ | 4-$C_4H_9$ | 1 | 4-$CH_3$ | 1 |
| 43 | $OCH_3$ | H | 1 | H | 1 |
| 44 | $OCH_3$ | 2-$CH_3$ | 1 | H | 1 |
| 45 | $OCH_3$ | 3-$CH_3$ | 1 | H | 1 |
| 46 | $OCH_3$ | 4-$CH_3$ | 1 | H | 1 |
| 47 | $OCH_3$ | 4-$CH_3$ | 1 | 4-$CH_3$ | 1 |
| 48 | $OCH_3$ | 4-$C_2H_5$ | 1 | 4-$CH_3$ | 1 |
| 49 | $OCH_3$ | 4-$C_3H_7$ | 1 | 4-$CH_3$ | 1 |
| 50 | $OCH_3$ | 4-$C_4H_9$ | 1 | 4-$CH_3$ | 1 |
| 51 | $CH_3$ | 2-$N(CH_3)_2$ | 1 | H | 1 |
| 52 | $CH_3$ | 3-$N(CH_3)_2$ | 1 | H | 1 |
| 53 | $CH_3$ | 4-$N(CH_3)_2$ | 1 | H | 1 |
| 54 | $CH_3$ | 4-Cl | 1 | H | 1 |

Specific examples of the compound represented by the foregoing general formula (b) are shown in Tables 1-11 to 1-13 below.

TABLE 1-11

| No. | $R_{10}$ | $Ar_3$ | $Ar_4$ |
|---|---|---|---|
| 1 | 4-$CH_3$ | 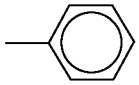 | 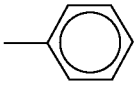 |
| 2 | 3,4-$CH_3$ | | |
| 3 | 4-$CH_3$ | 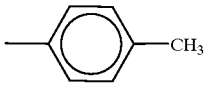 | 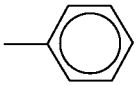 |
| 4 | 3,4-$CH_3$ | | |
| 5 | 4-$CH_3$ | 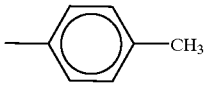 | 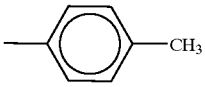 |
| 6 | 3,4-$CH_3$ | | |
| 7 | 4-$CH_3$ | 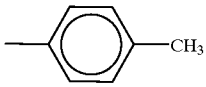 | 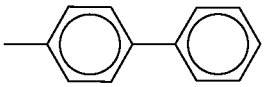 |
| 8 | 3,4-$CH_3$ | | |
| 9 | 4-$CH_3$ | 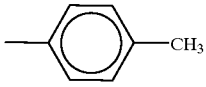 | 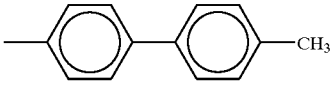 |
| 10 | 3,4-$CH_3$ | | |
| 11 | 4-$CH_3$ | 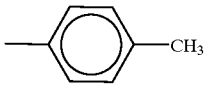 | 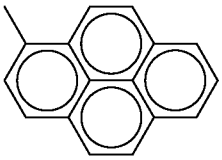 |
| 12 | 3,4-$CH_3$ | | |

TABLE 1-11-continued
| No. | $R_{10}$ | $Ar_3$ | $Ar_4$ |
|---|---|---|---|
| 13<br>14 | 4-$CH_3$<br>3,4-$CH_3$ | 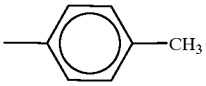 | 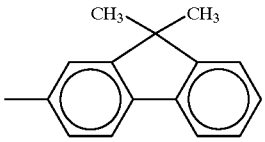 |
| 15<br>16 | 4-$CH_3$<br>3,4-$CH_3$ | 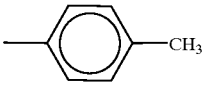 | 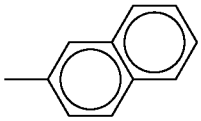 |
| 17<br>18 | 4-$CH_3$<br>3,4-$CH_3$ | 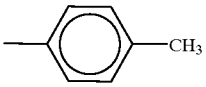 | 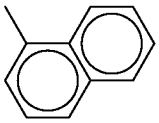 |
| 19<br>20 | 4-$CH_3$<br>3,4-$CH_3$ | 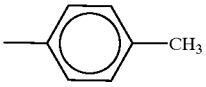 | 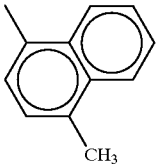 |
TABLE 1-12
| No. | $R_{10}$ | $Ar_3$ | $Ar_4$ |
|---|---|---|---|
| 21<br>22 | 4-$CH_3$<br>3,4-$CH_3$ | 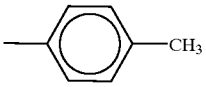 | 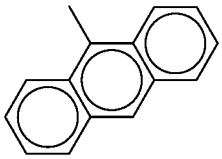 |
| 23<br>24 | 4-$CH_3$<br>3,4-$CH_3$ | 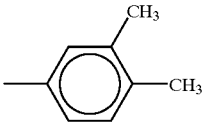 | 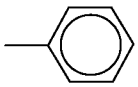 |
| 25<br>26 | 4-$CH_3$<br>3,4-$CH_3$ | 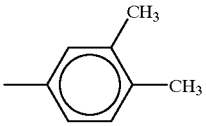 | 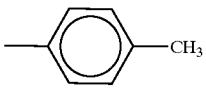 |
| 27<br>28 | 4-$CH_3$<br>3,4-$CH_3$ | 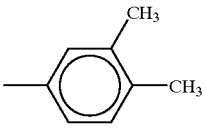 | 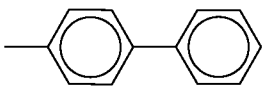 |

TABLE 1-12-continued
| No. | $R_{10}$ | $Ar_3$ | $Ar_4$ |
|---|---|---|---|
| 29<br>30 | 4-$CH_3$<br>3,4-$CH_3$ | 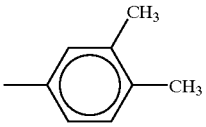 | 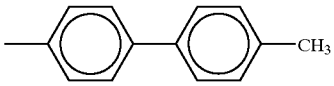 |
| 31<br>32 | 4-$CH_3$<br>3,4-$CH_3$ | 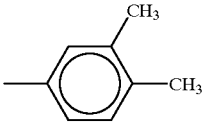 | 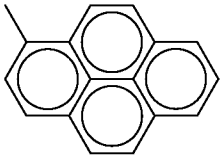 |
| 33<br>34 | 4-$CH_3$<br>3,4-$CH_3$ | 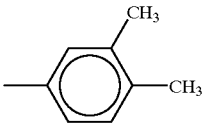 | 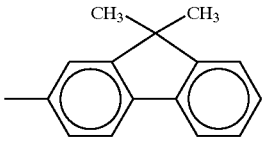 |
| 35<br>36 | 4-$CH_3$<br>3,4-$CH_3$ | 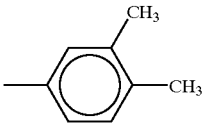 | 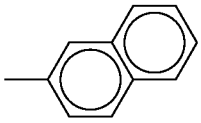 |
| 37<br>38 | 4-$CH_3$<br>3,4-$CH_3$ | 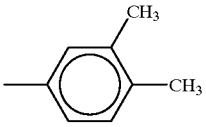 | 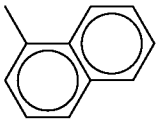 |
| 39<br>40 | 4-$CH_3$<br>3,4-$CH_3$ | 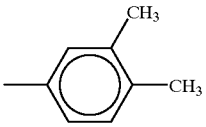 | 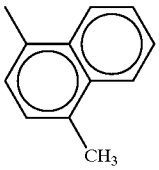 |
TABLE 1-13
| No. | $R_{10}$ | $Ar_3$ | $Ar_4$ |
|---|---|---|---|
| 41<br>42 | 4-$CH_3$<br>3,4-$CH_3$ | 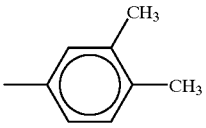 | 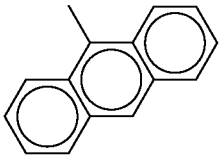 |

TABLE 1-13-continued
| No. | $R_{10}$ | $Ar_3$ | $Ar_4$ |
|---|---|---|---|
| 43<br>44 | 4-$CH_3$<br>3,4-$CH_3$ | 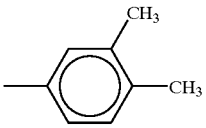 | 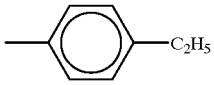 |
| 45<br>46 | 4-$CH_3$<br>3,4-$CH_3$ | 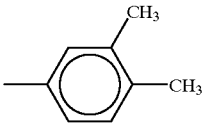 | 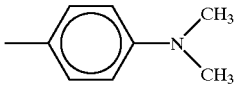 |
| 47<br>48 | 4-$CH_3$<br>3,4-$CH_3$ | 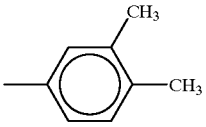 | 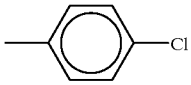 |
| 49<br>50 | 4-$CH_3$<br>3,4-$CH_3$ | 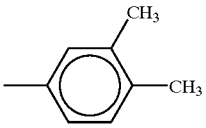 | 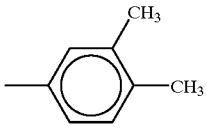 |
| 51<br>52 | 4-$CH_3$<br>3,4-$CH_3$ | 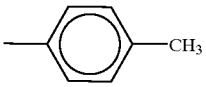 | 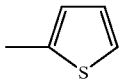 |
| 53<br>54 | 4-$CH_3$<br>3,4-$CH_3$ | 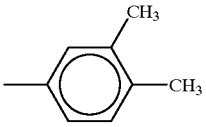 | 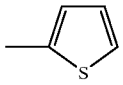 |
| 55<br>56 | 4-$CH_3$<br>3,4-$CH_3$ | 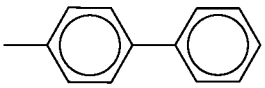 | 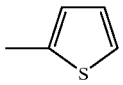 |
| 57<br>58 | 4-$CH_3$<br>3,4-$CH_3$ | 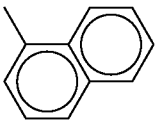 | 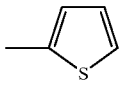 |
| 59<br>60 | 4-$CH_3$<br>3,4-$CH_3$ | 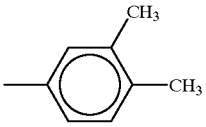 | 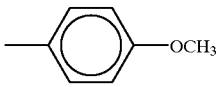 |

TABLE 1-13-continued

| No. | $R_{10}$ | $Ar_3$ | $Ar_4$ |
|---|---|---|---|
| 61 | 4-$CH_3$ | 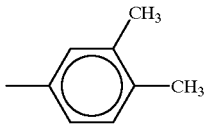 | 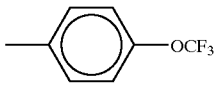 |
| 62 | 3,4-$CH_3$ | | |

As the binder resin to be incorporated in the electric charge-transporting layer there may be used a known resin such as polycarbonate resin, polyester resin, methacrylic resin, acrylic resin, vinyl chloride resin, vinylidene chloride resin, polystyrene resin, polyvinyl acetate resin, styrene-butadiene copolymer, vinylidene chloride-acrylonitrile copolymer, vinyl chloride-vinyl acetate copolymer, vinyl chloride-vinyl acetate-maleic anhydride copolymer, silicone resin, silicone-alkyd resin, phenol-formaldehyde resin, styrene-acryl resin, styrene-alkyd resin, poly-N-vinylcarbazole and polysilane.

Further, the electric charge-transporting layer may comprise the foregoing oxidation inhibitor for surface protective layer incorporated therein. Since the electric charge-transporting layer is not the outermost layer, it is not brought into direct contact with an oxidizing gas. However, such an oxidizing gas can penetrate the surface protective layer to reach the electric charge-transporting layer. In order to prevent the attack by such an oxidizing gas, the electric charge-transporting layer may comprise an oxidation inhibitor incorporated therein as necessary. Specific examples of such an oxidation inhibitor include those described above. The amount of such an oxidation inhibitor to be added, too, is as mentioned above, i.e., not more than 15% by weight, more preferably not more than 10% by weight.

As the solvent for forming the electric charge-transporting layer there may be used an ordinary organic solvent such as aromatic hydrocarbons (e.g., benzene, toluene, xylene, chlorobenzene), ketones (e.g., acetone, 2-butanone), halogenated aliphatic hydrocarbons (e.g., methylene chloride, chloroform, ethylene chloride) and cyclic or straight-chain ethers (e.g., tetrahydrofuran, ethyl ether, dioxane). These organic solvents may be used singly or in admixture.

In the electrophotographic photoreceptor, if it is of single photosensitive layer type, the photosensitive layer is formed by at least the electric charge-generating materials and binder resins mentioned above. As the binder resin there may be used the same binder resin as incorporated in the foregoing electric charge-generating layer and electric charge-transporting layer. The content of the electric charge-generating material in the single photosensitive layer is from 10 to 85% by weight, preferably from 20 to 50% by weight. The single photosensitive layer may comprise an oxidation inhibitor incorporated therein for the same reason as used in the electric charge-transporting layer. The amount of the oxidation inhibitor to be added is not more than 15% by weight, preferably not more than 10% by weight. Further, the single photosensitive layer may comprise the foregoing electric charge-transporting material incorporated therein for the purpose of improving the photoelectric properties thereof or like purposes. The amount of the electric charge-transporting material to be added is not more than 70% by weight, preferably not more than 50% by weight.

The image forming apparatus of the present invention comprises at least the foregoing electrophotographic photoreceptor and charging means for charging the photoreceptor to a predetermined surface potential, and exposure means for forming an electrostatic latent. image, development means for rendering the electrostatic latent image visible, and transferring means for transferring a developing material from the photoreceptor to paper or the like as necessary. The electrophotographic photoreceptor of the present invention may be used in a non-contact charging process image forming apparatus employing scorotron or the like as a charging means. In this case, too, the electrophotographic photoreceptor of the present invention exhibits excellent photoelectric properties and durability, particularly excellent ozone resistance. If used in a contact charging process image forming apparatus employing a charging roll or the like as a charging means, the electrophotographic photoreceptor of the present invention can exhibit an excellent durability against remarkable abrasion which would occur during contact charging.

FIG. 1 illustrates an embodiment of the image forming apparatus comprising the electrophotographic photoreceptor of the present invention. The image forming apparatus is arranged such that a charging means 3 such as charging roll into which a voltage is supplied from a power supply 2 provided outside the apparatus is brought into contact with a photoreceptor drum 1. Provided around the photoreceptor drum 1 are an image inputting apparatus 4 such as laser exposure optical system, a developing machine 5 loaded with a magnetic unitary toner or the like, a transferring machine 6 such as pressure transferring machine and electrostatic transferring machine, a cleaner device 8, and a destaticizing exposure apparatus 10 such as destaticizing LED array. Shown at the reference numerals 7 and 9 are paper and fixing apparatus, respectively. In order to charge the photoreceptor drum 1 by a contact charging process employing as the charging machine 3 a charging roll made of an electrically-conductive material in the image forming apparatus of the present invention, d.c. voltage having a.c. voltage superimposed thereon is applied to the charging roll to form an image.

The electrically-conductive member for effecting contact charging may be in any form such as brush, blade, pin electrode and roller, particularly roller. The roller-shaped member normally comprises a resistive layer as the outermost layer, an elastic layer supporting the resistive layer, and a core material. A protective layer may be provided on the resistive layer as necessary. The core material is electrically-conductive and normally comprises iron, copper, brass, stainless steel, aluminum, nickel or the like. Alternatively, a molded resin product having other particulate electrically-conductive materials dispersed therein may be used. The material of the elastic layer is electrically-conductive or semiconductive. In general, a rubber material having a particulate electrically-conductive or semiconductive material dispersed therein may be used. Examples of the rubber material employable herein include EPDM, polybutadiene, natural rubber, polyisobutylene, SBR, CR, NBR, silicone rubber, urethane rubber, epichlorohydrin rubber, SBS, thermoplastic elastomer, norbornene rubber, fluorosilicone rubber, and ethylene oxide rubber. Examples of the material constituting the particulate electrically-conductive or semiconductive material include metal such as carbon black, zinc, aluminum, copper, iron, nickel, chromium and titanium, and metal oxide such as ZnO—$Al_2O_3$, $SnO_2$—$Sb_2O_3$, $In_2O_3$—$SnO_2$, ZnO—$TiO_2$, MgO—$Al_2O_3$, FeO—$TiO_2$, $TiO_2$, $SnO_2$, $Sb_2O_3$, $In_2O_3$, ZnO and MgO. These materials may be used singly or in admixture. If two or more of these materials are used in admixture, one of them may be particulate. As the particulate material there may be used a particulate fluororesin.

The material constituting the resistive layer and protective layer of the roller-shaped member has a particulate electrically-conductive or semiconductive material dispersed in a binder to exhibit a properly-controlled resistivity. The resistivity of the resistive layer and protective layer is from $10^3$ to $10^{14}$ Ω·cm, preferably from $10^5$ to $10^{12}$ Ω·cm, more preferably from $10^7$ to $10^{12}$ Ω·cm. The thickness of the resistive layer and protective layer is from 0.01 to 1,000 μm, preferably from 0.1 to 500 μm, more preferably from 0.5 to 100 μm. Examples of the binder resin employable herein include acrylic resin, cellulose resin, polyamide resin, methoxymethylated nylon, ethoxymethylated nylon, polyurethane resin, polycarbonate resin, polyester resin, polyethylene resin, vinyl chloride resin, polyarylate resin, polythiophene resin, polyolefin resin such as PFA, PEP and PET, and styrene-butadiene resin. As the particulate electrically-conductive or semiconductive material there may be used the same carbon black, metal or metal oxide as used in the elastic layer.

The foregoing material may comprise an oxidation inhibitor such as hindered phenol and hindered amine, a filler such as clay and kaolin and a lubricant such as silicone oil incorporated therein as necessary. The formation of these layers can be accomplished by an ordinary method such as blade coating method, wire bar coating method, spray coating method, dip coating method, bead coating method, air knife coating method, curtain coating method, vacuum metallizing and plasma coating method.

In order to charge the electrophotographic photoreceptor using these electrically-conductive members, a voltage is applied to these electrically-conductive members. The voltage to be applied is preferably d.c. voltage having a.c. voltage superimposed thereon. If only d.c. voltage is applied, uniform charging can be hardly effected. Referring to the range of voltage used, d.c. voltage preferably ranges from + or −50 to 2,000 V, particularly from + or −100 to 1,500 V. The a.c. voltage to be superimposed on d.c. voltage ranges from 400 to 1,800 V, preferably from 800 to 1,600 V, more preferably 1,200 to 1,600 V. The frequency of a.c. voltage is from 50 to 20,000 Hz, preferably from 100 to 2,000 Hz.

The following descriptions mainly related to the above described embodiments (2-1) to (2-13).

The photosensitive layer for us herein may be either a so-called monolayer type photoreceptor or a laminated photoreceptor comprising a charge generating layer and a charge transporting layer. The order of lamination of the charge generating layer and the charge transporting layer may be any. However, the surface protective layer used in the present invention has hole transporting properties, so that it exhibits the most excellent characteristics in the case of a negative charge type laminated photoreceptor in which the charge generating layer, the charge transporting layer and the surface protective layer are laminated in this order.

FIGS. 2–5 each is a schematic sectional view showing an embodiment of the structure of the photoreceptor for use in the present invention. The photoreceptor shown in FIG. 2 comprises an electrically-conductive substrate 13 having thereon a photosensitive layer comprising a charge-generating layer 11 and a charge-transporting layer 12, and a surface protective layer 15. The photoreceptor shown in FIG. 3 further comprises a subbing layer 14 between the electrically-conductive substrate 13 and the photosensitive layer. The photoreceptor show in FIG. 4 comprises an electrically-conductive substrate 13 having thereon a photoconductive layer 16 and a surface protective layer 15. The photoreceptor show in FIG. 5 further comprises a subbing layer 14 between the electrically-conductive substrate 13 and the photoconductive layer 16.

The surface protective layer according to the twenty-first and twenty-second aspects of the present invention is to be prepared by reacting a charge-transporting compound which contains a hydroxyl group and is represented by formula (C), with an isocyanate compound having three or more functional groups so that the resulting cross linking-polymerized product having a urethane bonding content ratio (A=x/y) of 1.5 or more, to thereby form a film having a network structure with cross-linking bonds. In the case of urethane bonding content ratios of less than 1.5, the resulting mechanical strength may be unsatisfactory to thereby increase abrasion. The urethane bonding content ratio is preferably from 1.5 to 3.0.

The surface protective layer in embodiments (2-1) to (2-13) is formed by reacting a hydroxyl group-containing charge transporting compound represented by the above-mentioned structural formula (C) with an isocyanate compound having at least three functional groups to produce a crosslinked film in the network form. Specific examples of the above-mentioned hydroxyl group-containing charge transporting compounds are shown in Tables 2-1 and 2-2. Specific examples of the aliphatic groups represented by T in the above-mentioned structural formula (C) in Tables 2-1 and 2-2 are shown in Tables 2-3 and 2-4. In these Tables, "P(Y)" and "P(T)" represent the substituted position of Y and T, respectively.

TABLE 2-1

| | Y | P(Y) | n | T | P(T) |
|---|---|---|---|---|---|
| I-1 | H | — | 0 | — | 3 |
| I-2 | H | — | 0 | — | 4 |
| I-3 | H | — | 1 | T-1 | 3 |
| I-4 | H | — | 1 | T-1 | 4 |
| I-5 | H | — | 1 | T-2 | 3 |
| I-6 | H | — | 1 | T-2 | 4 |
| I-7 | $CH_3$ | 4 | 0 | — | 3 |
| I-8 | $CH_3$ | 4 | 0 | — | 4 |
| I-9 | Cl | 4 | 0 | — | 3 |
| I-10 | $CF_3$ | 4 | 0 | — | 3 |
| I-11 | $OCH_3$ | 4 | 0 | — | 3 |
| I-12 | 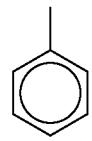 | 4 | 0 | — | 3 |

TABLE 2-1-continued
| Y | P(Y) | n | T | P(T) |
|---|---|---|---|---|
| I-13 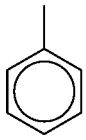 | 4 | 0 | — | 4 |
TABLE 2-2
| Y | P(Y) | n | T | P(T) |
|---|---|---|---|---|
| I-14 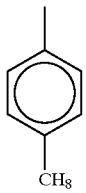 $CH_8$ | 4 | 0 | — | 3 |
| I-15 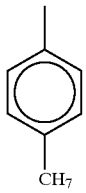 $CH_7$ | 4 | 1 | T-1 | 3 |
TABLE 2-2-continued
| Y | P(Y) | n | T | P(T) |
|---|---|---|---|---|
| I-16 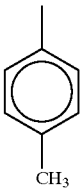 $CH_3$ | 4 | 1 | T-1 | 4 |
| I-17 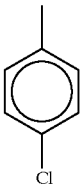 Cl | 4 | 0 | — | 3 |
| I-18 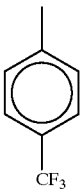 $CF_3$ | 4 | 0 | — | 4 |
| I-19 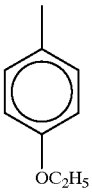 $OC_2H_5$ | 4 | 0 | — | 4 |
TABLE 2-3
| No. | | No. | | No. | | No. | |
|---|---|---|---|---|---|---|---|
| T-1 | $—CH_2—$ | T-2 | $—(CH_2)_2—$ | T-3 | 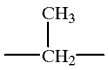 | T-4 | $—(CH_2)_3—$ |
| T-5 | 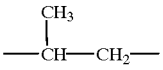 | T-6 | 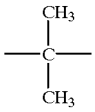 | T-7 | $—(CH_2)_4—$ | T-8 | 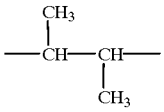 |
| T-9 | 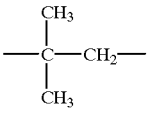 | T-10 | 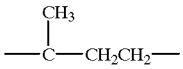 | T-11 | 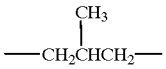 | T-12 | $—(CH_2)_5—$ |

TABLE 2-3-continued

| No. | | No. | | No. | | No. | |
|---|---|---|---|---|---|---|---|
| T-13 | $-CH(C_2H_5)-CH(CH_3)-$ | T-14 | $-CH(C_3H_7)-CH_2-$ | T-15 | $-C(CH_3)_2-CH_2CH_2-$ | T-16 | $-CH(CH_3)-CHCH_2(CH_3)-$ |
| T-17 | $-CHCH_2CH(CH_3)-$ | T-18 | $-CH_2C(CH_3)_2-CH_2-$ | T-19 | $-CH(CH_3)(CH_2)_3-$ | T-20 | $-CH_2CHCH_2-$ 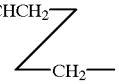 |

TABLE 2-4

| No. | | No. | | No. | |
|---|---|---|---|---|---|
| T-21 | $-CH(CH_3)(CH_2)_4-$ | T-22 | $-CH_2CH(CH_3)-(CH_2)_3-$ | T-23 | $-(CH)_2CH(CH_3)-(CH_2)_2-$ |
| T-24 | $-CH_2C(CH_3)_2-CH_2-CH_2-$ | T-25 | $-CH_2CH(CH_3)-(CH_2)_4-$ | T-26 | $-CH_2CHCH_2CHCH_2(CH_3)-$ |
| T-27 | $-CH_2CH(C_2H_5)-(CH_2)_4-$ | T-28 | $-CH_2C(CH_3)_2-(CH_2)_3-$ | T-29 | $-CH_2CH(CH_3)-(CH_2)_5-$ |
| T-30 | $-CH_2C(C_2H_5)(CH_2)-(CH_2)_4-$ | T-31 | $-CH_2C(CH_3)-(CH_2)_4-$ | T-32 | $-CH_2C(C_2H_5)(CH_3)-(CH_2)_3$ |

As a constituent of the surface protective layer used in the present invention, a compound having at least two hydroxyl group, preferably a glycol compound or a bisphenol compound, can be added as so required. This compound forms a crosslinked structure, replacing a part of the compound of the above-mentioned structural formula (C).

The hydroxyl group-containing compound can be freely selected from compounds having at least two hydroxyl groups in its molecule and polymerizable with isocyanates. Examples of such compounds include ethylene glycol, propylene glycol, butanediol and polyethylene glycol. Examples of the other hydroxyl group-containing compounds include various polymers and oligomers having reactive hydroxyl groups such as acrylic polyols and oligomers thereof, and polyester polyols and oligomers thereof.

On the other hand, specific examples of the bisphenol compounds are shown in Tables 2-5 and 2-6.

TABLE 2-5

| | |
|---|---|
| 1 | 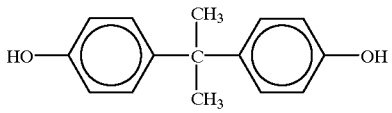 |
| 2 | 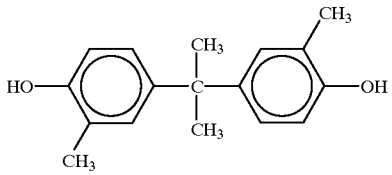 |

TABLE 2-5-continued
| | |
|---|---|
| 3 | 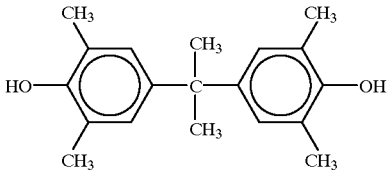 |
| 4 | 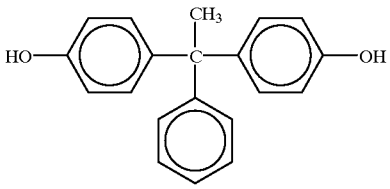 |
| 5 | 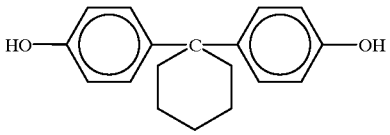 |
| 6 | 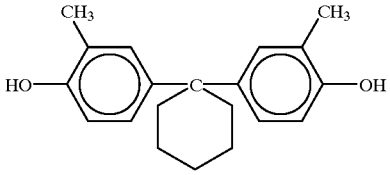 |
| 7 | 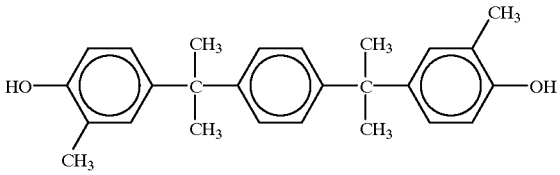 |
TABLE 2-6
| | |
|---|---|
| 8 | 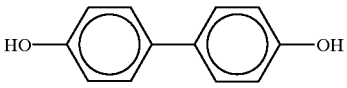 |
| 9 | 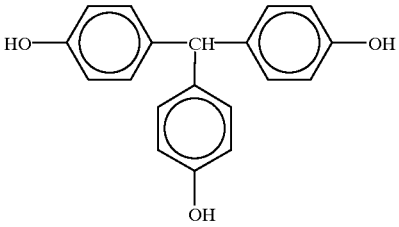 |
TABLE 2-6-continued
| | |
|---|---|
| 10 | 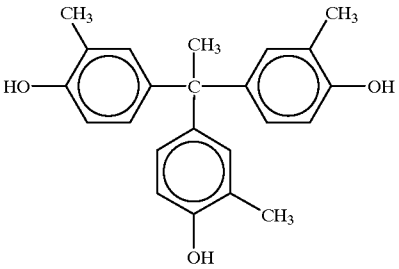 |
| 11 | 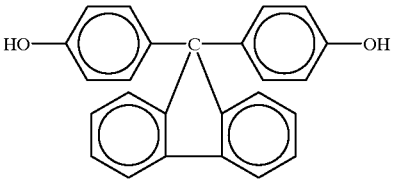 |

In order to crosslink to form a three-dimensional network structure, it is necessary to use the isocyanate compound having at least three functional groups, namely the compound having at least three reactable isocyanate groups, whereby the surface protective layer can take a high-density crosslinked structure.

Polyisocyanate modified compounds such as derivatives and prepolymers obtained from isocyanate monomers are more preferably used as the isocyanate compounds having at least three isocyanate groups. Particularly preferred examples thereof include adduct modified compounds in which isocyanates are added to polyols each having at least three functional groups, biuret modified compounds in which compounds having urea bonds are modified with isocyanate compounds, allophanate modified compounds in which isocyanates are added to urethane groups, and isocyanurate modified compounds. In addition, carbodiimide modified compounds can be used.

In particular, hexamethylene diisocyanate-modified compounds of biuret represented by the above-mentioned structural formula (2-II) or hexamethylene diisocyanate-modified compounds of isocyanurates represented by the above-mentioned structural formula (2-III) are excellent in mechanical strength and electric characteristics of the completed protective layers.

Blocked isocyanates protected with blocking agents such as oximes for temporarily masking the activity of isocyanate groups, which are included in the above-mentioned polyisocyanate modified compounds, can also be preferably used. These are preferred in that the pot life of coating solutions is prolonged.

Further, isocyanate compounds can be supplementarily used together with the above-mentioned isocyanates. Examples thereof include general isocyanate monomers such as tolylene diisocyanate, diphenylmethane diisocyanate, 1,5-naphthylene diisocyanate, tolidine diisocyanate, 1,6-hexamethylene diisocyanate, xylene diisocyanate, lysine diisocyanate, tetramethylxylene diisocyanate, 1,3,6-hexamethylene triisocyanate, lysine ester triisocyanate, 1,6,11-undecane triisocyanate, 1,8-diisocyanate-4-isocyanate methyloctane, triphenylmethane triisocyanate and tris(isocyanate phenyl) thiophosphate.

In order to form the surface protective layers for use in embodiments (2-1) to (2-13) of the present invention, the hydroxyl group-containing charge transporting compounds represented by the above-mentioned structural formula (C), the isocyanate compounds each having at least three functional groups, the other hydroxyl group-containing compounds as so required, additives and solvents are mixed to prepare coating solutions, and the coating solutions are applied onto the photosensitive layers, followed by heating to conduct crosslinking polymerization, thereby forming the surface protective layers.

Suitable crosslinking reaction temperature is from 80 to 170° C., preferably from 100 to 150° C. Cross-linking reaction temperatures lower than 80° C. cannot provide the desired urethane bonding content ratio. On the other hand, reaction temperature higher than 170° C. may damage layers lower than the surface protective layer. Suitable crosslinking reaction time depends on the materials used. However, the reaction time is generally from 1 to 5 hours. When the reaction time is shorter than 1 hour, the resulting urethane bonding content ratio may be undesired. On the other hand, when the reaction time is longer than 5 hours, although desired ratio can be obtained, the urethane bonding content ratio does not substantially improve anymore. Therefore, the upper limit of the reaction time is 5 hours in view of the manufacturing efficiency.

The above-mentioned coating solution is preferably prepared so that the ratio of the number of hydroxyl groups to be reacted to the number of isocyanate groups to be reacted ranges from 2:1 to 1:2, more preferably from 1.5:1 to 1:1.5. In particular, if the ratio exceeds this range and excess hydroxyl groups remain, the hydrophilicity of the surface protective layer increases to deteriorate the image characteristics under the circumstances of high temperature and humidity. Accordingly, care should be taken for this, including reaction conditions. Further, care should be taken, because the isocyanate compound is inactivated by the moisture in the air to decrease the number of isocyanate groups to be reacted in some cases. In that case, it is effective to prepare the coating solution so that the number of isocyanate groups becomes a little excessive.

The content of the charge transporting compound in the surface protective layer is determined depending on the molecular weight of the hydroxyl group-containing compound and that of the isocyanate compound. In order to give the mechanical strength while maintaining the electric characteristics of the photoreceptor, it is necessary to adjust the content of the charge transporting compound in the whole surface protective layer to 5% to 90% by weight, preferably 25% to 75% by weight. The surface protective layer of the present invention incorporates the charge transporting material into the network structure by binding, so that it can introduce a larger amount of the charge transporting material than the conventional charge transporting layer in which a low molecular weight charge transporting material is dispersed.

In order to improve the film forming property and the flexibility, various binder resins may be added to the surface protective layers of the present invention. As such binder resins, various polymers can be used such as polycarbonates, polyesters, acrylic polymers, polyvinyl alcohol and polyamides. In order to maintain the mechanical strength and the electrophotographic characteristics, the content of these binder resins in the surface protective layers is preferably 60% by weight or less.

For crosslinking polymerization of the surface protective layer of the present invention, the coating solution is applied onto the photosensitive layer, followed by heating. The reaction of hydroxyl groups with isocyanate groups generally requires no catalyst, but only heating, although it depends on the reactivity between the compounds used. When a solvent is used in coating, a heating treatment can be carried out simultaneously with drying, or subsequently thereto.

When the crosslinking reaction is desired to be enhanced, catalysts such as organic metal compounds such as dibutyltin dilaurate, inorganic metal compounds, monoamines, diamines, triamines, cyclic amines, alcohol amines and ether amines may be added based on the usual methods.

The conductive supports used in the photoreceptors of the present invention include metals such as aluminum, nickel, chromium and stainless steel; plastic films provided with thin films such as aluminum, titanium, nickel, chromium, stainless steel, gold, vanadium, tin oxide, indium oxide and ITO films; and paper or plastic films coated or impregnated with a conductivity imparting agent. These conductive supports are used in appropriate form such as drum-like, sheet-like or plate-like form, but are not limited thereto.

The surface of the conductive support can be further subjected to various treatments as so desired, as long as images are not affected. For example, the surface can be subjected to an oxidation treatment, a chemical agent treatment, a coloring treatment or a diffused reflection treatment such as sand dressing.

Further, an underlayer may be provided between the above-mentioned conductive support and the photosensitive layer. The underlayer prevents the charge from being injected from the conductive support into the photosensitive layer in charging the photosensitive layer of the laminated structure, serves as an adhesive layer for adhering the photosensitive layer to the conductive support as an integral body, and is effective as a layer for preventing the reflection of light of the conductive support in some cases.

Binding resins used for the underlayers include known materials such as polyethylene resins, polypropylene resins, acrylic resins, methacrylic resins, polyamide resins, vinyl chloride resins, vinyl acetate resins, phenol resins, polycarbonate resins, polyurethane resins, polyimide resins, vinylidene chloride resins, polyvinyl acetal resins, vinyl chloride-vinyl acetate copolymers, polyvinyl alcohol resins, water-soluble polyester resins, nitrocellulose, casein, gelatin, polyglutamic acid, starch, starch acetate, amino starch, polyacrylic acid, polyacrylamide, zirconium chelate compounds, titanyl chelate compounds, titanyl alkoxide compounds, organic titanyl compounds and silane coupling agents. These materials may be used alone or as a mixture of two or more kinds of them.

Further, fine particles of titanium oxide, silicon oxide, zirconium oxide, barium titanate, a silicone resin or the like can be incorporated therein. The thickness of the underlayer is suitably 0.01 $\mu$m to 10 $\mu$m, and preferably 0.05 $\mu$m to 2 $\mu$m.

Coating methods of the underlayers include usual methods such as blade coating, Mayer bar coating, spray coating, dip coating, bead coating, air knife coating and curtain coating.

The charge generating layers of the laminated photoreceptors contain charge generating materials and binder resins.

The charge generating materials used herein include inorganic photoconductive materials such as amorphous selenium, crystalline selenium-tellurium alloys, selenium-arsenic alloys, other selenium compounds and selenium alloys, zinc oxide and titanium oxide, and organic pigments and dyes such as phthalocyanine series, squarelium series, anthoanthrone series, perylene series, azo series, anthraquinone series, pyrene series, pyrylium salts and thiapyrylium salts.

Of these, phthalocyanine compounds are preferred from the viewpoint of the light sensitivity of the photoreceptors, and non-metallic phthalocyanines, titanyl phthalocyanine, chlorogallium phthalocyanine and hydroxygallium phthalocyanine are suitable.

In particular, chlorogallium phthalocyanine having a specific crystal form having high diffraction peaks at Bragg angles (2θ±0.2°) of 7.4°, 16.6°, 25.5° and 28.3° in its CuKα characteristic X-ray diffraction spectrum or hydroxygallium phthalocyanine having a specific crystal form having high diffraction peaks at Bragg angles (2θ±0.2°) of 7.5°, 9.9°, 12.5°, 16.3°, 18.6°, 25.1° and 28.3° in its CuKα characteristic X-ray diffraction spectrum or gallium phthalocyanine having high diffraction peaks at least at Bragg angles (2θ±0.2°) of 6.8°, 12.8°, 15.8° and 26° in its CuKα characteristic X-ray diffraction spectrum is particularly preferred, because it has a high charge generating efficiency to light in the region from visible light to near infrared light.

These phthalocyanine crystals having specific crystal forms are synthesized in the following manners:

SYNTHESIS EXAMPLE 2-1

Thirty parts of 1,3-diiminoisoindoline and 9.1 parts of gallium trichloride were added to 230 parts of quinoline. After the reaction at 200° C. for 3 hours, the reaction product was filtered off and washed with acetone and methanol. The resulting wet cake was dried to obtain 28 parts of chlorogallium phthalocyanine crystals. Then, 3 parts of the chlorogallium phthalocyanine crystals were dry ground in an automatic mortar (Lab Mill Type UT-21, manufactured by Yamato Kagaku Co.) for 3 hours, and 0.5 part thereof were milled together with 60 parts of glass beads (1 mm in diameter) in 20 parts of benzyl alcohol at room temperature for 24 hours. Thereafter, the glass beads were filtered off, and the filtrate was washed with 10 parts of methanol and dried, thereby obtaining chlorogallium phthalocyanine crystals having high diffraction peaks at Bragg angles (2θ±0.2°) of 7.4°, 16.6°, 25.5° and 28.3° in its CuKα characteristic X-ray diffraction spectrum.

SYNTHESIS EXAMPLE 2

Three parts of the chlorogallium phthalocyanine crystals obtained in synthesis example 1 were dissolved in 60 parts of concentrated sulfuric acid at 0° C., and the resulting solution was added dropwise to 450 parts of distilled water at 5° C. to reprecipitate the crystals. The resulting crystals were washed with distilled water and diluted aqueous ammonia, and then, dried to obtain 2.5 parts of hydroxygallium phthalocyanine crystals. The crystals were dry ground in the automatic mortar used in Synthesis Example 2-1 for 5.5 hours, and 0.5 part thereof were milled together with 15 parts of dimethylformamide and 30 parts of glass beads (1 mm in diameter) at room temperature for 24 hours. Thereafter, the glass beads were filtered off, and the filtrate was washed with 10 parts of methanol and dried, thereby obtaining hydroxygallium phthalocyanine crystals having high diffraction peaks at Bragg angles (2θ±0.20°) of 7.5°, 9.9°, 12.5°, 16.3°, 18.6°, 25.1° and 28.3° in its CuKα characteristic X-ray diffraction spectrum.

Binding resins used in the charge generating layers include but are not limited to polyvinyl butyral resins, polyvinyl formal resins, partially modified polyvinyl acetal resins, polycarbonate resins, polyester resins, acrylic resins, polyvinyl chloride resins, polystyrene resins, polyvinyl acetate resins, vinyl chloride-vinyl acetate copolymers, silicone resins, phenol resins and poly-N-vinylcarbazole resins. These binding resins can be used alone or as a mixture of two or more kinds of them.

The compounding ratio of the charge generating material to the binding resin in the charge generating layer is preferably within the range of 10:1 to 1:10 by weight ratio. Further, the thickness of the charge generating layer used in the present invention is generally 0.1 $\mu$m to 5 $\mu$m, and preferably 0.2 $\mu$m to 2.0 $\mu$m.

Coating methods of the charge generating layers include usual methods such as blade coating, Mayer bar coating, spray coating, dip coating, bead coating, air knife coating and curtain coating.

Solvents used in forming the charge generating layers include usual organic solvents such as methanol, ethanol, n-propanol, n-butanol, benzyl alcohol, methyl cellosolve, ethyl cellosolve, acetone, methyl ethyl ketone, cyclohexanone, methyl acetate, n-butyl acetate, dioxane, tetrahydrofuran, methylene chloride and chloroform. These solvents can be used alone or as a mixture of two or more kinds of them.

The charge transporting layers of the laminated photoreceptors comprise charge transporting materials and binder resins.

The charge transporting materials include quinone compounds such as p-benzoquinone, chloranil, bromanil and anthraquinone, tetracyanoquinodimethane compounds, fluorenone compounds such as 2,4,7-trinitrofluorenone, xanthone compounds, benzophenone compounds, cyanovinyl compounds, electron attractive compounds such as ethylene compounds, triarylamine compounds, benzine compounds, arylalkane compounds, aryl-substituted ethylene compounds, stilbene compound, anthracene compounds and hydrazone compounds. These charge transporting materials can be used alone or as a mixture of two or more kinds of them.

In particular, the benzidine compounds represented by the above-mentioned structural formula (2-IV) and the triphenylamine compounds represented by the above-mentioned structural formula (2-V) can be preferably used because they have high charge (hole) transporting ability and excellent stability. Specific examples of the above-mentioned benzine compounds are shown in Table 2-7, and specific examples of the above-mentioned triphenylamine compounds are shown in Tables 2-8 to 2-10.

TABLE 2-7

| No. | $R_1$<br>$R_1'$ | $(R_2)p$<br>$(R_2')p$ | $(R_3)q$<br>$(R_3')q$ | No. | $R_1$<br>$R_1'$ | $(R_2)p$<br>$(R_2')p$ | $(R_3)q$<br>$(R_3')q$ |
|---|---|---|---|---|---|---|---|
| IV-1 | $CH_3$ | H | H | IV-28 | Cl | H | H |
| IV-2 | $CH_3$ | 2-$CH_3$ | H | IV-29 | Cl | 2-$CH_3$ | H |
| IV-3 | $CH_3$ | 3-$CH_3$ | H | IV-30 | Cl | 3-$CH_3$ | H |
| IV-4 | $CH_3$ | 4-$CH_3$ | H | IV-31 | Cl | 4-$CH_3$ | H |
| IV-5 | $CH_3$ | 4-$CH_3$ | 2-$CH_3$ | IV-32 | Cl | 4-$CH_3$ | 2-$CH_3$ |
| IV-6 | $CH_3$ | 4-$CH_3$ | 3-$CH_3$ | IV-33 | Cl | 4-$CH_3$ | 3-$CH_3$ |
| IV-7 | $CH_3$ | 4-$CH_3$ | 4-$CH_3$ | IV-34 | Cl | 4-$CH_3$ | 4-$CH_3$ |

TABLE 2-7-continued

| No. | $R_1$<br>$R_1'$ | $(R_2)p$<br>$(R_2')p$ | $(R_3)q$<br>$(R_3')q$ | No. | $R_1$<br>$R_1'$ | $(R_2)p$<br>$(R_2')p$ | $(R_3)q$<br>$(R_3')q$ |
|---|---|---|---|---|---|---|---|
| IV-8 | $CH_3$ | 3,4-$CH_3$ | H | IV-35 | $C_2H_5$ | H | H |
| IV-9 | $CH_3$ | 3,4-$CH_3$ | 3,4-$CH_3$ | IV-36 | $C_2H_5$ | 2-$CH_3$ | H |
| IV-10 | $CH_3$ | 4-$C_2H_5$ | H | IV-37 | $C_2H_5$ | 3-$CH_3$ | H |
| IV-11 | $CH_3$ | 4-$C_3H_7$ | H | IV-38 | $C_2H_5$ | 4-$CH_3$ | H |
| IV-12 | $CH_3$ | 4-$C_4H_9$ | H | IV-39 | $C_2H_5$ | 4-$CH_3$ | 4-$CH_3$ |
| IV-13 | $CH_3$ | 4-$C_2H_5$ | 2-$CH_3$ | IV-40 | $C_2H_5$ | 4-$C_2H_5$ | 4-$CH_3$ |
| IV-14 | $CH_3$ | 4-$C_2H_6$ | 3-$CH_3$ | IV-41 | $C_2H_5$ | 4-$C_3H_7$ | 4-$CH_3$ |
| IV-15 | $CH_3$ | 4-$C_2H_6$ | 4-$CH_3$ | IV-42 | $C_2H_5$ | 4-$C_4H_9$ | 4-$CH_3$ |
| IV-16 | $CH_3$ | 4-$C_2H_5$ | 3,4-$CH_3$ | IV-43 | $OCH_3$ | H | H |
| IV-17 | $CH_3$ | 4-$C_3H_7$ | 3-$CH_3$ | IV-44 | $OCH_3$ | 2-$CH_3$ | H |
| IV-18 | $CH_3$ | 4-$C_3H_7$ | 4-$CH_3$ | IV-45 | $OCH_3$ | 3-$CH_3$ | H |
| IV-19 | $CH_3$ | 4-$C_4H_9$ | 3-$CH_3$ | IV-46 | $OCH_3$ | 4-$CH_3$ | H |
| IV-20 | $CH_3$ | 4-$C_4H_9$ | 4-$CH_3$ | IV-47 | $OCH_3$ | 4-$CH_3$ | 4-$CH_3$ |
| IV-21 | $CH_3$ | 4-$C_2H_5$ | 4-$C_2H_5$ | IV-48 | $OCH_3$ | 4-$C_2H_5$ | 4-$CH_3$ |
| IV-22 | $CH_3$ | 4-$C_2H_6$ | 4-$OCH_3$ | IV-49 | $OCH_3$ | 4-$C_3H_7$ | 4-$CH_3$ |
| IV-23 | $CH_3$ | 4-$C_3H_7$ | 4-$C_3H_7$ | IV-50 | $OCH_3$ | 4-$C_4H_9$ | 4-$CH_3$ |
| IV-24 | $CH_3$ | 4-$C_3H_7$ | 4-$OCH_3$ | IV-51 | $CH_3$ | 2-$N(CH_3)_2$ | H |
| IV-25 | $CH_3$ | 4-$C_4H_9$ | 4-$C_4H_9$ | IV-52 | $CH_3$ | 3-$N(CH_3)_2$ | H |
| IV-26 | $CH_3$ | 4-$C_4H_9$ | 4-$OCH_3$ | IV-53 | $CH_3$ | 4-$N(CH_3)_2$ | H |
| IV-27 | H | 3-$CH_3$ | H | IV-54 | $CH_3$ | 4-Cl | H |

TABLE 2-8

| No. | $(R_4)r$ | $Ar_1$ | $Ar_2$ |
|---|---|---|---|
| V-1<br>V-2 | 4-$CH_3$<br>3,4-$CH_3$ | 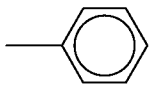 | 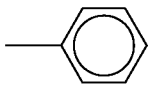 |
| V-3<br>V-4 | 4-$CH_3$<br>3,4-$CH_3$ | 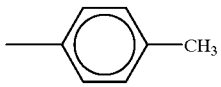 | 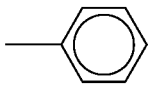 |
| V-5<br>V-6 | 4-$CH_3$<br>3,4-$CH_3$ | 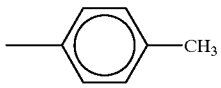 | 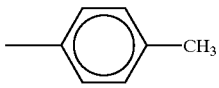 |
| V-7<br>V-8 | 4-$CH_3$<br>3,4-$CH_3$ | 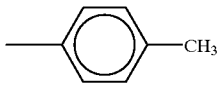 | 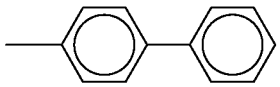 |
| V-9<br>V-10 | 4-$CH_3$<br>3,4-$CH_3$ | 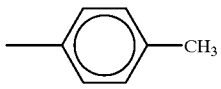 | 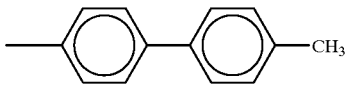 |

TABLE 2-8-continued
| No. | $(R_4)r$ | $Ar_1$ | $Ar_2$ |
|---|---|---|---|
| Y-11<br>V-12 | 4-$CH_3$<br>3,4-$CH_3$ | 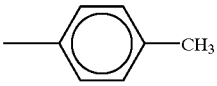 | 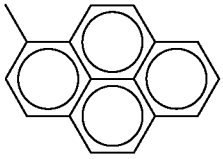 |
| V-13<br>V-14 | 4-$CH_3$<br>3,4-$CH_3$ | 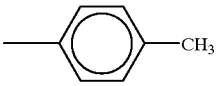 | 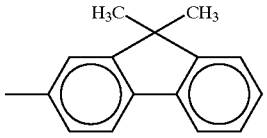 |
| V-15<br>V-16 | 4-$CH_3$<br>3,4-$CH_3$ | 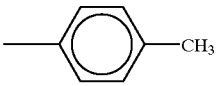 | 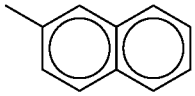 |
| V-17<br>V-18 | 4-$CH_3$<br>3,4-$CH_3$ | 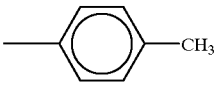 | 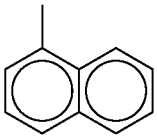 |
| V-19<br>V-20 | 4-$CH_3$<br>3,4-$CH_3$ | 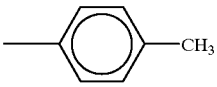 | 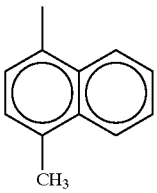 |
| V-21<br>V-22 | 4-$CH_3$<br>3,4-$CH_3$ | 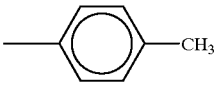 | 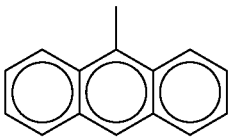 |
TABLE 2-9
| No. | $(R_4)r$ | $Ar_1$ | $Ar_2$ |
|---|---|---|---|
| V-23<br>V-24 | 4-$CH_3$<br>3,4-$CH_3$ | 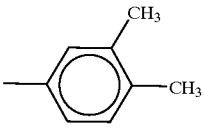 | 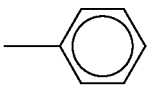 |

TABLE 2-9-continued
| No. | $(R_4)r$ | $Ar_1$ | $Ar_2$ |
|---|---|---|---|
| V-25 | 4-$CH_3$ | 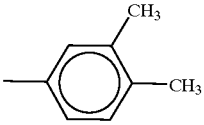 | 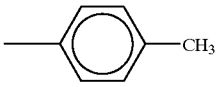 |
| V-26 | 3,4-$CH_3$ | | |
| V-27 | 4-$CH_3$ | 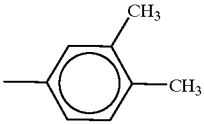 | 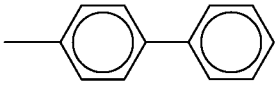 |
| V-28 | 3,4-$CH_3$ | | |
| V-29 | 4-$CH_3$ | 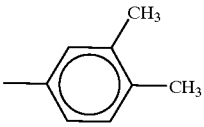 | 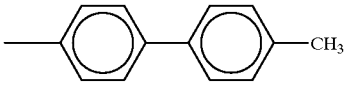 |
| V-30 | 3,4-$CH_3$ | | |
| V-31 | 4-$CH_3$ | 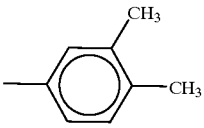 | 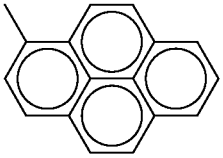 |
| V-32 | 3,4-$CH_3$ | | |
| V-33 | 4-$CH_3$ | 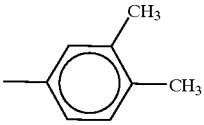 | 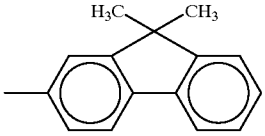 |
| V-34 | 3,4-$CH_3$ | | |
| V-35 | 4-$CH_3$ | 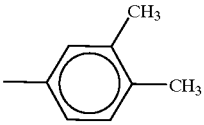 | 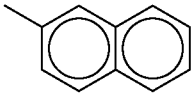 |
| V-36 | 3,4-$CH_3$ | | |
| V-37 | 4-$CH_3$ | 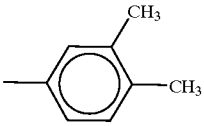 | 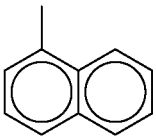 |
| V-38 | 3,4-$CH_3$ | | |
| V-39 | 4-$CH_3$ | 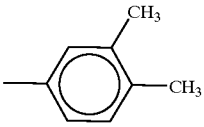 | 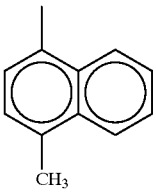 |
| V-40 | 3,4-$CH_3$ | | |

TABLE 2-9-continued
| No. | $(R_4)r$ | $Ar_1$ | $Ar_2$ |
|---|---|---|---|
| V-41<br>V-42 | 4-$CH_3$<br>3,4-$CH_3$ | 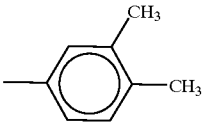 | 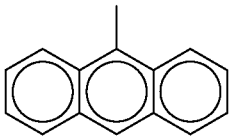 |
TABLE 2-10
| No. | $(R_4)r$ | $Ar_1$ | $Ar_3$ |
|---|---|---|---|
| V-43<br>V-44 | 4-$CH_3$<br>3,4-$CH_3$ | 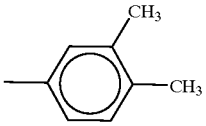 | 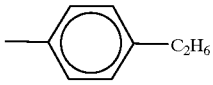 |
| V-45<br>V-46 | 4-$CH_3$<br>3,4-$CH_3$ | 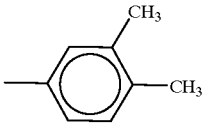 | 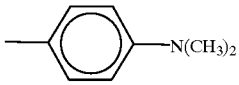 |
| V-47<br>V-48 | 4-$CH_3$<br>3,4-$CH_3$ | 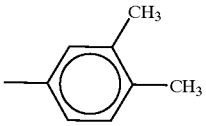 | 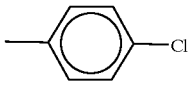 |
| V-49<br>V-50 | 4-$CH_3$<br>3,4-$CH_3$ | 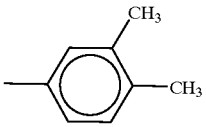 | 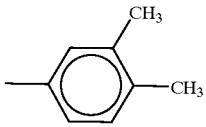 |
| V-51<br>V-52 | 4-$CH_3$<br>3,4-$CH_3$ | 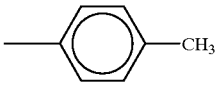 | 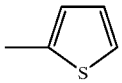 |
| V-53<br>V-54 | 4-$CH_3$<br>3,4-$CH_3$ | 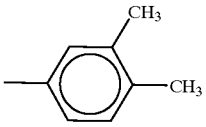 | 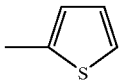 |
| V-55<br>V-56 | 4-$CH_3$<br>3,4-$CH_3$ | 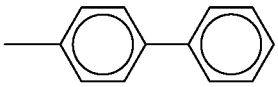 | 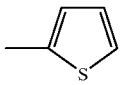 |

TABLE 2-10-continued

| No. | $(R_4)r$ | $Ar_1$ | $Ar_3$ |
|---|---|---|---|
| V-57 | 4-$CH_3$ | | |
| V-58 | 3,4-$CH_3$ | | |
| V-59 | 4-$CH_3$ | | |
| V-60 | 3,4-$CH_3$ | | |
| V-61 | 4-$CH_3$ | | |
| V-62 | 3,4-$CH_3$ | | |

The binder resins which can be used in the charge transporting layers include known resins such as polycarbonate resins, polyester resins, methacrylic resins, acrylic resins, polyvinyl chloride resins, polyvinylidene chloride resins, polystyrene resins, polyvinyl acetate resins, styrene-butadiene copolymers, vinylidene chloride-acrylonitrile copolymers, vinyl chloride-vinyl acetate copolymers, vinyl chloride-vinyl acetate-maleic anhydride copolymers, silicone resins, silicone-alkyd resins, phenol-formaldehyde resins, styrene-acrylic resins, styrene-alkyd resins, poly-N-vinylcarbazole and polysilane.

In order to prevent deterioration of the charge transporting layers caused by oxidizing gases such as ozone generated from corona charging units, antioxidants may be added to the charge transporting layers. The charge transporting layers are not uppermost layers, so that they do not come into direct contact with the oxidizing gases. However, these oxidizing gases pass through the surface protective layers to the charge transporting layers. The antioxidants are added to prevent oxidation deterioration caused thereby. As the oxidants, hindered phenol or hindered amine antioxidants are preferably used. Known antioxidants such as organic sulfur antioxidants, phosphite antioxidants, dithiocarbamate antioxidants, thiourea antioxidants and benzimidazole antioxidants may be used.

The amount of the antioxidant added to the charge transporting layer is preferably 15% by weight or less, and more preferably 10% by weight or less, based on the charge transporting layer.

Solvents used in forming the charge transporting layers include usual organic solvents such as aromatic hydrocarbons such as benzene, toluene, xylene and chlorobenzene, ketones such as acetone and 2-butanone, aliphatic hydrocarbon halides such as methylene chloride, chloroform, ethylene chloride, and cyclic or straight chain ethers such as tetrahydrofuran, ethyl ether and dioxane. These solvents can be used alone or as a mixture of two or more kinds of them.

As coating methods of the charge transporting layers, the same methods as with the charge generating methods can be used. The thickness of the charge transporting layer is 5 $\mu$m to 50 $\mu$m, and preferably 10 $\mu$m to 40 $\mu$m.

When the monolayer type photosensitive layers are formed, they comprise the above-mentioned charge generating materials and binder resins. As the binder resins, binder resins similar to those used in the above-mentioned charge generating layers and charge transporting layers can be used.

The content of the charge generating material in the monolayer type photosensitive layer is preferably about 10% to 85% by weight, and more preferably 20% to 50% by weight.

Charge transporting materials may be added to the monolayer type photosensitive layers as so required. They are preferably added in an amount of 5% to 50% by weight.

Further, antioxidants may be added to the monolayer type photosensitive layers for the same reason as with the case of the charge transporting layers as so desired. The amount of the antioxidant added is preferably 15% by weight or less, and more preferably 10% by weight or less.

The electrophotographic photoreceptors of the present invention can also be used in image forming apparatuses using noncontact charging systems such as scorotron charging, and have excellent electrophotographic characteristics and durability, particularly resistance to ozone. When they are applied to image formating apparatuses using contact charging systems such as charging rolls as charging means, they exhibit very excellent durability to the wear of photoreceptors which remarkably appears in contact charging.

Although the form of a conductive member for conducting contact charging may be any of brush-like, blade-like, pin electrode-like and roller-like forms, the roller-like conductive member is particularly preferred. Usually, the roller-like member is constituted by a resistance layer, an elastic layer for supporting it, and a core member from the outside. A protective layer can be further formed on the outside of the resistance layer if necessary.

As a material for the core member of the conductive member, iron, copper, brass, stainless steel, aluminum or nickel which has conductivity is used. In addition, a resin shaped article can also be used in which conductive particles are dispersed.

As a material for the elastic layer of the conductive member, a conductive or semiconductive material is used. In general, a rubber member can be used in which conductive or semiconductive particles are dispersed.

The rubber members used herein include EPDM, polybutadiene, natural rubber, polyisobutylene, SBR, CR, NBR, silicone rubber, urethane rubber, epichlorohydrin rubber, SBS, thermoplastic elastomers, norbornene rubber, fluorosilicone rubber and ethylene oxide rubber. The conductive or semiconductive particles include carbon black, metals such as zinc, aluminum, copper, iron, nickel, chromium and titanium, and metal oxides such as ZnO—$Al_2O_3$, $SnO_2$—$Sb_2O_3$, $In_2O_3$—$SnO_2$, ZnO—$TiO_2$, MgO—$Al_2O_3$, FeO—$TiO_2$, $TiO_2$, $SnO_2$, $Sb_2O_3$, $In_2O_3$, ZnO and MgO. These materials may be used alone or as a mixture of two or more kinds of them.

The resistance layer and the protective layer of the conductive member are layers in which conductive or semiconductive particles are dispersed in binding resins to regulate their resistance. The resistivity is $10^3$ 106 ·cm to $10^{14}$ Ω·cm, preferably $10^5$ Ω·cm to $10^{12}$ Ω·cm, and more preferably $10^7$ Ω·cm to $10^{12}$ Ω·cm.

Further, the thicknesses of the resistance layer and the protective layer of the conductive member are within the range of 0.01 μm to 1,000 μm, preferably 0.1 μm to 500 μm, and more preferably 0.5 μm to 100 μm.

The binding resins used in the resistance layers and the protective layers of the conductive members include acrylic resins, cellulose resins, polyamide resins, methoxymethylated nylon, ethoxymethylated nylon, polyurethane resins, polycarbonate resins, polyester resins, polyethylene resins, polyvinyl resins, polyarylate resins, polythiophene resins, polyolefin resins such as PFA, FEP and PET, and styrene-butadiene resins. As the conductive or semiconductive particles, carbon black, the metals and the metal oxides used in the elastic layers are used.

Further, antioxidants such as hindered phenols and hindered amines, fillers such as clay and kaolin and lubricants such as silicone oil can be added as so desired.

Means for forming these layers include blade coating, Mayer bar coating, spray coating, dip coating, bead coating, air knife coating and curtain coating.

When the photoreceptors are charged by the use of these conductive members, the voltage is applied to the conductive members. In this case, the voltage in which the alternating current voltage is superimposed on the direct current voltage is preferably applied. It is difficult to obtain uniform charge by the use of the direct current voltage alone.

As to the range of the voltage, the direct current voltage is preferably 50 V to 2,000 V in positive or negative, and more preferably 100 V to 1,500 V, depending on the desired charge voltage of the photoreceptors. With respect to the alternating current voltage to be superimposed, the voltage between peaks is suitably 400 V to 1,800 V, preferably 800 V to 1,600 V, and more preferably 1,200 V to 1,600 V. The frequency of the alternating current voltage is 50 Hz to 20,000 Hz, and preferably 100 Hz to 2,000 Hz.

The following description maily relates to the above described embodiments (3-1) to (3-13).

The photosensitive layer for use in embodiments (3-1) to (3-13) of the present invention may be either a so-called monolayer type photoreceptor or a laminated photoreceptor comprising a charge generating layer and a charge transporting layer. The order of lamination of the charge generating layer and the charge transporting layer may be any. However, the surface protective layer used in the present invention has hole transporting properties, so that it exhibits the most excellent characteristics in the case of a negative charge type laminated photoreceptor in which the charge generating layer, the charge transporting layer and the surface protective layer are laminated in this order.

The surface protective layer of embodiments (3-1) to (3-13) of the present invention is composed of a three-dimensional network film formed by the crosslinking polymerization of at least two kinds of compounds, a hydroxyl group-containing charge transporting compound represented by the above-mentioned structural formula (D) and an isocyanate compound having at least three functional groups.

Specific examples of the groups represented by $Ar_1$ in the above-mentioned structural formula (D) are shown in Table 3-1, and specific examples of the groups represented by $Ar_2$ and $Ar_3$ are shown in Table 3-2. Specific examples of the divalent binding moieties represented by T are shown in Tables 3-3 and 3-4. Specific examples represented by structural formula (D) are shown in Tables 3-5 and 3-6.

In Table 3-1, either bonds may be connected to the aliphatic group (T) or the nitrogen atom.

In Table 3-2, $Ar_x$ generically represents $Ar_2$ and $Ar_3$

TABLE 3-1

| No. | No. | No. |
|---|---|---|
| $Ar_1$-1 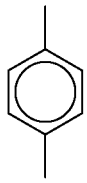 | $Ar_1$-2 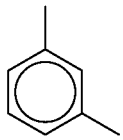 | $Ar_1$-3 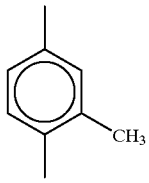  |

TABLE 3-1-continued
| No. | No. | No. |
|---|---|---|
| $Ar_1$-4 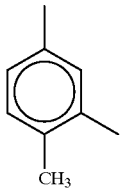 | $Ar_1$-5 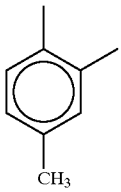 | $Ar_1$-6 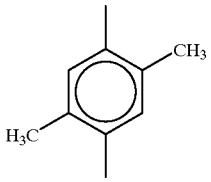 |
| $Ar_1$-7 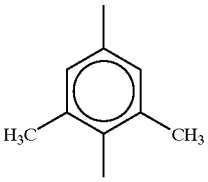 | $Ar_1$-8 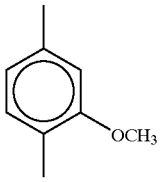 | $Ar_1$-9 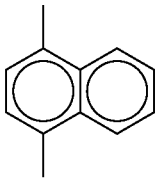 |
| $Ar_1$-10 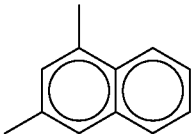 | $Ar_1$-11 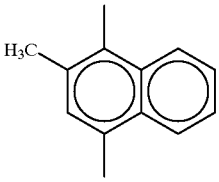 | $Ar_1$-12 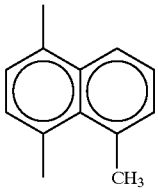 |
| $Ar_1$-13 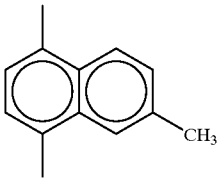 | $Ar_1$-14 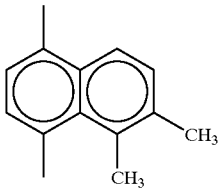 | $Ar_1$-15 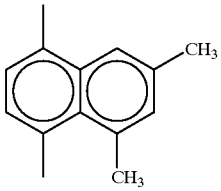 |
| $Ar_1$-16 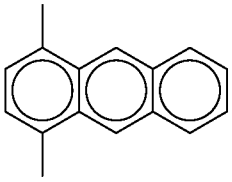 | $Ar_1$-17 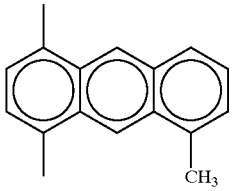 | $Ar_1$-18 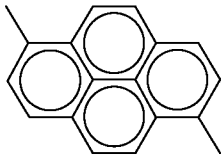 |
TABLE 3-2
| No. | No. | No. |
|---|---|---|
| $Ar_x$-1 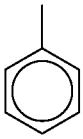 | $Ar_x$-2 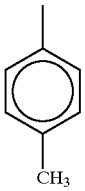 | $Ar_x$-3 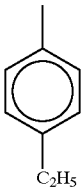 |

TABLE 3-2-continued
| No. | No. | No. |
|---|---|---|
| $Ar_x$-4 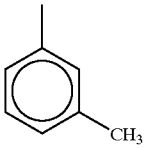 | $Ar_x$-5 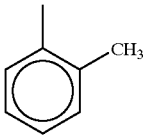 | $Ar_x$-6 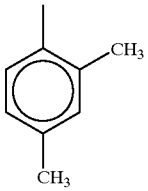 |
| $Ar_x$-7 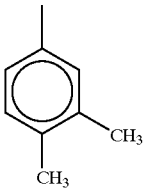 | $Ar_x$-8 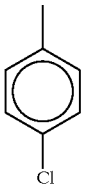 | $Ar_x$-9 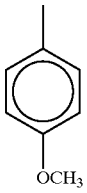 |
| $Ar_x$-10 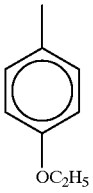 | $Ar_x$-11 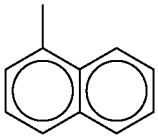 | $Ar_x$-12 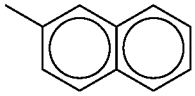 |
| $Ar_x$-13 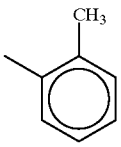 | $Ar_x$-14 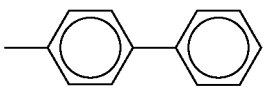 | $Ar_x$-15 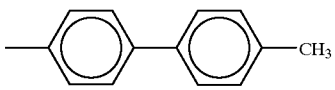 |
| $Ar_x$-16 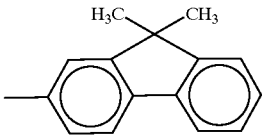 | $Ar_x$-17 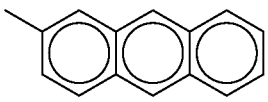 | $Ar_x$-18 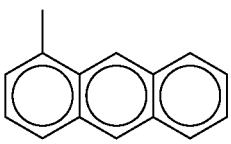 |
| $Ar_x$-19 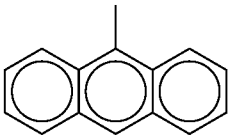 | $Ar_x$-20 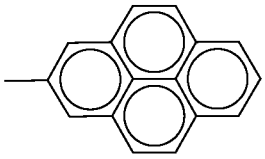 | $Ar_x$-21 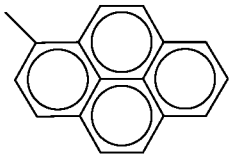 |
TABLE 3-3
| No. | No. | No. | No. |
|---|---|---|---|
| T-1 $—CH_2—$ | T-2 $—(CH_2)_2—$ | T-3 $—CH(CH_3)—CH_2—$ | T-4 $—(CH_2)_3—$ |

TABLE 3-3-continued

| No. | | No. | | No. | | No. | |
|---|---|---|---|---|---|---|---|
| T-5 | $-CH(CH_3)-CH_2-$ | T-6 | $-C(CH_3)_2-$ | T-7 | $-(CH_2)_4-$ | T-8 | $-CH(CH_3)-CH(CH_3)-$ |
| T-9 | $-C(CH_3)_2-CH_2-$ | T-10 | $-C(CH_3)-CH_2CH_2-$ | T-11 | $-CH_2CH(CH_3)CH_2-$ | T-12 | $-(CH_2)_5-$ |
| T-13 | $-CH(C_2H_5)-CH(CH_3)-$ | T-14 | $-CH(C_3H_7)-CH_2-$ | T-15 | $-C(CH_3)_2-CH_2CH_2-$ | T-16 | $-CH(CH_3)-CH(CH_3)CH_2-$ |
| T-17 | $-CH(CH_3)CH_2CH(CH_3)-$ | T-18 | $-CH_2C(CH_3)_2-CH_2-$ | T-19 | $-CH(CH_3)(CH_2)_3-$ | T-20 | $-CH_2CH(CH_3)CH_2-$ 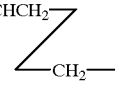 |

TABLE 3-4

| No. | | No. | | No. | |
|---|---|---|---|---|---|
| T-21 | $-CH(CH_3)(CH_2)_4-$ | T-22 | $-CH_2CH(CH_3)-(CH_2)_3-$ | T-23 | $-(CH)_2CH(CH_2)-(CH_2)_2-$ |
| T-24 | $-CH_2C(CH_3)_2-CH_2-CH_2-$ | T-25 | $-CH_2CH(CH_3)-(CH_2)_4-$ | T-26 | $-CH_2CH(CH_3)CH_2CH(CH_3)CH_2-$ |
| T-27 | $-CH_2CH(C_2H_5)-(CH_2)_4$ | T-28 | $-CH_2C(CH_3)_2-(CH_2)_3-$ | T-29 | $-CH_2CH(CH_3)-(CH_2)_5-$ |
| T-30 | $-CH_2C(C_2H_5)(CH_3)-(CH_2)_4-$ | T-31 | $-CH_2C(CH_3)-CH_2)_5-$ | T-32 | $-CH_2C(C_2H_6)(CH_3)-(CH_2)_5-$ |

TABLE 3-5

| No. | R | R | X | T | n | $Ar_1$ | $Ar_2$ | $Ar_3$ |
|---|---|---|---|---|---|---|---|---|
| I'-1 | H | H | $CH_3$ | — | 0 | $Ar_1$-1 | $Ar_x$-1 | $Ar_x$-1 |
| I'-2 | H | H | $CH_3$ | T-1 | 1 | $Ar_1$-1 | $Ar_x$-1 | $Ar_x$-1 |
| I'-3 | H | H | $CH_3$ | T-2 | 1 | $Ar_1$-1 | $Ar_x$-1 | $Ar_x$-1 |
| I'-4 | H | H | $CH_3$ | — | 0 | $Ar_1$-1 | $Ar_x$-1 | $Ar_x$-3 |
| I'-5 | H | H | $CH_3$ | T-2 | 1 | $Ar_1$-1 | $Ar_x$-1 | $Ar_x$-3 |
| I'-6 | H | H | $CH_3$ | — | 0 | $Ar_1$-1 | $Ar_x$-1 | $Ar_x$-7 |
| I'-7 | H | H | $CH_3$ | T-2 | 1 | $Ar_1$-1 | $Ar_x$-1 | $Ar_x$-7 |
| I'-8 | H | H | $CH_3$ | — | 0 | $Ar_1$-1 | $Ar_x$-1 | $Ar_x$-12 |

TABLE 3-5-continued

| No. | R | R | X | T | n | $Ar_1$ | $Ar_2$ | $Ar_3$ |
|---|---|---|---|---|---|---|---|---|
| I'-9 | H | H | $CH_3$ | | 0 | $Ar_1$-1 | $Ar_x$-7 | $Ar_x$-14 |
| I'-10 | H | H | $CH_3$ | T-2 | 1 | $Ar_1$-1 | $Ar_x$-7 | $Ar_x$-14 |
| I'-11 | H | H | $CH_3$ | — | 0 | $Ar_1$-1 | $Ar_x$-9 | $Ar_x$-9 |
| I'-12 | H | H | $CH_3$ | T-2 | 1 | $Ar_1$-1 | $Ar_x$-9 | $Ar_x$-9 |
| I'-13 | H | H | $CH_3$ | — | 0 | $Ar_1$-1 | $Ar_x$-7 | $Ar_x$-14 |
| I'-14 | H | H | $CH_3$ | — | 0 | $Ar_1$-1 | $Ar_x$-1 | $Ar_x$-21 |

TABLE 3-6

| No. | R | R | X | T | n | $Ar_1$ | $Ar_2$ | $Ar_3$ |
|---|---|---|---|---|---|---|---|---|
| I'-15 | 3-$CH_3$ | 3-$CH_3$ | $CH_3$ | T-2 | 1 | $Ar_1$-1 | $Ar_x$-1 | $Ar_x$-7 |
| I'-16 | 3-$CH_3$ | 3-$CH_3$ | $CH_3$ | — | 0 | $Ar_1$-1 | $Ar_x$-7 | $Ar_x$-14 |
| I'-17 | 3-$CH_3$ | 3-$CH_3$ | $CH_3$ | T-2 | 1 | $Ar_1$-1 | $Ar_x$-7 | $Ar_x$-14 |
| I'-18 | H | H | $CH_3$ | T-2 | 1 | $Ar_1$-10 | $Ar_x$-1 | $Ar_x$-1 |
| I'-19 | H | H | $CH_3$ | T-2 | 1 | $Ar_1$-10 | $Ar_x$-1 | $Ar_x$-7 |
| I'-20 | H | H | 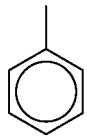 | T-2 | 1 | $Ar_1$-1 | $Ar_x$-1 | $Ar_x$-1 |
| I'-21 | H | H | 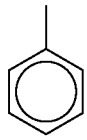 | T-2 | 1 | $Ar_1$-1 | $Ar_x$-1 | $Ar_x$-12 |
| I'-22 | H | H | 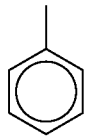 | T-2 | 1 | $Ar_1$-1 | $Ar_x$-1 | $Ar_x$-14 |
| I'-23 | H | H | 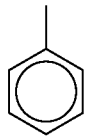 | T-2 | 1 | $Ar_1$-1 | $Ar_x$-7 | $Ar_x$-14 |

As a constituent of the surface protective layer used in the present invention, a compound having at least two hydroxyl group, for example, a glycol compound or a bisphenol compound, can be further added as so required. This compound forms a crosslinked structure, replacing a part of the compound of structural formula (D).

The hydroxyl group-containing compound can be freely selected from compounds having at least two hydroxyl groups in its molecule and polymerizable with isocyanates. Examples of such compounds include glycol compounds such as ethylene glycol, propylene glycol, butanediol and polyethylene glycol.

Specific examples of the bisphenol compounds are shown in Table 3-7.

TABLE 3-7

| No. | | No. | |
|---|---|---|---|
| (III-1) | 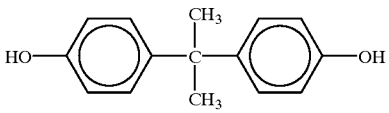 | (III-2) | 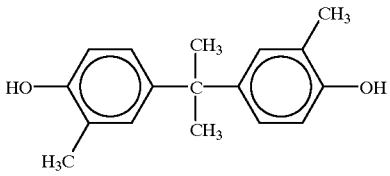 |

TABLE 3-7-continued

| No. | | No. | |
|---|---|---|---|
| (III-3) | 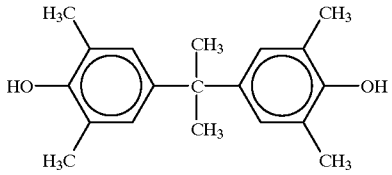 | (III-4) | 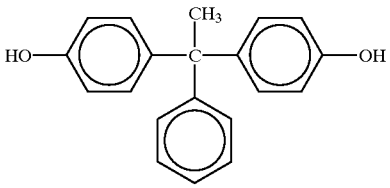 |
| (III-5) | 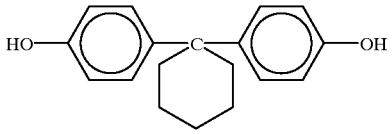 | (III-6) | 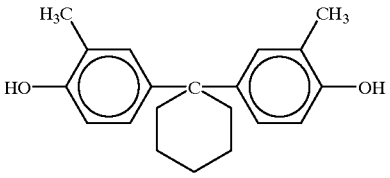 |
| (III-7) | 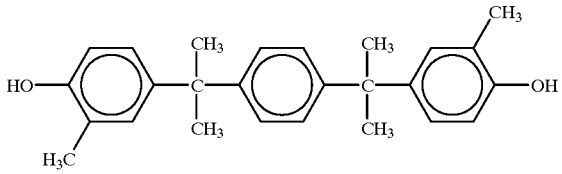 | (III-8) | 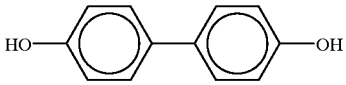 |
| (III-9) | 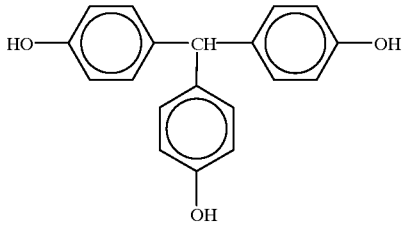 | (III-10) | 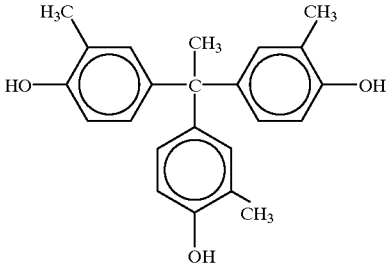 |
| (III-11) | 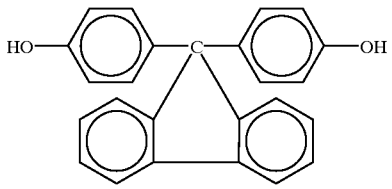 | | |

Further, additional examples of the hydroxyl group-containing compounds include various polymers and oligomers having reactive hydroxyl groups such as acrylic polyols and oligomers thereof, and polyester polyols and oligomers thereof.

In order to crosslink with the compound of structural formula (D) to form a three-dimensional network structure, it is necessary to use the isocyanate compound having at least three functional groups, namely tri- or more valent compound. The surface protective layer can take a high-density crosslinked structure by the use of this isocyanate compound.

Polyisocyanurate modified compounds such as derivatives and prepolymers obtained from isocyanate monomers are more preferably used as the isocyanate compounds having at least three isocyanate groups used in the present invention. Particularly preferred examples thereof include adduct modified compounds in which isocyanates are added to polyols each having at least three functional groups, biuret modified compounds in which compounds having urea bonds are modified with isocyanate compounds, allophanate modified compounds in which isocyanates are added to urethane groups, and isocyanurate modified compounds. In addition, carbodiimide modified compounds can be used.

Of the isocyanate compounds described above, hexamethylene diisocyanate-modified compounds of biuret represented by the above-mentioned structural formula (3-II) or hexamethylene diisocyanate-modified compounds of isocyanurates represented by the above-mentioned structural formula (3-III) are particularly excellent in mechanical strength and electric characteristics of the surface protective layers.

In the present invention, general isocyanate compounds can be supplementarily used together with the above-mentioned isocyanates. Examples of these general isocyanate compounds include general isocyanate monomers such as tolylene diisocyanate, diphenylmethane diisocyanate, 1,5-naphthylene diisocyanate, tolidine diisocyanate, 1,6-hexamethylene diisocyanate, xylene diisocyanate, lysine diisocyanate, tetramethylxylene diisocyanate, 1,3,6-hexamethylene triisocyanate, lysine ester triisocyanate, 1,6,11-undecane triisocyanate, 1,8-diisocyanate-4-isocyanate methyloctane, triphenylmethane triisocyanate and tris (isocyanate phenyl) thiophosphate.

Blocked isocyanates reacted with blocking agents for temporarily masking the activity of isocyanate groups, which are included in the above-mentioned polyisocyanurate modified compounds, can also be preferably used. These are preferred in that the pot life of coating solutions is prolonged.

The surface protective layers are formed by mixing the hydroxyl group-containing charge transporting materials represented by structural formula (D), the isocyanate compounds each having at least three functional groups, the other hydroxyl group-containing compounds as so required, additives and solvents to prepare coating solutions, and applying the coating solutions onto the photosensitive layers, followed by heating to conduct three-dimensional crosslinking polymerization, thereby forming films.

The above-mentioned coating solution is preferably prepared so that the ratio of the number of hydroxyl groups to be reacted to the number of isocyanate groups to be reacted ranges from 2:1 to 1:2, more preferably from 1.5:1 to 1:1.5. In particular, if the ratio exceeds this range, excess hydroxyl groups remain, resulting in increased hydrophilicity of the surface protective layer. As a result, the problem is encountered that the image characteristics under the circumstances of high temperature and humidity are deteriorate. Accordingly, care should be taken for this, including reaction conditions. Further, care should be taken, because the isocyanate compound might be inactivated by the moisture in the air to decrease the number of isocyanate groups to be reacted. In such as case, it is effective to prepare the coating solution so that the number of isocyanate groups becomes a little excessive.

The content of the charge transporting compound in the surface protective layer of the present invention is determined depending on the molecular weight of the hydroxyl group-containing compound and that of the isocyanate compound. In order to give the mechanical strength while maintaining the electric characteristics of the photoreceptor, it is necessary to adjust the content of the charge transporting compound in the whole surface protective layer to 5% to 90% by weight, preferably 25% to 75% by weight. The surface protective layer of the present invention incorporates the charge transporting material into the network structure by binding, so that it can introduce a larger amount of the charge transporting material than the conventional charge transporting layer in which a low molecular weight charge transporting material is dispersed.

In order to improve the film forming property and the flexibility, various binder resins may be added to the surface protective layers of the present invention. As such binder resins, various polymers can be used such as polycarbonates, polyesters, acrylic polymers, polyvinyl alcohol and polyamides. In order to maintain the mechanical strength and the electrophotographic characteristics, the content of these binder resins added to the surface protective layers is preferably 60% by weight or less.

For crosslinking polymerization of the surface protective layer of the present invention, the coating solution is applied onto the photoreceptor, followed by heating. The reaction of hydroxyl groups with isocyanate groups generally requires no catalyst, but only heating, although it depends on the reactivity between the compounds used. When a solvent is used in coating, a heating treatment is carried out simultaneously with drying, or subsequently thereto.

When the crosslinking reaction is desired to be enhanced, catalysts such as organic metal compounds such as dibutyltin dilaurate, inorganic metal compounds, monoamines, diamines, triamines, cyclic amines, alcohol amines and ether amines may be added based on the usual methods.

The conductive supports used in the photoreceptors of the present invention include metals such as aluminum, nickel, chromium and stainless steel; plastic films provided with thin films such as aluminum, titanium, nickel, chromium, stainless steel, gold, vanadium, tin oxide, indium oxide and ITO (Indium-Tin Oxide) films; and paper or plastic films coated or impregnated with a conductivity imparting agent. These conductive supports are used in appropriate form such as drum-like, sheet-like or plate-like form, but are not limited thereto.

The surface of the conductive support can be further subjected to various treatments as so desired, as long as images are not affected. For example, the surface can be subjected to an oxidation treatment, a chemical agent treatment, a coloring treatment or a diffused reflection treatment such as sand dressing.

In the photoreceptor of the present invention, an underlayer may be provided between the conductive support and the photosensitive layer. The underlayer prevents the charge from being injected from the conductive support into the photosensitive layer in charging the photosensitive layer of the laminated structure, serves as an adhesive layer for adhering the photosensitive layer to the conductive support as an integral body, and as a layer for preventing the reflection of light of the conductive support in some cases.

Binding resins used for the underlayers include known materials such as polyethylene resins, polypropylene resins, acrylic resins, methacrylic resins, polyamide resins, vinyl chloride resins, vinyl acetate resins, phenol resins, polycarbonate resins, polyurethane resins, polyimide resins, vinylidene chloride resins, polyvinyl acetal resins, vinyl chloride-vinyl acetate copolymers, polyvinyl alcohol resins, water-soluble polyester resins, nitrocellulose, casein, gelatin, polyglutamic acid, starch, starch acetate, amino starch, polyacrylic acid, polyacrylamide, zirconium chelate compounds, titanyl chelate compounds, titanyl alkoxide compounds, organic titanyl compounds and silane coupling agents. These materials may be used alone or as a mixture of two or more kinds of them. Further, they can be used as a mixture with fine particles of titanium oxide, silicon oxide, zirconium oxide, barium titanate, a silicone resin or the like.

The thickness of the underlayer is suitably 0.01 $\mu$m to 10 $\mu$m, and preferably 0.05 $\mu$m to 2 $\mu$m. Coating methods include usual methods such as blade coating, Mayer bar coating, spray coating, dip coating, bead coating, air knife coating and curtain coating.

The charge generating layers of the laminated photoreceptors contain charge generating materials and binder resins. The charge generating materials used herein include inorganic photoconductive materials such as amorphous selenium, crystalline selenium-tellurium alloys, selenium-arsenic alloys, other selenium compounds and selenium alloys, zinc oxide and titanium oxide, and organic pigments and dyes such as phthalocyanine series, squarelium series, anthoanthrone series, perylene series, azo series, anthraquinone series, pyrene series, pyrylium salts and thiapyrylium salts.

Of these, phthalocyanine compounds are preferred from the viewpoint of the light sensitivity of the photoreceptors, and non-metallic phthalocyanines, titanyl phthalocyanine, chlorogallium phthalocyanine and hydroxygallium phthalocyanine are suitable.

In particular, chlorogallium phthalocyanine having a specific crystal form having high diffraction peaks at Bragg angles (2θ±0.2°) of 7.4°, 16.6°, 25.5° and 28.3° in its X-ray diffraction spectrum or hydroxygallium phthalocyanine having a specific crystal form having high diffraction peaks at Bragg angles (2θ±0.2°) of 7.5°, 9.9°, 12.5°, 16.3°, 18.6°, 25.1° and 28.3° in its X-ray diffraction spectrum is particularly preferred, because it has a high charge generating efficiency to light in the region from visible light to near infrared light.

These phthalocyanine crystals having specific crystal forms are synthesized in the following manners:

SYNTHESIS EXAMPLE 3-1

Thirty parts of 1,3-diiminoisoindoline and 9.1 parts of gallium trichloride were added to 230 parts of quinoline. After the reaction at 200° C. for 3 hours, the reaction product was filtered off and washed with acetone and methanol. The resulting wet cake was dried to obtain 28 parts of chlorogallium phthalocyanine crystals. Then, 3 parts of the chlorogallium phthalocyanine crystals were dry ground in an automatic mortar (Lab Mill Type UT-21, manufactured by Yamato Kagaku Co.) for 3 hours, and 0.5 part thereof were milled together with 60 parts of glass beads (1 mm in diameter) in 20 parts of benzyl alcohol at room temperature for 24 hours. Thereafter, the glass beads were filtered off, and the filtrate was washed with 10 parts of methanol and dried, thereby obtaining chlorogallium phthalocyanine crystals having high diffraction peaks at Bragg angles (2θ±0.2°) of 7.4°, 16.6°, 25.5° and 28.3° in its X-ray diffraction spectrum.

SYNTHESIS EXAMPLE 3-2

Three parts of the chlorogallium phthalocyanine crystals obtained in synthesis example 1 were dissolved in 60 parts of concentrated sulfuric acid at 0° C., and the resulting solution was added dropwise to 450 parts of distilled water at 5° C. to reprecipitate the crystals. The resulting crystals were washed with distilled water and diluted aqueous ammonia, and then, dried to obtain 2.5 parts of hydroxygallium phthalocyanine crystals. The crystals were dry ground in the automatic mortar used in Synthesis Example 3-1 for 5.5 hours, and 0.5 part thereof were milled together with 15 parts of dimethylformamide and 30 parts of glass beads (1 mm in diameter) at room temperature for 24 hours. Thereafter, the glass beads were filtered off, and the filtrate was washed with 10 parts of methanol and dried, thereby obtaining hydroxygallium phthalocyanine crystals having high diffraction peaks at Bragg angles (2θ±0.2°) of 7.5°, 9.9°, 12.5°, 16.3°, 18.6°, 25.1° and 28.3° in its X-ray diffraction spectrum.

Binding resins used in the charge generating layers include but are not limited to polyvinyl butyral resins, polyvinyl formal resins, partially modified polyvinyl acetal resins, polycarbonate resins, polyester resins, acrylic resins, polyvinyl chloride resins, polystyrene resins, polyvinyl acetate resins, vinyl chloride-vinyl acetate copolymers, silicone resins, phenol resins and poly-N-vinylcarbazole resins. These binding resins can be used alone or as a mixture of two or more kinds of them.

The compounding ratio (weight ratio) of the charge generating material to the binding resin is preferably within the range of 10:1 to 1:10. Further, the thickness of the charge generating layer used in the present invention is generally 0.1 μm to 5 μm, and preferably 0.2 μm to 2.0 μm.

Coating methods include usual methods such as blade coating, Mayer bar coating, spray coating, dip coating, bead coating, air knife coating and curtain coating.

Solvents used in forming the charge generating layers include usual organic solvents such as methanol, ethanol, n-propanol, n-butanol, benzyl alcohol, methyl cellosolve, ethyl cellosolve, acetone, methyl ethyl ketone, cyclohexanone, methyl acetate, n-butyl acetate, dioxane, tetrahydrofuran, methylene chloride and chloroform. These solvents can be used alone or as a mixture of two or more kinds of them.

The charge transporting layers of the laminated photoreceptors comprise charge transporting materials and binder resins.

The charge transporting materials include quinone compounds such as p-benzoquinone, chloranil, bromanil and anthraquinone, tetracyanoquinodimethane compounds, fluorenone compounds such as 2,4,7-trinitrofluorenone, xanthone compounds, benzophenone compounds, cyanovinyl compounds, electron attractive compounds such as ethylene compounds, triarylamine compounds, benzine compounds, arylalkane compounds, aryl-substituted ethylene compounds, stilbene compound, anthracene compounds and hydrazone compounds. These charge transporting materials can be used alone or as a mixture of two or more kinds of them.

In particular, the benzidine compounds represented by the above-mentioned structural formula (3-IV) and the triphenylamine compounds represented by the above-mentioned structural formula (3-V) can be preferably used because they have high charge (hole) transporting ability and excellent stability. Specific examples of the above-mentioned benzine compounds are shown in Table 3-8, and specific examples of the above-mentioned triphenylamine compounds are shown in Tables 3-9 to 3-11.

TABLE 3-8

| No. | $R_2$ $R_2'$ | $(R_3)p$ $(R_3')p$ | $(R_4)q$ $(R_4')q$ | No. | $R_2$ $R_2'$ | $(R_3)p$ $(R_3')p$ | $(R_4)q$ $(R_4')q$ |
|---|---|---|---|---|---|---|---|
| IV-1 | $CH_3$ | H | H | IV-28 | Cl | H | H |
| IV-2 | $CH_3$ | 2-$CH_3$ | H | IV-29 | Cl | 2-$CH_3$ | H |
| IV-3 | $CH_3$ | 3-$CH_3$ | H | IV-30 | Cl | 3-$CH_3$ | H |
| IV-4 | $CH_3$ | 4-$CH_3$ | H | IV-31 | Cl | 4-$CH_3$ | H |
| IV-5 | $CH_3$ | 4-$CH_3$ | 2-$CH_3$ | IV-32 | Cl | 4-$CH_3$ | 2-$CH_3$ |
| IV-6 | $CH_3$ | 4-$CH_3$ | 3-$CH_3$ | IV-33 | Cl | 4-$CH_3$ | 3-$CH_3$ |
| IV-7 | $CH_3$ | 4-$CH_3$ | 4-$CH_3$ | IV-34 | Cl | 4-$CH_3$ | 4-$CH_3$ |
| IV-8 | $CH_3$ | 3,4-$CH_3$ | H | IV-35 | $C_2H_5$ | H | H |
| IV-9 | $CH_3$ | 3,4-$CH_3$ | 3,4-$CH_3$ | IV-36 | $C_2H_5$ | 2-$CH_3$ | H |
| IV-10 | $CH_3$ | 4-$C_2H_5$ | H | IV-37 | $C_2H_5$ | 3-$CH_3$ | H |
| IV-11 | $CH_3$ | 4-$C_3H_7$ | H | IV-38 | $C_2H_5$ | 4-$CH_3$ | H |
| IV-12 | $CH_3$ | 4-$C_4H_9$ | H | IV-39 | $C_2H_5$ | 4-$CH_3$ | 4-$CH_3$ |
| IV-13 | $CH_3$ | 4-$C_2H_5$ | 2-$CH_3$ | IV-40 | $C_2H_5$ | 4-$C_2H_5$ | 4-$CH_3$ |
| IV-14 | $CH_3$ | 4-$C_2H_5$ | 3-$CH_3$ | IV-41 | $C_2H_5$ | 4-$C_3H_7$ | 4-$CH_3$ |
| IV-15 | $CH_3$ | 4-$C_2H_5$ | 4-$CH_3$ | IV-42 | $C_2H_5$ | 4-$C_4H_9$ | 4-$CH_3$ |
| IV-16 | $CH_3$ | 4-$C_2H_5$ | 3,4-$CH_3$ | IV-43 | $OCH_3$ | H | H |
| IV-17 | $CH_3$ | 4-$C_3H_7$ | 3-$CH_3$ | IV-44 | $OCH_3$ | 2-$CH_3$ | H |
| IV-18 | $CH_3$ | 4-$C_3H_7$ | 4-$CH_3$ | IV-45 | $OCH_3$ | 3-$CH_3$ | H |
| IV-19 | $CH_3$ | 4-$C_4H_9$ | 3-$CH_3$ | IV-46 | $OCH_3$ | 4-$CH_3$ | H |
| IV-20 | $CH_3$ | 4-$C_4H_9$ | 4-$CH_3$ | IV-47 | $OCH_3$ | 4-$CH_3$ | 4-$CH_3$ |
| IV-21 | $CH_3$ | 4-$C_2H_5$ | 4-$C_2H_5$ | IV-48 | $OCH_3$ | 4-$C_2H_5$ | 4-$CH_3$ |
| IV-22 | $CH_3$ | 4-$C_2H_5$ | 4-$OCH_3$ | IV-49 | $OCH_3$ | 4-$C_3H_7$ | 4-$CH_3$ |
| IV-23 | $CH_3$ | 4-$C_3H_7$ | 4-$C_3H_7$ | IV-50 | $OCH_3$ | 4-$C_4H_9$ | 4-$CH_3$ |
| IV-24 | $CH_3$ | 4-$C_3H_7$ | 4-$OCH_3$ | IV-51 | $CH_3$ | 2-$N(CH_3)_2$ | H |

TABLE 3-8-continued

| No. | $R_2$<br>$R_2'$ | $(R_3)p$<br>$(R_3')p$ | $(R_4)q$<br>$(R_4')q$ | No. | $R_2$<br>$R_2'$ | $(R_3)p$<br>$(R_3')p$ | $(R_4)q$<br>$(R_4')q$ |
|---|---|---|---|---|---|---|---|
| IV-25 | $CH_3$ | 4-$C_4H_9$ | 4-$C_4H_9$ | IV-52 | $CH_3$ | 3-$N(CH_3)_2$ | H |
| IV-26 | $CH_3$ | 4-$C_4H_9$ | 4-$OCH_3$ | IV-53 | $CH_3$ | 4-$N(CH_3)_2$ | H |
| IV-27 | H | 3-$CH_3$ | H | IV-54 | $CH_3$ | 4-Cl | H |

TABLE 3-9

| No. | $(R_5)r$ | $Ar_4$ | $Ar_5$ |
|---|---|---|---|
| V-1<br>V-2 | 4-$CH_3$<br>3,4-$CH_3$ | 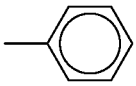 | 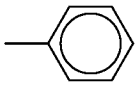 |
| V-3<br>V-4 | 4-$CH_3$<br>3,4-$CH_3$ | 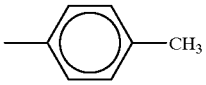 | 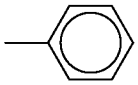 |
| V-5<br>V-6 | 4-$CH_3$<br>3,4-$CH_3$ | 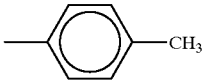 | 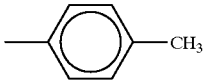 |
| V-7<br>V-8 | 4-$CH_3$<br>3,4-$CH_3$ | 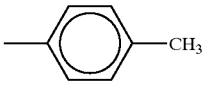 | 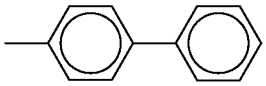 |
| V-9<br>V-10 | 4-$CH_3$<br>3,4-$CH_3$ | 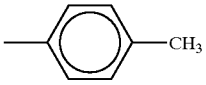 | 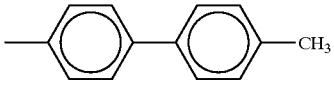 |
| V-11<br>V-12 | 4-$CH_3$<br>3,4-$CH_3$ | 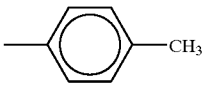 | 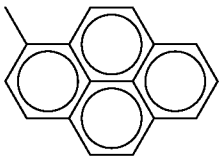 |
| V-13<br>V-14 | 4-$CH_3$<br>3,4-$CH_3$ | 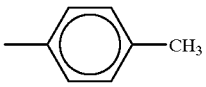 | 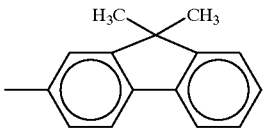 |
| V-15<br>V-16 | 4-$CH_3$<br>3,4-$CH_3$ | 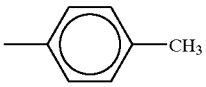 | 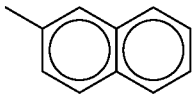 |

TABLE 3-9-continued
| No. | $(R_5)r$ | $Ar_4$ | $Ar_5$ |
|---|---|---|---|
| V-17<br>V-18 | 4-$CH_3$<br>3,4-$CH_3$ | 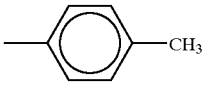 | 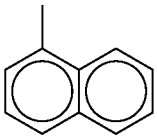 |
| V-19<br>V-20 | 4-$CH_3$<br>3,4-$CH_3$ | 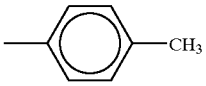 | 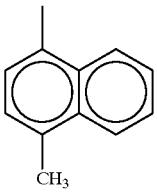 |
| V-21<br>V-22 | 4-$CH_3$<br>3,4-$CH_3$ | 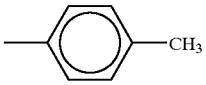 | 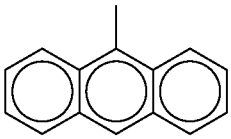 |
TABLE 3-10
| No. | $(R_5)r$ | $Ar_4$ | $Ar_5$ |
|---|---|---|---|
| V-23<br>V-24 | 4-$CH_3$<br>3,4-$CH_3$ | 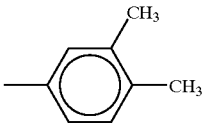 | 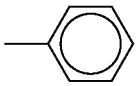 |
| V-25<br>V-26 | 4-$CH_3$<br>3,4-$CH_3$ | 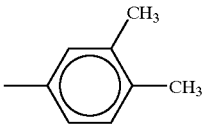 | 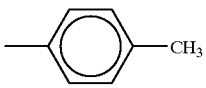 |
| V-27<br>V-28 | 4-$CH_3$<br>3,4-$CH_3$ | 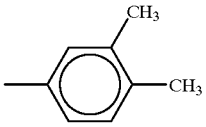 | 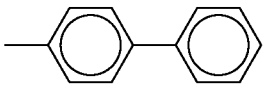 |
| V-29<br>V-30 | 4-$CH_3$<br>3,4-$CH_3$ | 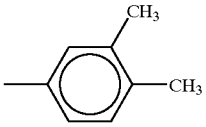 | 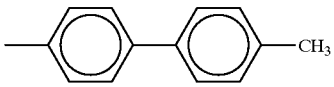 |

TABLE 3-10-continued
| No. | $(R_5)r$ | $Ar_4$ | $Ar_5$ |
|---|---|---|---|
| V-31<br>V-32 | 4-$CH_3$<br>3,4-$CH_3$ | 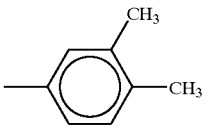 | 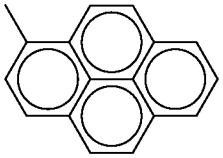 |
| V-33<br>V-34 | 4-$CH_3$<br>3,4-$CH_3$ | 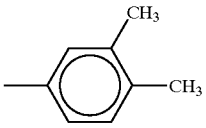 | 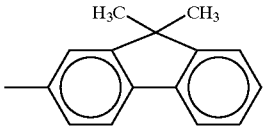 |
| V-35<br>V-36 | 4-$CH_3$<br>3,4-$CH_3$ | 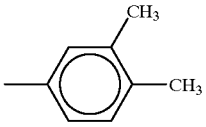 | 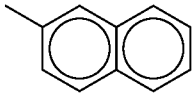 |
| V-37<br>V-38 | 4-$CH_3$<br>3,4-$CH_3$ | 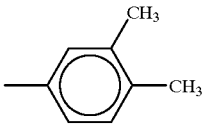 | 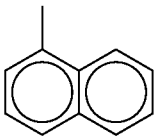 |
| V-39<br>V-40 | 4-$CH_3$<br>3,4-$CH_3$ | 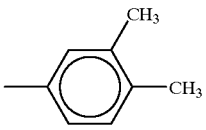 | 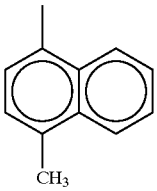 |
| V-41<br>V-42 | 4-$CH_3$<br>3,4-$CH_3$ | 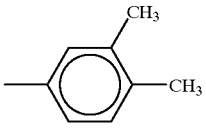 | 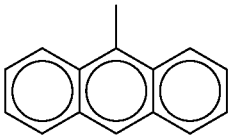 |
TABLE 3-11
| No. | $(R_5)r$ | $Ar_4$ | $Ar_5$ |
|---|---|---|---|
| V-43<br>V-44 | 4-$CH_3$<br>3,4-$CH_3$ | 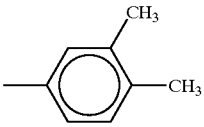 | 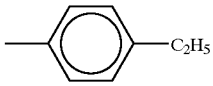 |

TABLE 3-11-continued

| No. | $(R_5)r$ | $Ar_4$ | $Ar_5$ |
|---|---|---|---|
| V-45<br>V-46 | 4-$CH_3$<br>3,4-$CH_3$ | 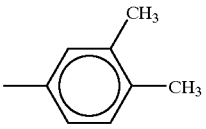 | 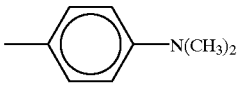 |
| V-47<br>V-48 | 4-$CH_3$<br>3,4-$CH_3$ | 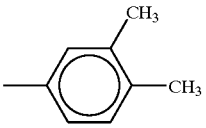 | 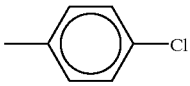 |
| V-49<br>V-50 | 4-$CH_3$<br>3,4-$CH_3$ | 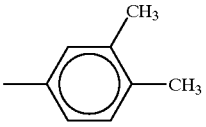 | 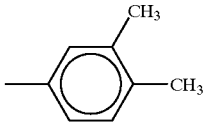 |
| V-51<br>V-52 | 4-$CH_3$<br>3,4-$CH_3$ | 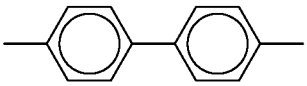 | 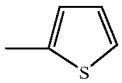 |
| V-53<br>V-54 | 4-$CH_3$<br>3,4-$CH_3$ | 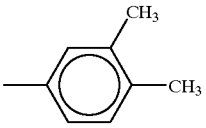 | 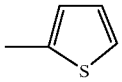 |
| V-55<br>V-56 | 4-$CH_3$<br>3,4-$CH_3$ | 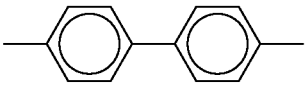 | 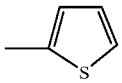 |
| V-57<br>V-58 | 4-$CH_3$<br>3,4-$CH_3$ | 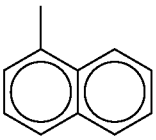 | 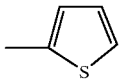 |
| V-59<br>V-60 | 4-$CH_3$<br>3,4-$CH_3$ | 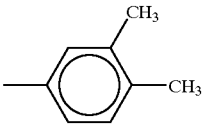 | 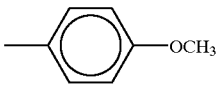 |
| V-61<br>V-62 | 4-$CH_3$<br>3,4-$CH_3$ | 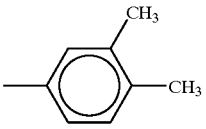 | 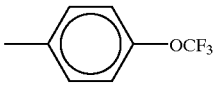 |

The binder resins which can be used in the charge transporting layers include known resins such as polycarbonate resins, polyester resins, methacrylic resins, acrylic resins, polyvinyl chloride resins, polyvinylidene chloride resins, polystyrene resins, polyvinyl acetate resins, styrene-butadiene copolymers, vinylidene chloride-acrylonitrile copolymers, vinyl chloride-vinyl acetate copolymers, vinyl chloride-vinyl acetate-.maleic anhydride copolymers, silicone resins, silicone-alkyd resins, phenol-formaldehyde resins, styrene-acrylic resins, styrene-alkyd resins, poly-N-vinylcarbazole and polysilane.

For the purpose of preventing deterioration of the charge transporting layers caused by oxidizing gases such as ozone generated from charging units, antioxidants may be added to the charge transporting layers. The charge transporting layers are not uppermost layers, so that they do not come into direct contact with the oxidizing gases. However, these oxidizing gases pass through the surface protective layers to the charge transporting layers. The antioxidants are added to prevent oxidation deterioration caused thereby. As the oxidants, hindered phenol or hindered amine antioxidants are preferably used. Known antioxidants such as organic sulfur antioxidants, phosphite antioxidants, dithiocarbamate antioxidants, thiourea antioxidants and benzimidazole antioxidants may be used.

The amount of the antioxidant added is preferably 15% by weight or less, and more preferably 10% by weight or less, based on the charge transporting layer.

Solvents used in forming the charge transporting layers include usual organic solvents such as aromatic hydrocarbons such as benzene, toluene, xylene and chlorobenzene, ketones such as acetone and 2-butanone, aliphatic hydrocarbon halides such as methylene chloride, chloroform, ethylene chloride, and cyclic or straight chain ethers such as tetrahydrofuran, ethyl ether and dioxane. These solvents can be used alone or as a mixture of two or more kinds of them.

As coating methods, the same methods as with the charge generating methods can be used. The thickness of the charge transporting layer is 5 $\mu$m to 50 $\mu$m, and preferably 10 $\mu$m to 40 $\mu$m.

When the monolayer type photosensitive layers are formed, they can be formed of the above-mentioned charge generating materials and binder resins. As the binder resins, binder resins similar to those used in the above-mentioned charge generating layers and charge transporting layers can be used. The content of the charge generating material in the monolayer type photosensitive layer is 10% to 85% by weight, and preferably 20% to 50% by weight.

Charge transporting materials may be added to the monolayer type photosensitive layers as so required. They are preferably added in an amount of 5% to 50% by weight.

Further, antioxidants may be added to the monolayer type photosensitive layers for the same reason as with the case of the charge transporting layers as so desired. The amount of the antioxidant added is preferably 15% by weight or less, and more preferably 10% by weight or less.

The electrophotographic photoreceptors of the present invention can also be used in image forming apparatus using noncontact charging systems such as scorotron charging, and have excellent electrophotographic characteristics and durability, particularly resistance to ozone. When they are applied to image forming apparatus using contact charging systems such as charging rolls as charging means, they exhibit very excellent durability to the wear of photoreceptors which remarkably appears in contact charging.

Although the form of a conductive member for conducting contact charging may be any of brush-like, blade-like, pin electrode-like and roller-like forms, the roller-like conductive member is particularly preferred. Usually, the roller-like member is constituted by a resistance layer, an elastic layer for supporting it, and a core member from the outside. A protective layer can be further formed on the outside of the resistance layer if necessary.

A material for the core member is one having conductivity, and iron, copper, brass, stainless steel, aluminum or nickel is generally used. It is also possible to use a resin shaped article in which conductive particles are dispersed.

A material for the elastic layer is one having conductivity or semiconductivity, and, generally, a rubber member is used in which conductive or semiconductive particles are dispersed.

The rubber members used herein include EPDM, polybutadiene, natural rubber, polyisobutylene, SBR, CR, NBR, silicone rubber, urethane rubber, epichlorohydrin rubber, SBS, thermoplastic elastomers, norbornene rubber, fluorosilicone rubber and ethylene oxide rubber. The conductive or semiconductive particles include carbon black, metals such as zinc, aluminum, copper, iron, nickel, chromium and titanium, and metal oxides such as $ZnO—Al_2O_3$, $SnO_2—Sb_2O_3$, $In_2O_3—SnO_2$, $ZnO—TiO_2$, $MgO—Al_2O_3$, $FeO—TiO_2$, $TiO_2$, $SnO_2$, $Sb_2O_3$, $In_2O_3$, ZnO and MgO. These materials may be used alone or as a mixture of two or more kinds of them. When two or more kinds of them are used, one may be in fine particle form, and can also be used in combination with fine particles of a fluorine resin.

As materials for the resistance layer and the protective layer, materials can be used in which conductive or semiconductive particles are dispersed in binding resins to regulate their resistance. The resistivity is $10^3$ Ω·cm to $10^{14}$ Ω·cm, preferably $10^5$ Ω·cm to $10^{12}$ Ω·cm, and more preferably $10^7$ Ω·cm to $10^{12}$ Ω·cm. Further, the thicknesses of the resistance layer and the protective layer are within the range of 0.01 $\mu$m to 1,000 $\mu$m, preferably 0.1 $\mu$m to 500 $\mu$m, and more preferably 0.5 $\mu$m to 100 $\mu$m.

The binding resins used in the resistance layers and the protective layers include acrylic resins, cellulose resins, polyamide resins, methoxymethylated nylon, ethoxymethylated nylon, polyurethane resins, polycarbonate resins, polyester resins, polyethylene resins, polyvinyl resins, polyarylate resins, polythiophene resins, polyolefin resins such as PcA, FEP and PET, and styrene-butadiene resins.

As the conductive or semiconductive particles used in the resistance layers and the protective layers, carbon black, the metals and the metal oxides used in the elastic layers are used.

Further, antioxidants such as hindered phenols and hindered amines, fillers such as clay and kaolin and lubricants such as silicone oil can be added as so desired. Means for forming these layers include blade coating, Mayer bar coating, spray coating, dip coating, bead coating, air knife coating and curtain coating.

When the photoreceptors are charged by the use of these conductive members, the voltage is applied to the conductive members. In this case, the voltage in which the alternating current voltage is superimposed on the direct current voltage is preferably applied. It is difficult to obtain uniform charge by the use of the direct current voltage alone.

As to the voltage for charging, the direct current voltage is preferably 50 V to 2,000 V in positive or negative, and more preferably 100 V to 1,500 V, depending on the desired charge voltage of the photoreceptors. With respect to the alternating current voltage to be superimposed, the voltage between peaks is suitably 400 V to 1,800 V, preferably 800 V to 1,600 V, and more preferably 1,200 V to 1,600 V. The frequency of the alternating current voltage is 50 Hz to 20,000 Hz, and preferably 100 Hz to 2,000 Hz.

The following description maily relates to the above described embodiments (4-1) to (4-10).

In these embodiments, an electric charge-transporting material terminated by a plurality of hydroxyl groups and a compound having three or more isocyanate groups are mixed so that the hydroxyl groups and the isocyanate groups are allowed to undergo polyaddition reaction with each other to form a three-dimensionally crosslinked surface protective layer. Further, when the foregoing surface protective layer comprises a compound having a hindered phenol structural unit or a compound having a hindered amine structural unit incorporated therein, an electrophotographic photoreceptor can be provided which exhibits a chemical durability against nitrogen oxide or the like as well as a prolonged durability while maintaining desired photoelectric properties required for photoreceptor.

In particular, it was found that the use of compounds containing hydroxyl group represented by the foregoing structural formulae (E) to (G) as electric charge-transporting materials makes it possible to provide an electrophotographic photoreceptor having excellent photoelectric properties, image quality, abrasion resistance, scratch resistance and chemical durability.

The electric charge-transporting material having a plurality of hydroxyl groups can easily form a three-dimensional network structure with a high crosslink density when it undergoes polyaddition reaction with the polyisocyanate compound having three or more isocyanate groups. It is thought that since the surface protective layer has such a high density crosslinked structure, the mechanical strength of the entire surface protective layer cannot be rapidly lowered even if the bonds are partially broken under a strong external stress such as a.c. voltage applied during contact charging and ozone and nitrogen oxide produced by corona charging.

The electric charge-transporting materials represented by the foregoing structural formulae (E) to (G) exhibit an excellent compatibility with many isocyanate compounds and thus can be uniformly incorporated in the network structure to provide good photoelectric properties.

In general, a so-called electric charge-transporting layer comprises a low molecular electric charge-transporting material compatibilized in a binder resin. Thus, if it is desired to maintain a high mechanical strength, the electric charge-transporting layer cannot comprise an electric charge-transporting material incorporated therein in a great amount. The surface protective layer of the present invention comprises an electric charge-transporting material bonded to a three-dimensional structure. Thus, an electric charge-transporting material can be incorporated in the surface protective layer of the present invention in a greater amount than in the ordinary electric charge-transporting layer. Accordingly, the photoelectric properties of the photoreceptor can be maintained over an extended period of time.

Further, the compound having a hindered phenol structural unit or the compound having a hindered amine structural unit exerts an effect of inhibiting the deterioration of the surface layer by ozone, nitrogen oxide, etc. produced by corona charging. Moreover, these compounds exhibit an excellent compatibility with the electric charge-transporting materials having hydroxyl group and an amine structure represented by the foregoing structural formulae (E) to (G) and thus can be uniformly incorporated in the network structure. Therefore, a surface layer comprising these electric charge-transporting materials incorporated therein in a predetermined proportion can maintain a good image quality over an extended period of time without any secondary hindrance.

A polymer which has thus been three-dimensionally crosslinked is normally insoluble in any solvent. Thus, such a three-dimensionally crosslinked polymer cannot be subjected to a conventional process which comprises dissolving the compound in a solvent, applying the coating solution to a substrate, and then drying the coated material to form a film. However, the uncrosslinked compounds may be mixed or dissolved in a solvent, applied to a substrate, formed into a film, and then allowed to undergo crosslinked polymerization reaction by heating or the like to form a surface protective layer. A high molecular electric charge-transporting agent having a low crosslink density may be dissolved in a solvent, applied to a substrate, and then formed into a film. However, the resulting surface layer has a low crosslink density and hence too low a mechanical strength to provide a sufficient abrasion resistance. In particular, a photoreceptor shows a great abrasion when used in an electrophotographic image forming apparatus using contact charging process. Accordingly, a photoreceptor having an insufficient abrasion resistance exhibits a remarkably reduced life.

The photoreceptor of the present invention comprises a photosensitive layer and a surface protective layer formed on an electrically-conductive substrate.

A subbing layer may be provided interposed between the electrically-conductive substrate and the photosensitive layer for the purpose of inhibiting injection of electric charge and generation of interference band and improving adhesivity. The photosensitive layer of the present invention may be of single layer type or laminated type consisting of electric charge-generating layer and electric charge-transporting layer. In an electrophotographic photoreceptor comprising a laminated type photosensitive layer, the order of lamination of electric charge-generating layer and electric charge-transporting layer is not limited. Since the surface protective layer of the present invention is mainly capable of transporting positive holes, the electrophotographic photoreceptor of the present invention exhibits the most excellent properties if it is of negatively-charged laminated type comprising an electric charge-generating layer, an electric charge-transporting layer and a surface protective layer laminated in this order.

As the electric charge-transporting material containing hydroxyl group to be incorporated in the surface protective layer of the present invention there may be used those represented by the foregoing structural formulae (E) to (G), which exhibit excellent photoelectric properties and abrasion resistance.

Specific examples of the compounds represented by the foregoing structural formula (E) are shown in Tables 4-1 and 4-2 below. Specific examples of the divalent bond T in the structural formula (E) are shown in Table 4-3 below. In Tables 4-1, 4-2 and 4-4, "P" represents the substituted position.

TABLE 4-1

| No. | $R_1$ | $R_2$ | $R_3$ | n | T | p |
|---|---|---|---|---|---|---|
| A-1 | H | H | H | 0 | — | 3 |
| A-2 | H | H | H | 0 | — | 4 |
| A-3 | H | H | H | 1 | T-1 | 3 |
| A-4 | H | H | H | 1 | T-1 | 4 |
| A-5 | H | H | H | 1 | T-2 | 3 |
| A-6 | H | H | H | 1 | T-2 | 4 |
| A-7 | 2-$CH_3$ | H | H | 0 | — | 3 |
| A-8 | 2-$CH_3$ | H | H | 0 | — | 4 |

TABLE 4-1-continued

| No. | $R_1$ | $R_2$ | $R_3$ | n | T | p |
|---|---|---|---|---|---|---|
| A-9 | 3-$CH_3$ | H | H | 0 | — | 3 |
| A-10 | 4-$CH_3$ | H | H | 0 | — | 3 |
| A-11 | 4-$CH_3$ | H | H | 0 | — | 4 |
| A-12 | 4-$CH_3$ | H | H | 1 | T-1 | 3 |
| A-13 | 4-$CH_3$ | H | H | 1 | T-1 | 4 |
| A-14 | 2-$CH_3$ | 3-$CH_3$ | H | 0 | — | 3 |
| A-15 | 2-$CH_3$ | 3-$CH_3$ | H | 0 | — | 4 |
| A-16 | 2-$CH_3$ | 3-$CH_3$ | H | 1 | T-1 | 3 |
| A-17 | 2-$CH_3$ | 3-$CH_3$ | H | 1 | T-1 | 4 |
| A-18 | 3-$CH_3$ | 4-$CH_3$ | H | 0 | — | 3 |
| A-19 | 3-$CH_3$ | 4-$CH_3$ | H | 0 | — | 4 |
| A-20 | 3-$CH_3$ | 4-$CH_3$ | H | 1 | T-1 | 3 |
| A-21 | 3-$CH_3$ | 4-$CH_3$ | H | 1 | T-1 | 4 |
| A-22 | 3-$CH_3$ | 4-$CH_3$ | H | 1 | T-2 | 4 |
| A-23 | 3-$CH_3$ | 5-$CH_3$ | H | 0 | — | 3 |

TABLE 4-2

| No. | $R_1$ | $R_2$ | $R_3$ | n | T | p |
|---|---|---|---|---|---|---|
| A-24 | 3-$CH_3$ | 5-$CH_3$ | H | 0 | — | 4 |
| A-25 | 4-$CH_3O$ | H | R | 0 | — | 3 |
| A-26 | 4-$CH_3O$ | R | H | 0 | — | 4 |
| A-27 | H | H | $CH_3$ | 0 | — | 3 |
| A-28 | H | H | $CH_3$ | 0 | — | 4 |

TABLE 4-2-continued

| No. | $R_1$ | $R_2$ | $R_3$ | n | T | p |
|---|---|---|---|---|---|---|
| A-29 | H | H | $CH_3$ | 1 | T-1 | 3 |
| A-30 | H | H | $CH_3$ | 1 | T-1 | 4 |
| A-31 | 4-$CH_3$ | H | $CH_3$ | 0 | — | 3 |
| A-32 | 4-$CH_3$ | H | $CH_3$ | 0 | — | 4 |
| A-33 | 4-$CH_3$ | H | $CH_3$ | 1 | T-1 | 3 |
| A-34 | 4-$CH_3$ | H | $CH_3$ | 1 | T-1 | 4 |
| A-35 | 3-$CH_3$ | 4-$CH_3$ | $CH_3$ | 0 | — | 4 |
| A-36 | 3-$CH_3$ | 4-$CH_3$ | $CH_3$ | 1 | T-1 | 4 |
| A-37 | 3-$CH_3$ | 5-$CH_3$ | $CH_3$ | 0 | — | 4 |
| A-38 | 3-$CH_3$ | 5-$CH_3$ | $CH_3$ | 1 | T-1 | 4 |
| A-39 | 3-$C_2H_5$ | H | H | 0 | — | 3 |
| A-40 | 4-$C_2H_5$ | H | H | 0 | — | 3 |
| A-41 | 4-$C_2H_5$ | H | H | 0 | — | 4 |
| A-42 | 4-$C_2H_5$ | H | H | 1 | T-1 | 3 |
| A-43 | 4-$C_2H_5$ | H | H | 1 | T-1 | 4 |
| A-44 | 2-$C_2H_5$ | H | $CH_3$ | 0 | — | 4 |
| A-45 | 3-$C_3H_6$ | H | $CH_3$ | 0 | — | 4 |
| A-46 | 4-$C_2H_5$ | H | $CH_3$ | 0 | — | 4 |

TABLE 4-3

| No. | | No. | | No | | No. | |
|---|---|---|---|---|---|---|---|
| T-1 | —$CH_3$— | T-2 | —$(CH_2)_2$— | T-3 | —CH($CH_3$)— | T-4 | —$(CH_2)_3$— |
| T-5 | —CH($CH_3$)—$CH_2$— | T-6 | —C($CH_3$)$_2$— | T-7 | —$(CH_2)_4$— | T-8 | —CH($CH_3$)—CH($CH_2$)— |
| T-9 | —C($CH_3$)$_2$—$CH_2$— | T-10 | —CH($CH_3$)$CH_2CH_2$— | T-11 | —$CH_2$CH($CH_3$)$CH_2$— | T-12 | —$(CH_2)_5$— |
| T-13 | —CH($C_2H_5$)—CH($CH_3$)— | T-14 | —CH($C_3H_7$)—$CH_2$— | T-15 | —C($CH_3$)$_2$—$CH_2CH_2$— | T-16 | —CH($CH_3$)—CH($CH_3$)$CH_2$— |
| T-17 | —CH($CH_3$)$CH_2$CH($CH_3$)— | T-18 | —$CH_2$C($CH_3$)$_2$—$CH_2$— | T-19 | —CH($CH_3$)$CH_2CH_2CH_2$— | | |
| T-20 | —$CH_2$CH($CH_3$)$CH_2CH_2$— | T-21 | —CH($CH_3$)$(CH_2)_4$— | T-22 | —$CH_2$CH($CH_3$)—$(CH_2)_3$— | | |

Specific examples of the foregoing structural formula (F) are shown in Table 4-4. The divalent bond T in the structural formula (F) is the same as in the structural formula (E). In the Table, "P(R4)" and "P(T)" represent the substituted positions of $R_4$ and T, respectively.

TABLE 4-4

| No. | $R_4$ | P(R4) | n | T | P(T) |
|---|---|---|---|---|---|
| B-1 | H | — | 0 | — | 3 |
| B-2 | H | — | 0 | — | 4 |
| B-3 | H | — | 1 | T-1 | 3 |
| B-4 | H | — | 1 | T-1 | 4 |
| B-5 | H | — | 1 | T-2 | 3 |
| B-6 | H | — | 1 | T-2 | 4 |
| B-7 | $CH_3$ | 4 | 0 | — | 3 |
| B-8 | $CH_3$ | 4 | 0 | — | 4 |
| B-9 | Cl | 4 | 0 | — | 3 |
| B-10 | $CF_3$ | 4 | 0 | — | 3 |
| B-11 | $OCH_3$ | 4 | 0 | — | 3 |
| B-12 | 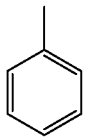 | 4 | 0 | — | 3 |
| B-13 | 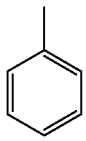 | 4 | 0 | — | 4 |
| B-14 | 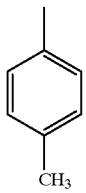 | 4 | 0 | — | 3 |
| B-15 | 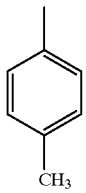 | 4 | 1 | T-1 | 3 |
| B-16 | 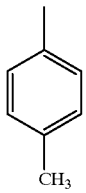 | 4 | 1 | T-1 | 4 |
| B-17 | 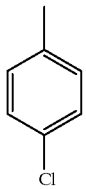 | 4 | 0 | — | 3 |

TABLE 4-4-continued

| No. | $R_4$ | P(R4) | n | T | P(T) |
|---|---|---|---|---|---|
| B-18 | 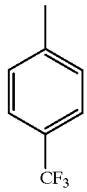 | 4 | 0 | — | 4 |
| B-19 | 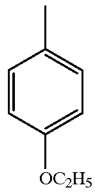 | 4 | 0 | — | 4 |

Specific examples of the foregoing structural formula (G) are shown in Table 4-5 below. Specific examples of $Ar_1$ in the structural formula (G) are shown in Table 4-6. Specific examples of $Ar_2$ and $Ar_3$ are shown in Table 4-7 below. $Ar_1$ may be bonded at either T or N. In Table 4-7, "$Ar_x$" generically represents $Ar_2$ and $Ar_3$.

TABLE 4-5

| No. | $R_5$ | X | T | n | $Ar_1$ | $Ar_2$ | $Ar_3$ |
|---|---|---|---|---|---|---|---|
| C-1 | H | $CH_3$ | — | 0 | $Ar_1$-1 | $Ar_x$-1 | $Ar_x$-1 |
| C-2 | H | $CH_x$ | T-1 | 1 | $Ar_1$-1 | $Ar_x$-1 | $Ar_x$-1 |
| C-3 | H | $CH_x$ | T-2 | 1 | $Ar_1$-1 | $Ar_x$-1 | $Ar_x$-1 |
| C-4 | H | $CH_x$ | — | 0 | $Ar_1$-1 | $Ar_x$-1 | $Ar_x$-3 |
| C-5 | H | $CH_x$ | T-2 | 1 | $Ar_1$-1 | $Ar_x$-1 | $Ar_x$-3 |
| C-6 | H | $CH_x$ | — | 0 | $Ar_1$-1 | $Ar_x$-1 | $Ar_x$-7 |
| C-7 | H | $CH_x$ | T-2 | 1 | $Ar_1$-1 | $Ar_x$-1 | $Ar_x$-7 |
| C-8 | H | $CH_x$ | — | 0 | $Ar_1$-1 | $Ar_x$-1 | $Ar_x$-12 |
| C-9 | H | $CH_x$ | — | 0 | $Ar_1$-1 | $Ar_x$-7 | $Ar_x$-14 |
| C-10 | H | $CH_x$ | T-2 | 1 | $Ar_1$-1 | $Ar_x$-7 | $Ar_x$-14 |
| C-11 | H | $CH_x$ | — | 0 | $Ar_1$-1 | $Ar_x$-9 | $Ar_x$-9 |
| C-12 | H | $CH_x$ | T-2 | 1 | $Ar_1$-1 | $Ar_x$-9 | $Ar_x$-9 |
| C-13 | H | $CH_x$ | — | 0 | $Ar_1$-4 | $Ar_x$-7 | $Ar_x$14 |
| C-14 | H | $CH_x$ | — | 0 | $Ar_1$-1 | $Ar_x$-1 | $Ar_x$21 |
| C-15 | 3-$CH_x$ | $CH_x$ | T-2 | 1 | $Ar_1$-1 | $Ar_x$-1 | $Ar_x$-1 |
| C-16 | 3-$CH_x$ | $CH_x$ | — | 0 | $Ar_1$-1 | $Ar_x$-7 | $Ar_x$14 |
| C-17 | 3-$CH_x$ | $CH_x$ | T-2 | 1 | $Ar_1$-1 | $Ar_x$-7 | $Ar_x$14 |
| C-18 | H | $CH_x$ | T-2 | 1 | $Ar_1$-10 | $Ar_x$-1 | $Ar_x$-1 |
| C-19 | H | $CH_x$ | T-2 | 1 | $Ar_1$-10 | $Ar_x$-1 | $Ar_x$-7 |
| C-20 | H | 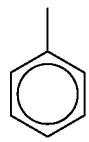 | T-2 | 1 | $Ar_1$-1 | $Ar_x$-1 | $Ar_x$-1 |
| C-21 | H | 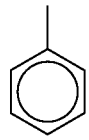 | T-2 | 1 | $Ar_1$-1 | $Ar_x$-1 | $Ar_x$12 |

TABLE 4-5-continued
| No. | $R_5$ | X | T | n | $Ar_1$ | $Ar_2$ | $Ar_3$ |
|---|---|---|---|---|---|---|---|
| C-22 | H | 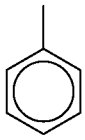 | T-2 | 1 | $Ar_1$-1 | $Ar_x$-1 | $Ar_x$14 |
TABLE 4-5-continued
| No. | $R_5$ | X | T | n | $Ar_1$ | $Ar_2$ | $Ar_3$ |
|---|---|---|---|---|---|---|---|
| C-23 | H | 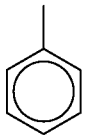 | T-2 | 1 | $Ar_1$-1 | $Ar_x$-7 | $Ar_x$14 |
TABLE 4-6
| No. | | No. | | No. | |
|---|---|---|---|---|---|
| $Ar_1$-1 | 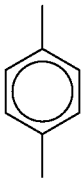 | $Ar_1$-2 | 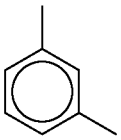 | $Ar_1$-3 | 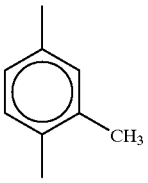 |
| $Ar_1$-4 | 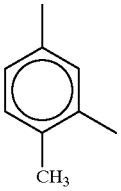 | $Ar_1$-5 | 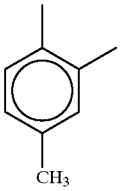 | $Ar_1$-6 | 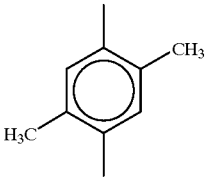 |
| $Ar_1$-7 | 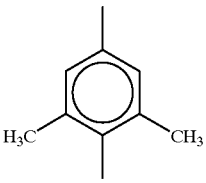 | $Ar_1$-8 | 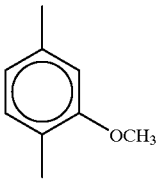 | $Ar_1$-9 | 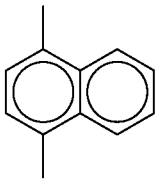 |
| $Ar_1$-10 | 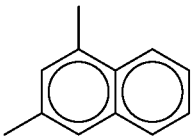 | $Ar_1$-11 | 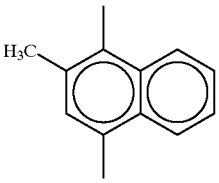 | $Ar_1$-12 | 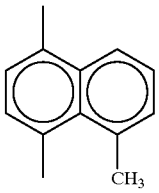 |
| $Ar_1$-13 | 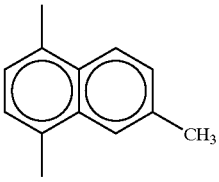 | $Ar_1$-14 | 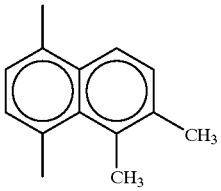 | $Ar_1$-15 | 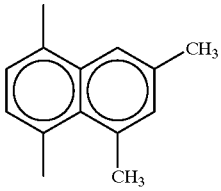 |

TABLE 4-6-continued
| No. | No. | No. |
|---|---|---|
| $Ar_1$-16 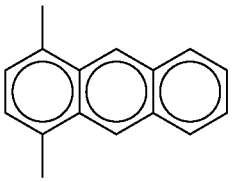 | $Ar_1$-17 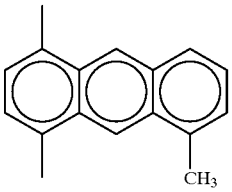  | $Ar_1$-18 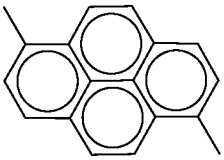 |
TABLE 4-7
| No. | No. | No. |
|---|---|---|
| $Ar_x$-1 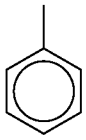 | $Ar_x$-2 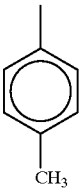  | $Ar_x$-3 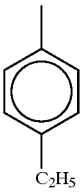  |
| $Ar_x$-4 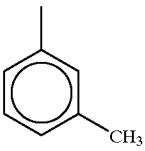  | $Ar_x$-5 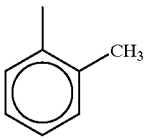  | $Ar_x$-6 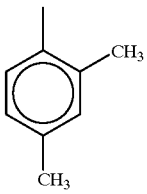  |
| $Ar_x$-7 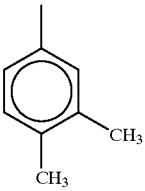  | $Ar_x$-8 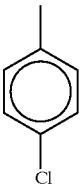  | $Ar_x$-9 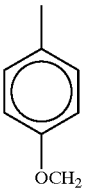  |
| $Ar_x$-10 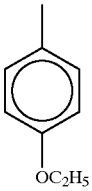  | $Ar_x$-11 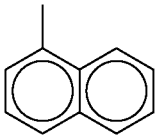 | $Ar_x$-12 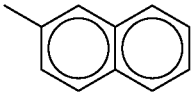 |
| $Ar_x$-13 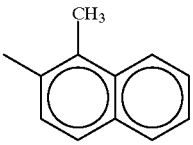  | $Ar_x$-14 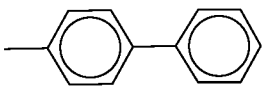 | $Ar_x$-15 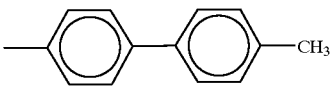  |

TABLE 4-7-continued

| No. | | No. | | No. | |
|---|---|---|---|---|---|
| $Ar_x$-16 | 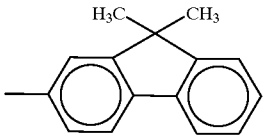 | $Ar_x$-17 | 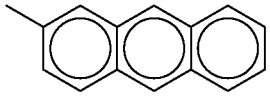 | $Ar_x$-18 | 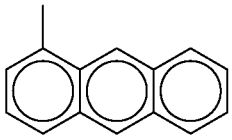 |
| $Ar_x$-19 | 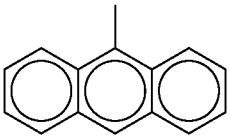 | $Ar_x$-20 | 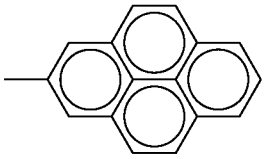 | $Ar_x$-21 | 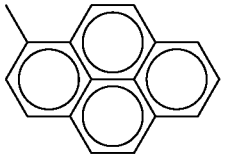 |

The surface protective layer of the present invention may comprise a compound containing two or more hydroxyl groups such as glycol compound and bisphenol compound incorporated therein as a constituent for the purpose of improving its flexibility, film-forming properties, humidity dependence and surface adhesivity. The compounds substitute for some of the compounds represented by the foregoing structural formulae (E) to (G) to form a crosslinked structure.

These hydroxyl group-containing compounds may be arbitrarily selected from the group consisting of those having two or more hydroxyl groups per molecule which can undergo polyaddition with isocyanate. Examples of these hydroxyl group-containing compounds include ethylene glycol, propylene glycol, butanediol, polyethylene glycol, and bisphenol compound. Specific examples of these compounds containing two or more hydroxyl groups are shown in Table 4-8 below. Other examples of compounds containing hydroxyl group employable herein include acryl polyol, polyester polyol, various polymers containing reactive hydroxyl group, and oligomer thereof.

TABLE 4-8

| No. | | No. | |
|---|---|---|---|
| H-1 | 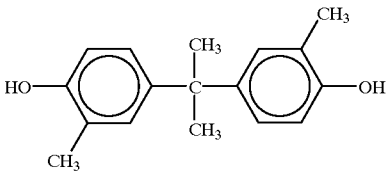 | H-2 | 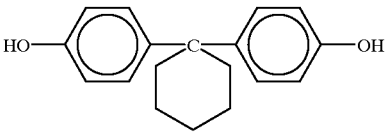 |
| H-3 | 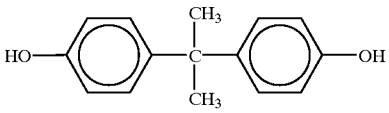 | H-4 | 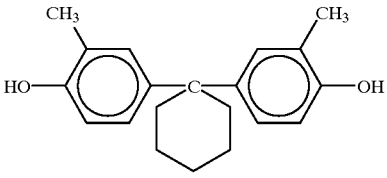 |
| H-5 | 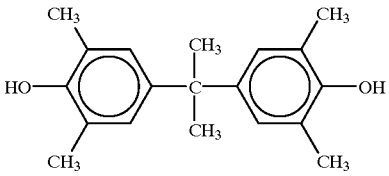 | H-6 | 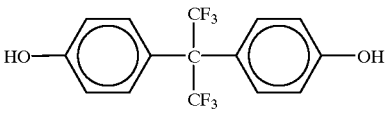 |

TABLE 4-8-continued

| No. | | No. | |
|---|---|---|---|
| H-7 | 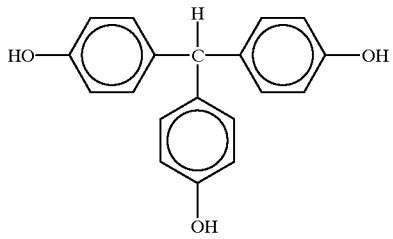 | H-8 | 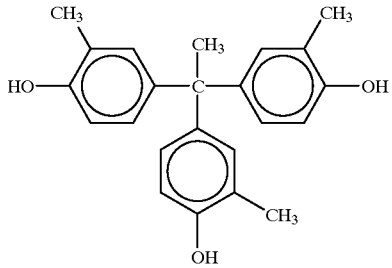 |
| H-9 | 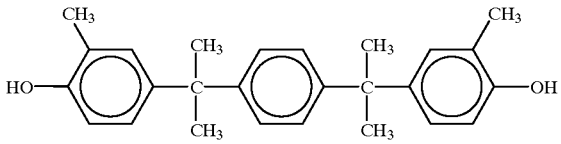 | H-10 | 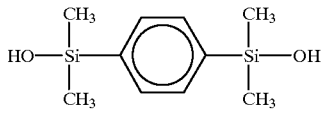 |
| H-11 | 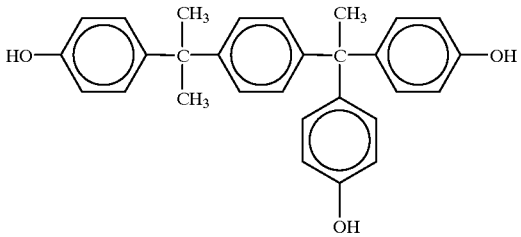 | H-12 | 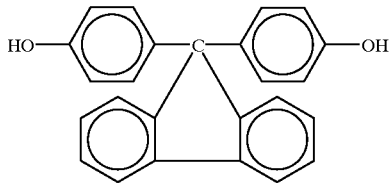 |
| H-13 | 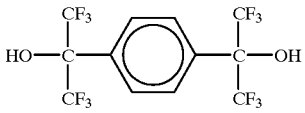 | H-14 | 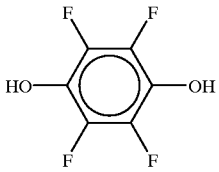 |
| H-15 | $HOCH_2(CF_2)_4CH_2OH$ | H-16 | $HOCH_2(CF_2)_{10}CH_2OH$ |

In order to effect crosslinking to form a three-dimensional network structure, it is necessary that as the isocyanate compound there be used one having three or more functionalities, i.e., three or more reactive isocyanate groups. The resulting surface protective layer can form a high density crosslinked structure therein.

As the isocyanate compound containing three or more isocyanate groups there may be preferably used a derivative obtained from isocyanate monomer or a modified polyisocyanate such as prepolymer. Specific preferred examples of these isocyanate compounds include adduct-modified products obtained by adding isocyanate to polyol having three or more functional groups, burette-modified products obtained by modifying a compound having urea bond with an isocyanate compound, alophanate-modified products obtained by adding isocyanate to urethane group, and isocyanurate-modified products. Further, carbodiimide-modified products may be used. Specific examples of modified products other than those represented by the foregoing structural formulae (4-D) and (4-E) are shown below.

(4-i)

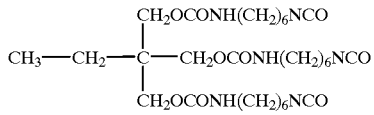

-continued (4-ii)

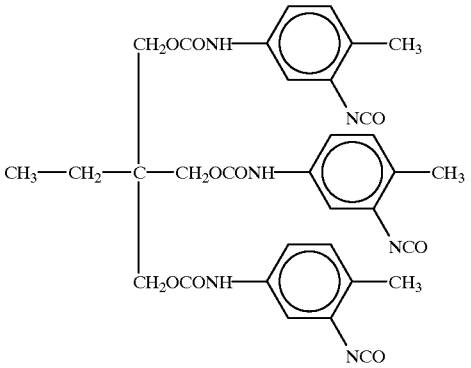

(4-iii)

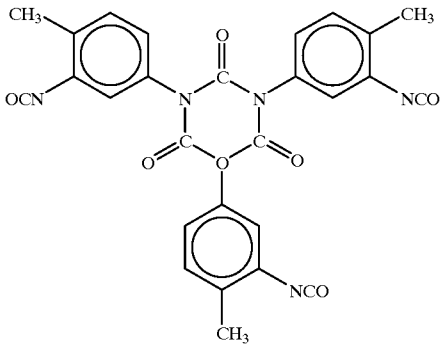

In particular, a surface protective layer formed by a burette-modified hexamethylenediisocyanate and an isocyanurate-modified hexamethylenediisocyanate as represented by the foregoing structural formulae (4-D) and (4-E) exhibits excellent mechanical strength and electrical properties.

Examples of isocyanate compounds which can be used auxiliarily used with the foregoing isocyanate include ordinary isocyanate monomers such as tolylene diisocyanate (TDI), diphenylmethane diisocyanate (MDI), 1,5-naphthylene diisocyanate, toluidine diisocyanate, 1,6-hexamethylene diisocyanate, xylene diisocyanate, lysine diisocyanate, tetramethylxylene diisocyanate, 1,3,6-hexamethylene triisocyanate, lysine ester triisocyanate, 1,6,11-undecane triisocyanate, 1,8-isocyanate-4-isocyanate methyl octane, triphenylmethane triisocyanate and tris (isocyanatephenyl) thiophosphate.

Blocked isocyanates obtained by the reaction of a isocyanate group-containing compound with a blocking agent for temporarily masking the activity of isocyanate group may be preferably used. These blocked isocyanates are also desirable from the standpoint of extension of the pot life of the coating solution.

Specific examples of Compounds (F-1) to (F-25) having hindered phenol structural unit for use in the present invention are shown in Tables 4-9 to 4-11. Specific examples of Compounds (G-1) to (G-9) having hindered amine structural unit are shown in Tables 4-12 and 4-13 below.

TABLE 4-9

| No | | No | |
|---|---|---|---|
| F-1 | 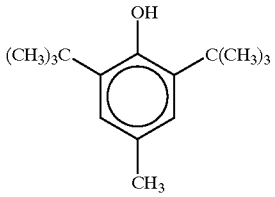 | F-2 | 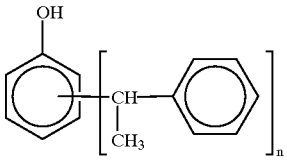 |
| F-3 | 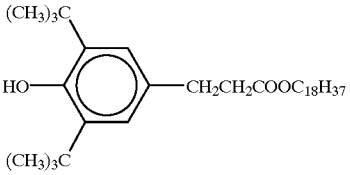 | F-4 | 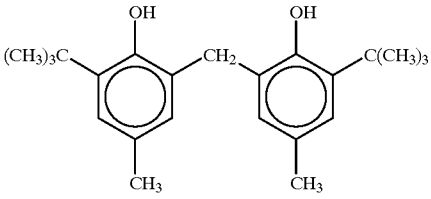 |
| F-5 | 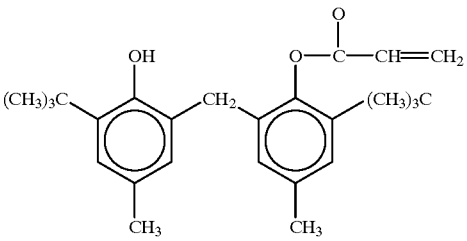 | F-6 | 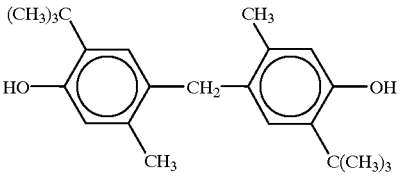 |

TABLE 4-9-continued
| No | No |
|---|---|
| F-7 | 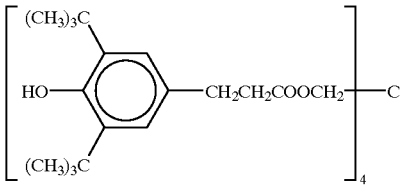 |
| F-8 | 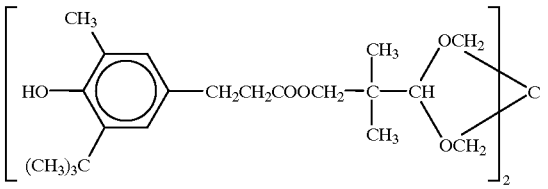 |
| F-9 | 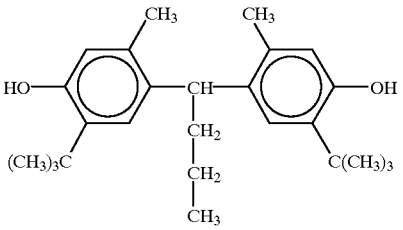 |
| F-10 | 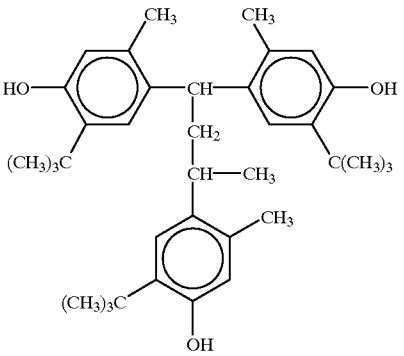 |
TABLE 4-10
| No | |
|---|---|
| F-11 | 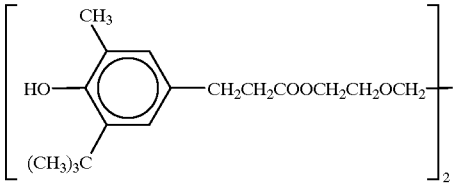 |
| F-12 | 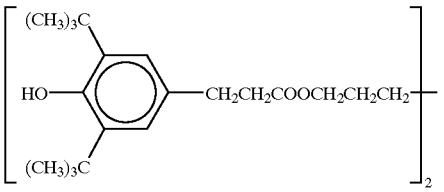 |
| F-14 | 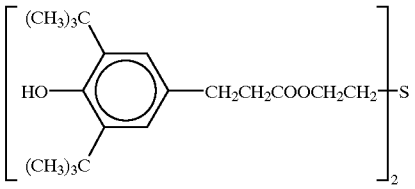 |

TABLE 4-10-continued
| No | |
|---|---|
| F-16 | 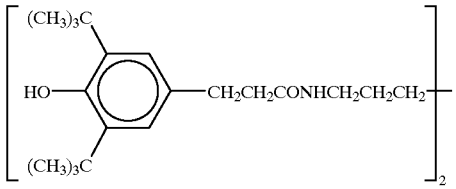 |
| F-13 | 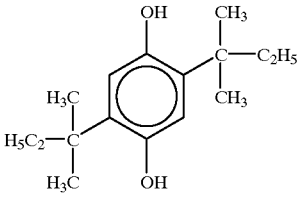 |
| F-15 | 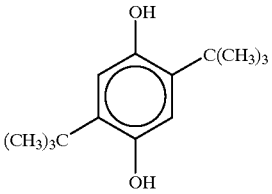 |
| F-17 | 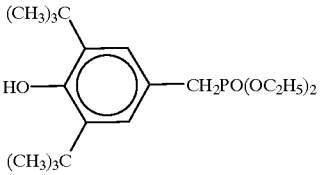 |
| F-18 | 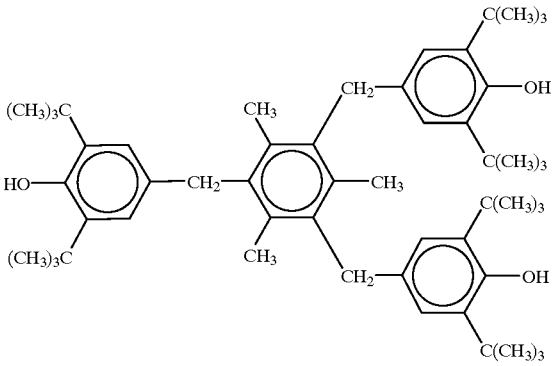 |
TABLE 4-11
| No | |
|---|---|
| F-19 | 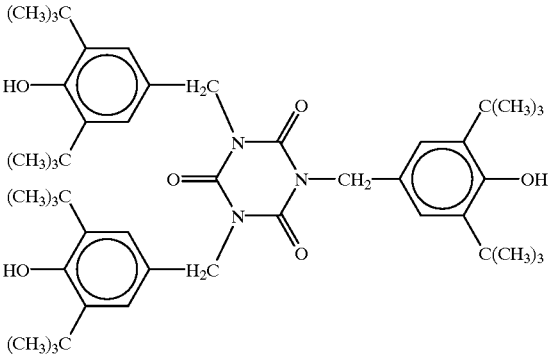 |

TABLE 4-11-continued
| No | | | |
|---|---|---|---|
| F-20 | 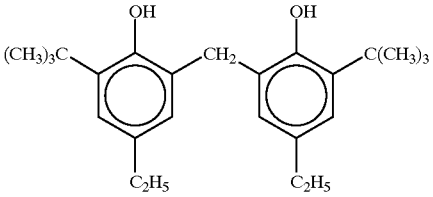 | F-21 | 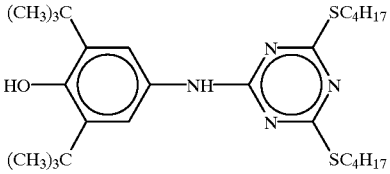 |
| F-22 | 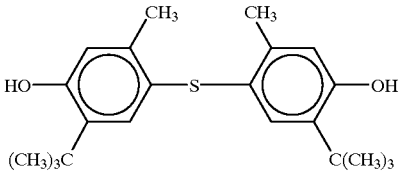 | F-23 | 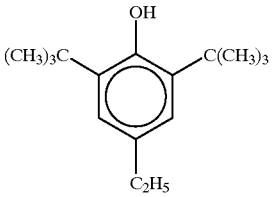 |
| F-24 | 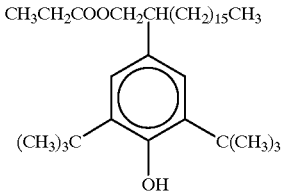 | F-25 | 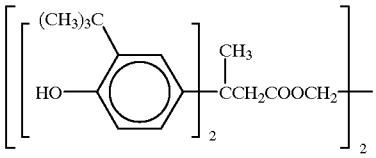 |
TABLE 4-12
| No | |
|---|---|
| G-1 | 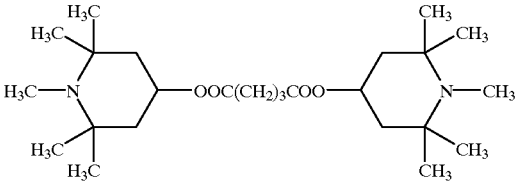 |
| G-2 | 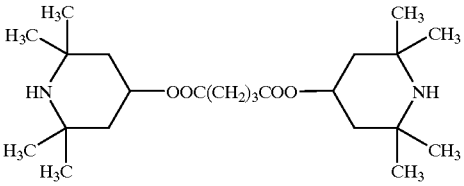 |
| G-3 | 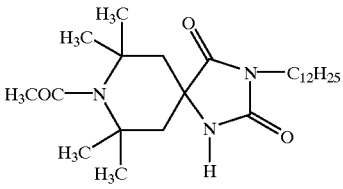 |
| G-4 | 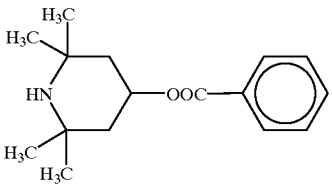 |
| G-5 | 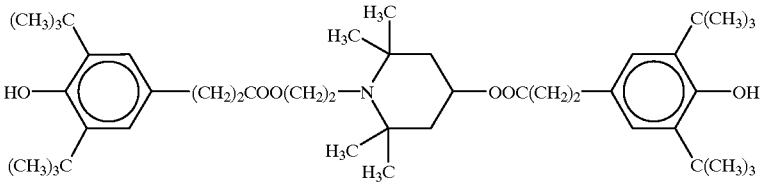 |

TABLE 4-12-continued
| No | |
|---|---|
| G-6 | 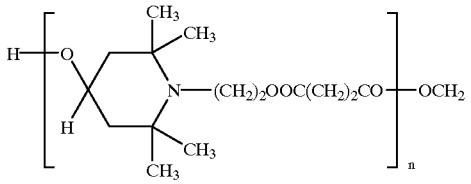 |
| G-7 | 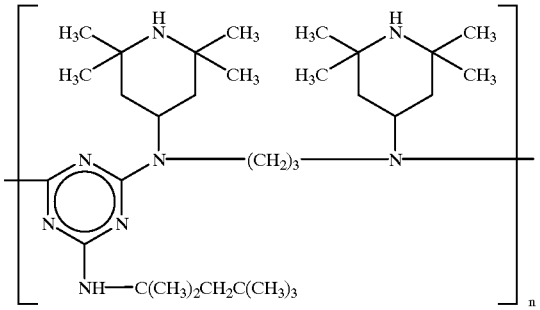 |
TABLE 4-13
| No | |
|---|---|
| G-8 | 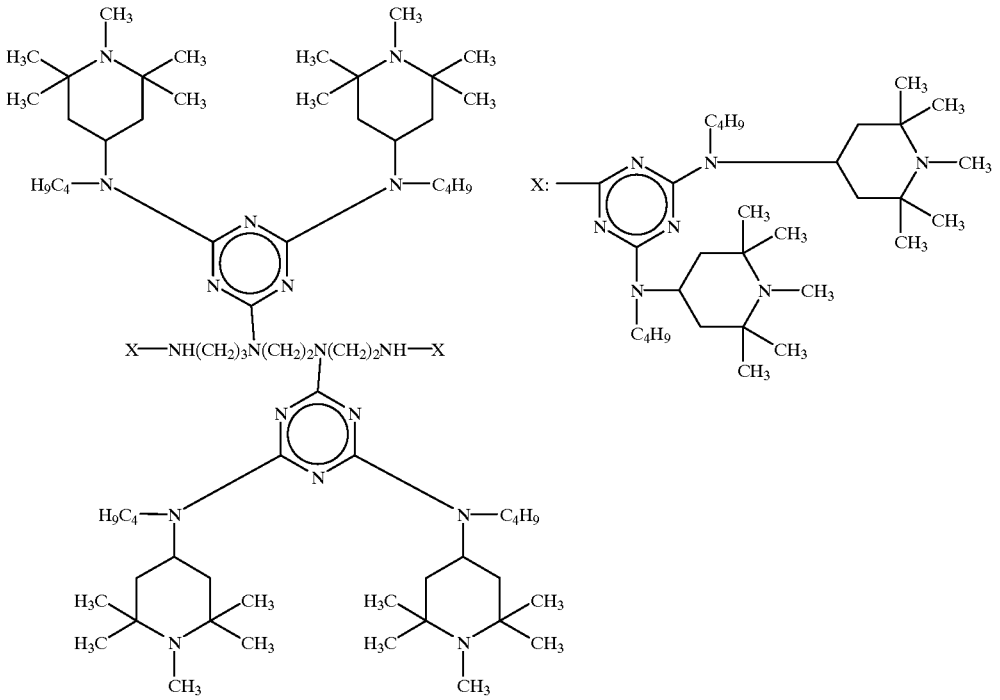 |

TABLE 4-13-continued

| No | |
|---|---|
| G-9 | 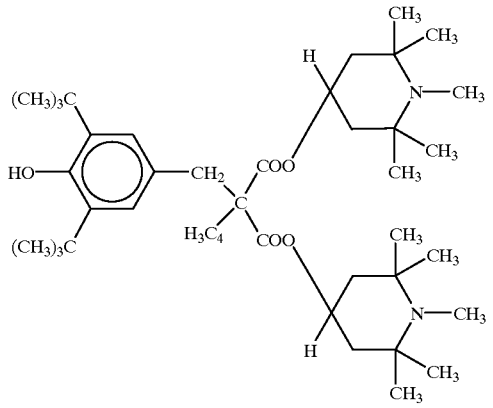 |

The formation of the surface protective layer of embodiments (4-1) to (4-10) can be accomplished by a process which comprises mixing electric charge-transporting materials containing hydroxyl group represented by the foregoing structural formulae (E) to (G), a compound containing three of more isocyanate groups, a compound having a hindered phenol structural unit or compound having a hindered amine structural unit, and optionally other compounds having hydroxyl group, additives and solvents to form a coating solution, applying the coating solution to a photosensitive layer, and then allowing the coating solution to undergo crosslinked polymerization to form a surface protective layer.

The mixing ratio of these constituents is adjusted such that the ratio of (total number of hydroxyl groups) to (total number of isocyanate groups) is from 2:1 to 1:2, preferably from 1.5:1 to 1:1.5, more preferably from 1.2:1 to 1:1.2. If the mixing ratio exceeds 2:1, leaving excess hydroxyl group, the surface of the resulting surface protective layer exhibits a raised hydrophilicity. Thus, the electrophotographic photoreceptor provides deteriorated image properties under high humidity and temperature conditions. On the contrary, if the mixing ratio falls below 1:2, the resulting three-dimensional network structure has a reduced crosslink density that causes the lack of mechanical strength. It is necessary that the mixing ratio as well as reaction conditions be taken carefully.

Further, isocyanate compounds can be deactivated by water content in the air, etc. to have a reduced number of isocyanate groups. Care must be taken in handling it. In this case, the foregoing components may be mixed in such a manner that isocyanate groups occur in somewhat excess.

The content of the electric charge-transporting material in the protective layer is determined by the molecular weight of the hydroxyl group-containing compound, the content of hydroxyl groups in the hydroxyl group-containing compound, the molecular weight of the isocyanate compound, and the content of isocyanate groups in the isocyanate compound. In order that the photoreceptor might be provided with desired mechanical strength while maintaining photoelectric properties require for photoreceptor, the content of the electric charge-transporting material moiety in the entire surface protective layer is determined to a range of from 5 to 90% by weight, preferably from 25 to 75% by weight. The surface protective layer of the present invention comprises an electric charge-transporting material covalently incorporated in a three-dimensional crosslinked structure. Therefore, an electric charge-transporting material can be incorporated in the surface protective layer in a greater amount than in ordinary electric charge-transporting layer without deteriorating the durability of the surface protective layer.

The mixing proportion of the compound having a hindered phenol structure or the compound having a hindered amine structure in the surface protective layer of the present invention is preferably from 0.01 to 30 parts by weight, particularly from 0.1 to 10 parts by weight based on 100 parts by weight of the hydroxyl group-containing compound and the isocyanate compound constituting the three-dimensional crosslinked structure. The compound having a hindered phenol structure and the compound having a hindered amine structure may be each used singly. The two compounds may be effectively used in admixture.

The surface protective layer of the present invention may comprise as an oxidation inhibitor paraphenylenediamine, arylalkane, hydroquinone, spirochroman, spiroindanone, derivative thereof, organic sulfur compound, organic phosphorus compound, etc. incorporated therein. The surface protective layer of the present invention may further comprise as a light stabilizer a derivative such as benzophenone, benzotriazole, dithiocarbamate and tetramethylpiperidine incorporated therein.

Moreover, the surface protective layer may comprise one or more electron accepting substances incorporated therein for the purpose of improving the sensitivity of the electrophotographic photoreceptor, reducing the residual potential and fatigue during repeated use or like purposes. Examples of the electron accepting substances employable in the photoreceptor of the present invention include succinic anhydride, maleic anhydride, dibromomaleic ahydride, phthalic anhydride, tetrabromophthalic anhydride, tetracyanoethylene, tetracyanoquinodimethane, o-dinitrobenzene, m-dinitrobenzene, chloranil, dinitroanthraquinone, trinitrofluorenone, picric acid, o-nitrobenzoic acid, p-nitrobenzoic acid, and phthalic acid. Particularly preferred among these electron accepting substances are fluorenone compound, quinone compound, and benzene derivative having electron attractive substituents such as Cl, CN and $NO_2$.

In order to allow the coating solution of the surface protective layer of the present invention to undergo crosslinked polymerization, the coating solution which has been applied to the photoreceptor may be heated. The addition reaction of hydroxyl group with isocyanate group normally doesn't require the use of catalyst or the like and can be effected only by heating, though depending on the reactivity between the compounds used. If any solvent is used during the application of the coating solution, heat treatment is preferably effected during or after the drying step.

If it is desired to accelerate the crosslinking reaction, a catalyst such as organic metal compound (e.g., dibutyltin dilaurate), inorganic metal compound, monoamine, diamine, triamine, cyclic amine, alcohol amine and ether amine may be added to the reaction system by an ordinary method.

Examples of the electrically-conductive substrate to be used in the electrophotographic photoreceptor of the present invention include metal such as aluminum, nickel, chromium and stainless steel, plastic film having a thin film made of aluminum, titanium, nickel, chromium, stainless steel, gold, vanadium, tin oxide, indium oxide and ITO provided thereon, and paper or plastic film coated or impregnated with an electrical conductivity donative agent. Such an electrically-conductive substrate may be used in a proper form such as drum, sheet and plate, but the present invention is not limited thereto. The surface of the electrically-conductive substrate may be optionally subjected to various treatments so far as the image quality is not impaired. For example, the surface of the electrically-conductive substrate may be subjected to oxidation, chemical treatment, coloring or treatment for providing irregular reflection such as graining.

A subbing layer may be provided interposed between the electrically-conductive substrate and the photosensitive layer. The subbing layer prevents electrical charge from being injected into the photosensitive layer from the electrically-conductive substrate during charging of a laminated photosensitive layer. At the same time, the subbing layer acts as an adhesive layer for integrally gluing the photosensitive layer to the electrically-conductive substrate. In some cases, the subbing layer inhibits the reflection of light by the electrically-conductive substrate.

As the binder resin to be incorporated in the subbing layer there may be used a known material such as polyethylene resin, polypropylene resin, acrylic resin, methacrylic resin, polyamide resin, vinyl chloride resin, vinyl acetate resin, phenolic resin, polycarbonate resin, polyurethane resin, polyimide resin, vinylidene chloride resin, polyvinyl acetal resin, vinyl chloride-vinyl acetate copolymer, polyvinyl alcohol resin, water-soluble polyester resin, nitrocellulose, casein, gelatin, polyglutamic acid, starch, starch acetate, aminostarch, polyacrylic acid, polyacrylamide, zirconium chelate compound, titanyl chelate compound, titanyl alkoxide compound, organic titanyl compound and silane coupling agent incorporated therein. These materials may be used singly or in combination. These materials may be used in admixture with a particulate material made of titanium oxide, silicon oxide, zirconium oxide, barium titanate, silicone resin or the like.

The thickness of the subbing layer is normally from 0.01 to 10 $\mu$m, preferably from 0.05 to 2 $\mu$m. The application of the subbing layer coating solution can be accomplished by an ordinary method such as blade coating, wire bar coating, spray coating, dip coating, bead coating, air knife coating and curtain coating.

The electric charge-generating layer of the laminated photoreceptor of the present invention comprises at least an electric charge-generating material and a binder resin incorporated therein. Examples of the electric charge-generating material employable herein include inorganic photoconductive materials such as amorphous selenium, crystalline selenium-tellurium alloy, selenium-arsenic alloy, other selenium compounds and selenium alloys, zinc oxide and titanium oxide, and organic pigments or dyes such as phthalocyanine, squarilium, anthanthron, perylene, azo, anthraquinone, pyrene, pyrylium salt and thipyrylium salt.

Preferred among these electric charge-generating materials is phthalocyanine compound. Preferred examples of such a phthalocyanine compound include metal-free phthalocyanine, titanyl phthalocyanine, chlorogallium phthalocyanine, and hydroxygallium phthalocyanine.

Examples of the binder resin to be incorporated in the electric charge-generating layer employable herein include polyvinyl butyral resin, polyvinyl formal resin, partially-modified polyvinyl acetal resin, polycarbonate resin, polyester resin, acrylic resin, polyvinyl chloride resin, polystyrene resin, polyvinyl acetate resin, vinyl chloride-vinyl acetate copolymer, silicone resin, phenolic resin, and poly-N-vinylcarbazole resin. The present invention is not limited to these binder resins. These binder resins may be used singly or in admixture.

The mixing ratio (by weight) of electric charge-generating layer and binder resin is preferably from 10:1 to 1:10. The thickness of the electric charge-generating layer to be used herein is normally from 0.1 to 5 $\mu$m, preferably from 0.2 to 2.0 $\mu$m.

The application of the electric charge-generating layer coating solution can be accomplished by an ordinary method such as blade coating method, wire bar coating method, spray coating method, dip coating method, bead coating method, air knife coating method and curtain coating method.

As the solvent to be used in the formation of the electric charge-generating layer there may be used an ordinary organic solvent such as methanol, ethanol, n-propanol, n-butanol, benzyl alcohol, methyl cellosolve, ethyl cellosolve, acetone, methyl ethyl ketone, cyclohexanone, methyl acetate, n-butyl acetate, dioxane, tetrahydrofuran, methylene chloride and chloroform. These solvents may be used singly or in admixture.

The electric charge-transporting layer of the laminated photoreceptor of the present invention comprises at least an electric charge-transporting material and a binder resin incorporated therein. Examples of the electric charge-transporting material employable herein include quinone compounds such as p-benzoquinone, chloranil, bromoanil and anthraquinone, fluorenone compounds such as tetracyanoquinodimethane compound and 2,4,7-trinitrofluorenone, electron attractive substances such as xanthone compound, benzophenone compound, cyanovinyl compound and ethylene compound, triarylamine compounds, benzidine compounds, arylalkane compounds, aryl-substituted ethylene compounds, stilbene compounds, anthracene compounds, and hydrazone compounds. These electric charge-transporting materials may be used singly or in admixture.

As the binder resin to be incorporated in the electric charge-transporting layer there may be used a known resin such as polycarbonate resin, polyester resin, methacrylic resin, acrylic resin, vinyl chloride resin, vinylidene chloride resin, polystyrene resin, polyvinyl acetate resin, styrene-butadiene copolymer, vinylidene chloride-acrylonitrile copolymer, vinyl chloride-vinyl acetate copolymer, vinyl chloride-vinyl acetate-maleic anhydride copolymer, silicone resin, silicone-alkyd resin, phenol-formaldehyde resin, styrene-acryl resin, styrene-alkyd resin, poly-N-vinylcarbazole and polysilane.

Further, the electric charge-transporting layer may comprise the oxidation inhibitor described with reference to the surface protective layer incorporated therein. Since the electric charge-transporting layer is not the outermost layer, it is not brought into direct contact with an oxidizing gas. However, such an oxidizing gas can penetrate the surface protective layer to reach the electric charge-transporting layer. In order to prevent the attack by such an oxidizing gas, the electric charge-transporting layer may comprise an oxidation inhibitor incorporated therein. Specific examples of such an oxidation inhibitor include those described above. The amount of such an oxidation inhibitor to be added is preferably from 0.01 to 30% by weight, more preferably from 0.1 to 10% by weight based on the weight of the solid content in the material constituting the electric charge-transporting layer.

As the solvent for forming the electric charge-transporting layer there may be used an ordinary organic solvent such as aromatic hydrocarbons (e.g., benzene, toluene, xylene, chlorobenzene), ketones (e.g., acetone, 2-butanone), halogenated aliphatic hydrocarbons (e.g., methylene chloride, chloroform, ethylene chloride) and cyclic or straight-chain ethers (e.g., tetrahydrofuran, ethyl ether, dioxane). These organic solvents may be used singly or in admixture.

The application of the coating solution of electric charge-transporting layer can be accomplished by the same process as for the electric charge-generating layer. The thickness of the electric charge-transporting layer is from 5 to 50 $\mu$m, preferably from 10 to 40 $\mu$m.

If the electrophotographic photoreceptor of the present invention is of single photosensitive layer type, the photosensitive layer is formed by the electric charge-generating materials and binder resins mentioned above. As the binder resin there may be used the same binder resin as incorporated in the foregoing electric charge-generating layer and electric charge-transporting layer. The content of the electric charge-generating material in the single photosensitive layer is from 10 to 85% by weight, preferably from 20 to 50% by weight.

The single photosensitive layer may comprise an oxidation inhibitor incorporated therein for the same reason as used in the electric charge-transporting layer as necessary. The amount of the oxidation inhibitor to be added is from 0.01 to 30% by weight, preferably from 0.1 to 10% by weight based on the solid content in the material constituting the photosensitive layer.

When applied to an image forming method using a non-contact charging process such as corona charging, the electrophotographic photoreceptor of the present invention exhibits excellent photoelectric properties and durability, particularly high ozone resistance and high nitrogen oxide resistance. If used in a contact charging process image forming apparatus employing a charging roll or the like as a charging means, the electrophotographic photoreceptor of the present invention can exhibit an excellent durability against remarkable abrasion which would occur during contact charging.

The electrically-conductive member for effecting contact charging may be in any form such as brush, blade, pin electrode and roller, particularly roller. The roller-shaped member normally comprises a resistive layer as the outermost layer, an elastic layer supporting the resistive layer, and a core material. A protective layer may be provided on the resistive layer as necessary.

The core material is electrically-conductive and normally comprises iron, copper, brass, stainless steel, aluminum, nickel or the like. Alternatively, a molded resin product having other particulate electrically-conductive materials dispersed therein may be used.

The material of the elastic layer is electrically-conductive or semiconductive. In general, a rubber material having a particulate electrically-conductive or semiconductive material dispersed therein may be used.

Examples of the rubber material employable herein include EPDM, polybutadiene, natural rubber, polyisobutylene, SBR, CR, NBR, silicone rubber, urethane rubber, epichlorohydrin rubber, SBS, thermoplastic elastomer, norbornene rubber, fluorosilicone rubber, and ethylene oxide rubber.

Examples of the material constituting the particulate electrically-conductive or semiconductive material include metal such as carbon black, zinc, aluminum, copper, iron, nickel, chromium and titanium, and metal oxide such as $ZnO—Al_2O_3$, $SnO_2—Sb_2O_3$, $In_2O_3—SnO_2$, $ZnO—TiO_2$, $MgO—Al_2O_3$, $FeO—TiO_2$, $TiO_2$, $SnO_2$, $Sb_2O_3$, $In_2O_3$, ZnO and MgO. These materials may be used singly or in admixture. If two or more of these materials are used in admixture, one of them may be particulate. As the particulate material there may be used a particulate fluororesin.

The material constituting the resistive layer and protective layer has a particulate electrically-conductive or semiconductive material dispersed in a binder to exhibit a properly-controlled resistivity. The resistivity of the resistive layer and protective layer is from $10^3$ to $10^{14}$ Ω·cm, preferably from $10^5$ to $10^{12}$ Ω·cm, more preferably from $10^7$ to $10^{12}$ Ω·cm.

The thickness of the resistive layer and protective layer is from 0.01 to 1,000 $\mu$m, preferably from 0.1 to 500 $\mu$m, more preferably from 0.5 to 100 $\mu$m.

Examples of the binder resin employable herein include acrylic resin, cellulose resin, polyamide resin, methoxymethylated nylon, ethoxymethylated nylon, polyurethane resin, polycarbonate resin, polyester resin, polyethylene resin, vinyl chloride resin, polyarylate resin, polythiophene resin, polyolefin resin such as PFA, PEP and PET, and styrene-butadiene resin. As the particulate electrically-conductive or semiconductive material there may be used the same carbon black, metal or metal oxide as used in the elastic layer.

The foregoing material may comprise an oxidation inhibitor such as hindered phenol and hindered amine, a filler such as clay and kaolin and a lubricant such as silicone oil incorporated therein as necessary.

The formation of these layers can be accomplished by an ordinary method such as blade coating method, wire bar coating method, spray coating method, dip coating method, bead coating method, air knife coating method, curtain coating method, vacuum metallizing and plasma coating method.

In order to charge the electrophotographic photoreceptor using these electrically-conductive members, a voltage is applied to these electrically-conductive members. The voltage to be applied is preferably d.c. voltage having a.c. voltage superimposed thereon. The superimposition of a.c. voltage on d.c. voltage makes it possible to uniformly charge the photoreceptor.

Referring to the range of voltage to be applied to the charging machine, d.c. voltage preferably ranges from + or −50 to 2,000 V, particularly from + or −100 to 1,500 V. The a.c. voltage to be superimposed on d.c. voltage ranges from 400 to 1,800 V, preferably from 800 to 1,600 V, more preferably 1,200 to 1,600 V. The frequency of a.c. voltage is from 50 to 20,000 Hz, preferably from 100 to 2,000 Hz.

The present invention will be described in greater detail with reference to the following examples, but the invention should not be construed as being limited thereto. All "parts" are by weight unless otherwise indicated.

EXAMPLE 1-1

A solution of 10 parts of a zirconium compound (orgatix ZC540, available from Matsumoto Chemical Industry Co., Ltd.), 1 part of a silane compound (A1110, available from Nippon Unicar Co., Ltd.), 40 parts of isopropanol and 20 parts of butanol was applied to an aluminum pipe by a dip coating method, and then heated and dried at a temperature of 150° C. for 10 minutes to form a subbing layer having a thickness of 0.1 μm thereon.

Subsequently, 1 part of X type metal-free phthalocyanine crystal and 1 part of a polyvinyl butyral (S-LEC, available from Sekisui Chemical Co., Ltd.) were mixed with 100 parts of cyclohexanone. The mixture was subjected to dispersion with glass beads in a sandmill for 1 hour, dip-coated onto the foregoing subbing layer, and then heated to a temperature of 100° C. for 10 minutes to form an electric charge-generating layer having a thickness of about 0.15 μm.

Subsequently, a coating solution obtained by dissolving 2 parts of a benzidine compound shown as Exemplary Compound (No. 27) in Table 1-9 and 3 parts of a polymer (viscosity-average molecular weight: 39,000) comprising a repeating structural unit represented by the following structural formula (1-E) in 20 parts of chlorobenzene was applied to the foregoing electric charge-generating layer by a dip coating method, and then heated to a temperature of 110° C. for 40 minutes to form an electric charge-transporting layer having a thickness of 20 μm thereon.

(1-E)

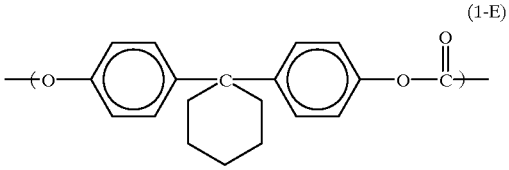

Subsequently, a solution obtained by dissolving 3 parts of Exemplary Compound (A-1) shown in Table 1-1 as an electric charge-transporting material containing hydroxyl group and 2 parts of a burette-modified polyisocyanate represented by the following general formula (1-F) as an isocyanate group-containing compound (molar ratio of electric charge-transporting material to isocyanate group-containing compound: about 3:2) in 10 parts of cyclohexanone was spray-coated onto the foregoing electric charge-transporting layer, dried at ordinary temperature for 10 minutes, and then heated to a temperature of 130° C. for 60 minutes to form a surface protective layer having a thickness of 5 μm thereon. Thus, an electrophotographic photoreceptor was prepared.

(1-F)

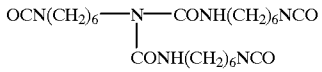

The electrophotographic photoreceptor thus obtained was then mounted in a remodelled version of Type. XP-11 image forming apparatus available from Fuji Xerox Co., Ltd. Under these conditions, the following experiment was carried out. The remodelled version of Type XP-11 image forming apparatus is an electrophotographic printer comprising a contact charging machine made of charging roll, a laser exposure optical system, a developing machine, a scorotron for transferring an image, LED for destaticization, a cleaning blade and a fixing roll as shown in FIG. 1.

Using the foregoing image forming apparatus, the image quality was evaluated at the initial stage of the experiment and after continuous printing of 50,000 sheets. Further, the thickness of the photoreceptor was measured before and after the test. The thickness loss was defined as abrasion. The charging was carried out by applying a charging voltage comprising a d.c. voltage of −550 V with an a.c. voltage of 1.5 $kV_{pp}$ (800 Hz) superimposed thereon to the charging roll.

COMPARATIVE EXAMPLE 1-1

The procedure of Example 1-1 was followed except that the thickness of the electric charge-transporting layer was 25 μm and no surface protective layer was provided. Thus, an electrophotographic photoreceptor was prepared.

COMPARATIVE EXAMPLE 1-2

A subbing layer, an electric charge-generating layer and an electric charge-transporting layer were formed on an aluminum pipe in sequence in the same manner as in Example 1-1. Onto the electric charge-transporting layer was then spray-coated a solution obtained by dissolving 5 parts of a styrene-methyl methacrylate-hydroxyethyl methacrylate copolymer (Retan 4000, available from Kansai Paint Co., Ltd.) and 1 part of an isocyanate compound represented by the foregoing general formula (1-F) in 15 parts of xylene. The coated material was then heated to a temperature of 130° C. for 1 hour to form a 5-μm thick surface protective layer having a network structure, though free of electric charge-generating layer. Thus, an electrophotographic photoreceptor was prepared.

COMPARATIVE EXAMPLE 1-3

The procedure of Example 1-1 was followed except that 4,4-diphenylmethane diisocyanate was used instead of the compound represented by the general formula (1-F) as an isocyanate compound. Thus, an electrophotographic photoreceptor was prepared.

EXAMPLES 1-2 to 1-5

The procedure of Example 1-1 was followed except that as the electric charge-transporting material containing hydroxyl group to be incorporated in the surface protective layer there were used those shown in Table 1-14 below, respectively. Thus, electrophotographic photoreceptors were prepared. In this procedure, the amount of the isocyanate compound to be added was adjusted such that the molar ratio of the electric charge-transporting material containing hydroxyl group to the isocyanate compound was 3:2.

TABLE 1-14

| Example No. | Hydroxyl group-containing electric charge-transporting material |
|---|---|
| 1-2 | A-10 |
| 1-3 | A-18 |
| 1-4 | A-25 |
| 1-5 | A-36 |

The electrophotographic photoreceptors obtained in Examples 1-2 to 1-5 and Comparative Examples 1-1 to 1-3 were subjected to the same experiment as effected in Example 1-1. The results are set forth in Table 1-15.

TABLE 1-15

| Photoreceptor | Image quality: Initial | Image quality: After 50,000 sheets of printing | Abrasion (μm) |
|---|---|---|---|
| Example 1-1 | Good | Good | 0.33 |
| Example 1-2 | Good | Good | 0.45 |
| Example 1-3 | Good | Good | 0.25 |
| Example 1-4 | Good | Good | 0.50 |
| Example 1-5 | Good | Good | 0.40 |
| Comparative Example 1-1 | Good | Image density drops Many image defects due to scratch | 10.2 |
| Comparative Example 1-2 | Low image density | Low image density | 0.20 |
| Comparative Example 1-3 (number of functional groups in isocyanate: 2) | Good | Many image defects due to scratch | 7.5 |

The use of the electrophotographic photoreceptors obtained in Examples 1-1 to 1-5 provides a good image quality at the initial stage of continuous printing. A good image quality was maintained even after 50,000 sheets of printing. The good image quality at the initial stage of continuous printing is attributed to the fact that the surface protective layer comprises an electric charge-transporting material incorporated therein to provide the photoreceptor with excellent photoelectric properties. This is obvious from the comparison with the photoreceptor of Comparative Example 1-2, which is free of electric charge-transporting material in the surface protective layer.

As mentioned above, when the electrophotographic photoreceptors of Examples 1-1 to 1-5 are used, a good image quality is maintained even after 50,000 sheets of printing. This is attributed to the fact that the photoreceptors used show a small abrasion and can be hardly scratched on the surface thereof. On the contrary, the electrophotographic photoreceptor of Comparative Example 1-1 shows a great abrasion that causes a change in photoelectric properties. Therefore, the surface potential of the electrophotographic photoreceptor doesn't show a sufficient drop, resulting in the drop of image density. Further, the contact with the developer or paper causes the generation of many stripe-like scratches on the electrophotographic photoreceptor, resulting in the occurrence of image defects. The electrophotographic photoreceptor of Comparative Example 1-2 comprises a surface protective layer having a three-dimensional network that reduces abrasion. However, since the surface protective layer has no capability of transporting electric charge, the electrophotographic photoreceptor exhibits poor photoelectric properties, making it impossible to obtain a sufficient image quality even at the initial stage of continuous printing. In Comparative Example 1-3, the number of functional groups in the isocyanate compound used in crosslinking is as small as 2. Therefore, the surface protective layer cannot be provided with a sufficient three-dimensional network structure and thus has a reduced mechanical strength.

EXAMPLE 1-6

A subbing layer, an electric charge-generating layer and an electric charge-transporting layer were formed on an aluminum pipe in sequence in the same manner as in Example 1-1.

Subsequently, onto the foregoing electric charge-transporting layer was spray-coated a solution obtained by dissolving 3 parts of Exemplary Compound (B-21) as an electric charge-transporting material containing hydroxyl group, 2 parts of a styrene-methyl methacrylate-hydroxyethyl methacrylate copolymer (Retan 4000, available from Kansai Paint Co., Ltd.) as a hydroxyl group-containing compound and 4 parts of a polyisocyanate represented by the foregoing general formula (1-F) as an isocyanate group-containing compound in 20 parts of a 1:2 (by weight) mixture of cyclohexanone and xylene. The coated material was dried at ordinary temperature for 10 minutes, and then heated to a temperature of 130° C. for 60 minutes to form a surface protective layer having a thickness of 5 μm. Thus, an electrophotographic photoreceptor was prepared.

EXAMPLE 1-7

A subbing layer, an electric charge-generating layer and an electric charge-transporting layer were formed on an aluminum pipe in sequence in the same manner as in Example 1-1.

Subsequently, onto the foregoing electric charge-transporting layer was spray-coated a solution obtained by dissolving 3 parts of Exemplary Compound (B-21) as an electric charge-transporting material containing hydroxyl group, 2 parts of a polyisocyanate represented by the foregoing general formula (1-F) as an isocyanate group-containing compound and 2 parts of a polymethyl methacrylate as binder resin in 20 parts of a 1:2 (by weight) mixture of cyclohexanone and xylene. The coated material was dried at ordinary temperature for 10 minutes, and then heated to a temperature of 130° C. for 60 minutes to form a surface protective layer having a thickness of 5 μm. Thus, an electrophotographic photoreceptor was prepared. The results are set forth in Table 1-16 below.

TABLE 1-16

| Photoreceptor | Image quality: Initial | Image quality: After 50,000 sheets of printing | Abrasion (μm) |
|---|---|---|---|
| Example 1-6 | Good | Good | 0.43 |
| Example 1-7 | Good | Good | 0.65 |

EXAMPLE 1-8

A subbing layer, an electric charge-generating layer and an electric charge-transporting layer were formed on an aluminum pipe in sequence in the same manner as in Example 1-1.

Subsequently, onto the foregoing electric charge-transporting layer was spray-coated a solution obtained by dissolving 3 parts of Exemplary Compound (A-1) as an electric charge-transporting material containing hydroxyl group, 1 part of Exemplary Compound (C-3) as a compound containing hydroxyl group and fluorine atom and 4.7 parts of a burette-modified polyisocyanate represented by the foregoing general formula (1-F) (solid content: about 60% by weight) as an isocyanate group-containing compound in 30 parts of cyclohexanone. The coated material was dried at ordinary temperature for 10 minutes, and then heated to a temperature of 150° C. for 60 minutes to form a surface protective layer having a thickness of 5 μm. Thus, an electrophotographic photoreceptor was prepared.

COMPARATIVE EXAMPLE 1-4

A subbing layer, an electric charge-generating layer and an electric charge-transporting layer were formed on an aluminum pipe in sequence in the same manner as in Example 1-8.

Subsequently, onto the foregoing electric charge-transporting layer was spray-coated a solution obtained by dissolving 3 parts of Exemplary Compound (A-1) as an electric charge-transporting material containing hydroxyl group, 1.5 parts of a compound obtained by replacing fluorine atom in Exemplary Compound (C-3) by hydrogen atom and 4.7 parts of the foregoing compound represented by the general formula (1-F) as an isocyanate group-containing compound in 25 parts of cyclohexanone. The coated material was dried at ordinary temperature for 10 minutes, and then heated to a temperature of 150° C. for 60 minutes to form a surface protective layer having a thickness of 5 μm. Thus, an electrophotographic photoreceptor was prepared.

The electrophotographic photoreceptors obtained in Example 1-8 and Comparative Examples 1-1 and 1-4 were then subjected to experiment with the foregoing remodelled version of XP-11 in the same manner as for the electrophotographic photoreceptor obtained in Example 1-1. As the printing paper there was used a neutral paper available from Fuji Xerox Co., Ltd. Further, in order to evaluate the surface slip properties of the photoreceptor, continuous printing was effected on 10,000 sheets of an acidic paper. In this manner, the degree of attachment of paper powder or the like to the surface of the photoreceptor was evaluated. The results are set forth in Table 1-17.

TABLE 1-17

| Photoreceptor | Initial stage | Image quality After 50,000 sheets of printing | Abrasion (μm) | Continuous printing on acidic paper |
|---|---|---|---|---|
| Example 1-8 | Good | Good | 0.40 | Good |
| Comparative Example 1-1 (free of protective layer) | Good | Image density drops Many image defects due to scratch | 10.2 | Image density drops Many image defects due to scratch |
| Comparative Example 1-4 (free of fluorine atom in protective layer) | Good | Good | 0.50 | Many image defects due to attachment of talc |

As can be seen in Table 1-17, the photoreceptor of Example 1-8 caused no troubles in the continuous printing on acidic paper. Comparative Example 1-4 showed a remarkable image defect due to the attachment of paper powder (talc). This shows that the incorporation of a compound containing hydroxyl group and fluorine atom in the surface protective layer is effective for the prevention of the deterioration of image quality due to the attachment of foreign substances to the surface of the photoreceptor.

EXAMPLES 1-9 to 1-11

The procedure of Example 1-8 was followed except that as the electric charge-transporting material containing hydroxyl group to be used in the formation of the surface protective layer there were used those set forth in Table 1-18 below, respectively. Thus, electrophotographic photoreceptors were prepared, and then used in continuous printing of 50,000 sheets.

TABLE 1-18

| Example No. | Electric charge-transporting material containing hydroxyl group |
|---|---|
| 1-9 | A-3 |
| 1-10 | A-33 |
| 1-11 | A-35 |

EXAMPLE 1-12

A subbing layer, an electric charge-generating layer and an electric charge-transporting layer were formed on an aluminum pipe in sequence in the same manner as in Example 1-1.

Subsequently, onto the foregoing electric charge-transporting layer was spray-coated a solution obtained by dissolving 2 parts of Exemplary Compound (B-19) as an electric charge-transporting material containing hydroxyl group, 1 part of Exemplary Compound (C-3) and 3 parts of the compound represented by the foregoing general formula (1-F) as an isocyanate group-containing compound in 30 parts of cyclohexanone. The coated material was dried at ordinary temperature for 10 minutes, and then heated to a temperature of 150° C. for 60 minutes to form a surface protective layer having a thickness of 5 μm. Thus, an electrophotographic photoreceptor was prepared.

EXAMPLES 1-13 to 1-14

The procedure of Example 1-12 was followed except that Exemplary Compound (B-19) was replaced by those set forth in Table 1-19 below, respectively. Thus, electrophotographic photoreceptors were prepared. These electrophotographic photoreceptors were then evaluated in the same manner as in Example 1-12.

EXAMPLES 1-15 to 1-17

The procedure of Example 1-8 was followed except that as the compound containing hydroxyl group and fluorine atom to be incorporated in the surface protective layer there were used those set forth in Table 1-19 below, respectively, instead of Exemplary Compound (C-3). Thus, electrophotographic photoreceptors were prepared. These electrophotographic photoreceptors were then evaluated in the same manner as in Example 1-8.

TABLE 1-19

| Example No. | Compound containing hydroxyl group and fluorine atom |
|---|---|
| 1-13 | B-21 |
| 1-14 | B-53 |
| 1-15 | C-4 |
| 1-16 | C-7 |
| 1-17 | C-10 |

The results of evaluation of the electrophotographic photoreceptors of Examples 1-9 to 1-17 are set forth in Table 1-20.

TABLE 1-20

| Photoreceptor | Image quality | | |
|---|---|---|---|
| | Initial | After 50,000 sheets of printing | Abrasion (μm) |
| Example 1-9 | Good | Good | 0.55 |
| Example 1-10 | Good | Good | 0.45 |
| Example 1-11 | Good | Good | 0.53 |
| Example 1-12 | Good | Good | 0.75 |
| Example 1-13 | Good | Good | 0.83 |
| Example 1-14 | Good | Good | 0.62 |
| Example 1-15 | Good | Good | 0.61 |
| Example 1-16 | Good | Good | 0.71 |
| Example 1-17 | Good | Good | 0.82 |

EXAMPLE 1-18

A subbing layer, an electric charge-generating layer and an electric charge-transporting layer were formed on an aluminum pipe in sequence in the same manner as in Example 1-1.

Subsequently, onto the foregoing electric charge-transporting layer was spray-coated a solution obtained by dissolving 1 part of Exemplary Compound (A-19) as an electric charge-transporting material containing hydroxyl group, 1 part of Exemplary Compound (D-1) as a bisphenol compound and 3 parts of the burette-modified polyisocyanate represented by the foregoing general formula (1-F) (solid content: about 67% by weight) as an isocyanate group-containing compound in 10 parts of cyclohexanone. The coated material was dried at ordinary temperature for 10 minutes, and then heated to a temperature of 150° C. for 60 minutes to form a surface protective layer having a thickness of 5 μm. Thus, an electrophotographic photoreceptor was prepared.

COMPARATIVE EXAMPLE 1-5

A subbing layer, an electric charge-generating layer and an electric charge-transporting layer were formed on an aluminum pipe in sequence in the same manner as in Example 1-18.

Subsequently, onto the foregoing electric charge-transporting layer was spray-coated a solution obtained by dissolving 3 parts of Exemplary Compound (D-1) as a bisphenol compound and 4 parts of the compound represented by the foregoing general formula (1-F) as an isocyanate group-containing compound in 15 parts of xylene. The coated material was dried at ordinary temperature for 10 minutes, and then heated to a temperature of 150° C. for 60 minutes to form a 5-μm thick surface protective layer having a three-dimensional network structure, though free of electric charge-transporting material. Thus, an electrophotographic photoreceptor was prepared.

COMPARATIVE EXAMPLE 1-6

A subbing layer, an electric charge-generating layer and an electric charge-transporting layer were formed on an aluminum pipe in sequence in the same manner as in Example 1-18.

Subsequently, onto the foregoing electric charge-transporting layer was spray-coated a solution obtained by dissolving 2 parts of Exemplary Compound (A-1) as an electric charge-transporting material containing hydroxyl group, 2 parts of Exemplary Compound (D-1) as a bisphenol compound and 3 parts of 4,4'-diphenylmethanediisocyanate having two functional groups as an isocyanate group-containing compound in 10 parts of xylene. The coated material was dried at ordinary temperature for 10 minutes, and then heated to a temperature of 150° C. for 60 minutes to form a surface protective layer having a thickness of 5 μm. Thus, an electrophotographic photoreceptor was prepared.

The electrophotographic photoreceptors obtained in Example 1-18 and Comparative Examples 1-1, 1-5 and 1-6 were then subjected to experiment with the foregoing remodelled version of XP-11 in the same manner as for the electrophotographic photoreceptor obtained in Example 1-1. The results of evaluation are set forth in Table 1-21 below.

TABLE 1-21

| Photoreceptor | Image quality | | |
|---|---|---|---|
| | Initial | After 50,000 sheets of printing | Abrasion (μm) |
| Example 1-18 | Good | Good | 0.33 |
| Comparative Example 1-1 (free of protective layer) | Good | Image density drops Many image defects due to scratch | 10.2 |
| Comparative Example 1-5 (free of electric charge-transporting material in protective layer) | Low image density | Low image density | 0.20 |
| Comparative Example 1-6 (number of functional groups in isocyanate: 2 | Good | Many image defects due to scratch | 3.8 |

The use of the electrophotographic photoreceptor obtained in Example 1-18 provides a good image quality at the initial stage of continuous printing. A good image quality was maintained even after 50,000 sheets of printing. The good image quality at the initial stage of continuous printing is attributed to the fact that the surface protective layer comprises an electric charge-transporting material incorporated therein to provide the photoreceptor with excellent photoelectric properties. This is obvious from the comparison with the photoreceptor of Comparative Example 1-5, which is free of electric charge-transporting material in the surface protective layer. As mentioned above, when the electrophotographic photoreceptor of Example 1-18 are used, a good image quality is maintained even after 50,000 sheets of printing. This is attributed to the fact that the photoreceptor used show a small abrasion and can be hardly scratched on the surface thereof. On the contrary, the electrophotographic photoreceptor of Comparative Example 1-6 has no network structure formed therein and thus shows a great abrasion. Further, many stripe-like scratches occur on the electrophotographic photoreceptor, resulting in the occurrence of image defects. This shows that the use of a binding material having three or more functional groups as a constituent of the surface protective layer is effective for the formation of a three-dimensional network structure having a high crosslink density that renders the electrophotographic photoreceptor durable against a.c. voltage applied during contact charging.

EXAMPLES 1-19 to 1-21

The procedure of Example 1-18 was followed except that as the electric charge-transporting material containing hydroxyl group to be incorporated in the surface protective layer there were used those set forth in Table 1-22 below, respectively. Thus, electrophotographic photoreceptors were prepared. These electrophotographic photoreceptors were then evaluated in the same manner as in Example 1-18.

EXAMPLE 1-22

A subbing layer, an electric charge-generating layer and an electric charge-transporting layer were formed on an aluminum pipe in sequence in the same manner as in Example 1-1.

Subsequently, onto the foregoing electric charge-transporting layer was spray-coated a solution obtained by dissolving 2 parts of Exemplary Compound (B-19) as an electric charge-transporting material containing hydroxyl group, 1 part of Exemplary Compound (D-1) as a bisphenol compound and 3 parts of the polyisocyanate represented by the foregoing general formula (1-F) as an isocyanate group-containing compound in 10 parts of a 1:2 (by weight) ratio of cyclohexanone and xylene. The coated material was dried at ordinary temperature for 10 minutes, and then heated to a temperature of 150° C. for 60 minutes to form a surface protective layer having a thickness of 5 μm. Thus, an electrophotographic photoreceptor was prepared.

EXAMPLES 1-23 to 1-24

The procedure of Example 1-22 was followed except that as the electric charge-transporting material containing hydroxyl group to be incorporated in the surface protective layer there were used those set forth in Table 1-22 below, respectively. Thus, electrophotographic photoreceptors were prepared. These electrophotographic photoreceptors were then evaluated in the same manner as in Example 1-22.

TABLE 1-22

| Example No. | Electric charge-transporting material containing hydroxyl group |
|---|---|
| 1-19 | A-3 |
| 1-20 | A-31 |
| 1-21 | A-33 |
| 1-23 | B-21 |
| 1-24 | B-53 |

EXAMPLES 1-25 to 1-26

The procedure of Example 1-18 was followed except that as the bisphenol compound to be incorporated in the surface protective layer there were used those set forth in Table 1-23 below, respectively. Thus, electrophotographic photoreceptors were prepared. These electrophotographic photoreceptors were then evaluated in the same manner as in Example 1-18.

TABLE 1-23

| Example No. | Bisphenol compound |
|---|---|
| 1-25 | C-2 |
| 1-26 | C-9 |

The results of evaluation of the electrophotographic photoreceptors obtained in Examples 1-19 to 1-26 are set forth in Table 1-24.

TABLE 1-24

| Photoreceptor | Image quality: Initial | Image quality: After 50,000 sheets of printing | Abrasion (μm) |
|---|---|---|---|
| Example 1-19 | Good | Good | 0.43 |
| Example 1-20 | Good | Good | 0.38 |
| Example 1-21 | Good | Good | 0.53 |
| Example 1-22 | Good | Good | 0.39 |
| Example 1-23 | Good | Good | 0.55 |
| Example 1-24 | Good | Good | 0.45 |
| Example 1-25 | Good | Good | 0.58 |
| Example 1-26 | Good | Good | 0.61 |

EXAMPLE 1-27

A subbing layer was formed on an aluminum pipe (outer diameter: 30 mm) in the same manner as in Example 1-1. Subsequently, 1 part of chlorogallium phthalocyanine obtained in Synthesis Example 1-1 and 1 part of a polyvinyl butyral (S-LEC BM-S, available from Sekisui Chemical Co., Ltd.) were mixed with 100 parts of n-butyl acetate. The mixture was then subjected to dispersion with glass beads in a paint shaker for 1 hour to obtain a coating solution. The coating solution thus obtained was dip-coated onto the foregoing subbing layer, and then heated and dried at a temperature of 100° C. for 10 minutes to form an electric charge-generating layer having a thickness of about 0.15 μm.

Subsequently, a coating solution obtained by dissolving 2 parts of Exemplary Compound (No. 27) set forth in Table 1-9, 1 part of Exemplary Compound (No. 28) set forth in Table 1-12 and 3 parts of a polymer comprising a repeating structural unit represented by the structural formula (1-E) (viscosity-average molecular weight: 39,000) in 12 parts of chlorobenzene was dip-coated onto the foregoing electric charge-generating layer, and then dried at a temperature of 110° C. for 40 minutes to form an electric charge-transporting layer having a thickness of 20 μm. A surface protective layer having a thickness of 5 μm was then formed on the electric charge-transporting layer in the same manner as in Example 1-1 to prepare an electrophotographic photoreceptor.

EXAMPLE 1-28

The procedure of Example 1-27 was followed except that hydroxygallium phthalocyanine obtained in Synthesis Example 1-27 was used instead of chlorogallium phthalocyanine. Thus, an electrophotographic photoreceptor was prepared.

The electrophotographic photoreceptors obtained in Examples 1-27 and 1-28 were each mounted in a remodelled version of Type Able 1321 printer available from Fuji Xerox Co., Ltd. having a printing rate of 30 sheets (A4 size, crosswise) per minute. The electrophotographic photoreceptors were then subjected to the same printing resistance test as in Example 1-1 to determine image quality and abrasion. The remodelled version of Type Able 1321 printer is an electrophotographic image forming apparatus having the same configuration as shown in FIG. 1 but free of destaticizing means. The results of evaluation are set forth in Table 1-25 below.

TABLE 1-25

| | Image quality | | |
|---|---|---|---|
| Photoreceptor | Initial | After 50,000 sheets of printing | Abrasion (μm) |
| Example 1-27 | Good | Good | 3.5 |
| Example 1-28 | Good | Good | 3.5 |

The remodelled version of Type Able 1321 printer operates at a higher speed than the foregoing remodelled version of Type XP-11 printer (speed: about 100,000 sheets per minute). Accordingly, a higher voltage was applied to the charging roll in the remodelled version of Type Able 1321 printer than in the remodelled version of Type XP-11 printer. In some detail, 1.8 kv was applied to the charging roll at 1 kHz in the remodelled version of Type Able 1321 printer. Therefore, these examples showed a great abrasion. However, the organoleptical visual evaluation of image density and definition provided extremely good results.

As mentioned above, the electrophotographic photoreceptor of the present invention comprises a surface protective layer formed in a three-dimensional network structure comprising an electric charge-transporting material. In this arrangement, the electrophotographic photoreceptor of the present invention exhibits good photoelectric properties and excellent mechanical strength such as high abrasion resistance. Further, the electrophotographic photoreceptor exhibits a high durability against a strong external stress such as application of a.c. voltage and gas produced by discharge. Accordingly, an image forming apparatus comprising the electrophotographic photoreceptor of the present invention can keep providing a good image quality even after a plurality of sheets of printing.

EXAMPLE 2-1

A solution of 10 parts of a zirconium compound (Orgnotics ZC540, manufactured by Matsumoto Seiyaku Co.) and 1 part of a silane compound (A1110, manufactured by Nippon Unicar Co., Ltd.) in 40 parts of isopropanol and 20 parts of butanol was applied onto an aluminum pipe (40 mm in outer diameter) by dip coating, and dried by heating at 150° C. for 10 minutes to form an underlayer having a thickness of 0.1 μm. Then, 1 part of x type nonmetallic phthalocyanine crystals and 1 part of a polyvinyl butyral resin (Esleck BM-S, manufactured by Sekisui Chemical Co., Ltd.) was mixed with 100 parts of cyclohexanone, and the mixture was dispersed together with glass beads in a sand mill for 1 hour to prepare a coating solution. The resulting coating solution was applied onto the above-mentioned underlayer by dip coating, and dried by heating at 100° C. for 10 minutes to form a charge generating layer having a thickness of about 0.15 μm.

Further, 2 parts of example compound (IV-27) of structural formula (2-IV) described in Table 2-7 and 3 parts of a polymer (viscosity average molecular weight: 39,000) represented by the following structural formula (a) were dissolved in 20 parts of chlorobenzene to prepare a coating solution. The resulting coating solution was applied onto the above-mentioned charge generating layer by dip coating, and dried by heating at 110° C. for 40 minutes to form a charge transporting layer having a thickness of 20 μm.

(2-a)

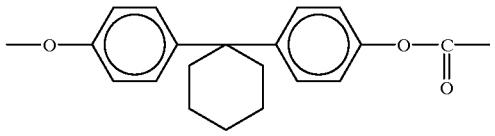

Further, 1 part of example compound (I-12) of structural formula (C) described in Table 2-1 and 2 parts of a solution of a biuret modified compound represented by the above-mentioned structural formula (2-II) (solid content: 67% by weight) were dissolved in 50 parts of cyclohexanone to prepare a coating solution. The resulting coating solution was applied onto the above-mentioned charge transporting layer by spray coating, and dried at room temperature for 10 minutes, followed by heating at 150° C. for 60 minutes to form a surface protective layer having a thickness of 4 μm. This coating solution was prepared so that the mixing ratio of the total molar number of OH groups of example compound (I-12) to the total molar number of isocyanate groups of the biuret modified compound represented by structural formula (2-II) showed about 45:55.

EXAMPLE 2-2

A conductive base material was laminated with a charge generating layer and a charge transporting layer in the same manner as with Example 2-1.

Then, 1 part of example compound (I-12) used in Example 2-1 and 2 parts of an isocyanurate modified compound represented by the above-mentioned structural formula (2-III) were dissolved in 50 parts of cyclohexanone to prepare a coating solution. The resulting coating solution was applied onto the above-mentioned charge transporting layer by spray coating, and dried at room temperature for 10 minutes, followed by heating at 150° C. for 60 minutes to form a surface protective layer having a thickness of 4 μm. This coating solution was prepared so that the mixing ratio of the total molar number of OH groups of example compound (I-12) to the total molar number of isocyanate groups of the isocyanurate modified compound represented by structural formula (2-III) showed about 45:55.

EXAMPLE 2-3

A photoreceptor was prepared in the same manner as Example 2-1, except that the drying time with heat was changed from 60 minutes to 30 minutes.

EXAMPLE 2-4

A photoreceptor was prepared in the same manner in Example 2-1, except that the mixing ratio of the coating solution was changed to have a ratio of the total molar number of OH groups to the total molar number of isocyanate groups of 65:35.

COMPARATIVE EXAMPLE 2-1

A photoreceptor was prepared in the same manner as with Example 2-1 with the exception that the thickness of the charge transporting layer was changed from 20 μm in Example 2-1 to 24 μm, and the surface protective layer was omitted.

COMPARATIVE EXAMPLE 2-2

A conductive base material was laminated with a charge generating layer and a charge transporting layer in the same manner as with Example 2-1.

Then, 2 parts of a compound represented by the following structural formula (b) in place of example compound (I-12) used in Example 2-1 and 4.5 parts of a solution of a modified polyisocyanate represented by the above-mentioned structural formula (2-II) (solid content: 67% by weight) were dissolved in 50 parts of cyclohexanone to prepare a coating solution. The resulting coating solution was applied onto the above-mentioned charge transporting layer by spray coating, and dried at room temperature for 10 minutes, followed by heating at 150° C. for 60 minutes to form a surface protective layer having a thickness of 4 μm. This coating solution was prepared so that the mixing ratio of the total molar number of OH groups of the compound represented by structural formula (b) to the total molar number of isocyanate groups of the modified polyisocyanate represented by structural formula (2-II) showed about 45:55.

(2-b)

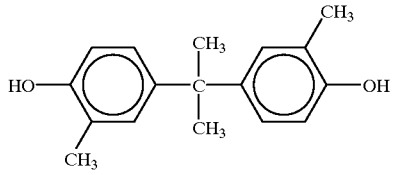

(Test Method)

The electrophotographic photoreceptors thus obtained in Examples 2-1 and 2 and Comparative Examples 2-1 and 2-2 were mounted on a modified XP-11 printer (about 11 lateral A-4 sheets per minute) manufactured by Fuji Xerox Co., Ltd., and the following test was conducted. This modified XP-11 printer is an electrophotographic printer comprising a contact charging unit using a charging roll, an exposure optical system having a semiconductor laser, a developing unit having a magnetic one-component toner, a corotron for transfer, an LED for charge elimination, a cleaning blade and a pair of fixing rolls, as shown in FIG. 1.

Using this printer, the initial image quality was evaluated, and thereafter, the continuous print test of 50,000 sheets was conducted. Then, the image quality after the test was evaluated again. Further, the amount of thickness decreased after the continuous print test of 50,000 sheets was measured to evaluate the wear resistance. Results thereof are shown in Table 2-11. In charging, the charge voltage in which the alternating current voltage (1.5 kVpp (800 Hz)) is superimposed on the direct current voltage (−550 V) was applied to the charging roll.

In addition, a part of the surface protective layer of the thus prepared photoreceptor was peeled, and measured in terms of infrared absorption spectrum in transmission mode using an FT-IR spectral photometer (1640; manufactured by Perkin Elmer). From the results, the urethane bonding content ratio was calculated using the absorbence of the infrared absorption peak at form 1720 to 1740 $cm^{-1}$ attributed to the CO stretching vibration in the urethane bonding (x), and the absorbence of the infrared absorption peak at 2973 $cm^{-1}$ attributed to the $CH_2$ stretching vibration (y). The results obtained were shown in Table 2-11 below.

TABLE 2-11

| | Initial Image Quality | A | Image Quality After Printing of 50,000 Sheets | Wear Amount (μm) |
|---|---|---|---|---|
| Example 2-1 | Good | 1.7 | Good | 0.31 |
| Example 2-2 | Good | 1.6 | Good | 0.40 |
| Example 2-3 | Good | 1.2 | Scratches occurred after 10,000 sheet printing | 2.50 |
| Example 2-4 | Good | 1.3 | Scratches occurred after 15,000 sheet printing | 1.50 |
| Comparative Example 2-1 | Good | — | The image density was slightly reduced. Image defects due to surface scratches were frequently developed. | 10.5 |
| Comparative Example 2-2 | Good | 1.7 | The image density was reduced after printing 10,000 sheets. | 0.25 |

(Evaluation)

As apparent from Table 2-11, the photoreceptors of Examples 2-1 and 2-2 were good in initial image characteristics, and maintained good image quality characteristics even after printing of 50,000 sheets. Further, the amounts of thickness decreased after the continuous print test of 50,000 sheets were as small as 0.31 μm and 0.40 μm, and visual examination of surfaces of the photoreceptors after printing f 50,000 sheets resulted in no observation of scratches. The reason why good image quality characteristics were maintained after printing of 50,000 sheets is that 3-dimensional cross-linking structures adequately formed to thereby provide wear amounts of the photoreceptors as small as 0.31 μm and 0.40 μm and the surface thereof unsusceptible to scratches. Further, it is considered that incorporation of the charge transporting materials into the crosslinked structures of the surface protective layers caused good electrophotographic characteristics of the photoreceptors and little deterioration in characteristics by continuous printing.

Because the photoreceptor of Example 2-3 was prepared in insufficient heat-drying conditions, and because the photoreceptor of Example 2-4 had insufficient formulation, three-dimensional crosslinking structures formed in these Examples were not sufficient as compared to Examples 2-1 and 2-2. Therefore, the wear amounts thereof were rather large, and strip scratches occurred on the surfaces after 10,000 or 15,000 sheet printing on account of the contact with a developer or paper. Thus, image defects were observed.

As to the photoreceptor of Comparative Example 2-1, the amount of thickness decreased after the continuous print test of 50,000 sheets was as large as 10.5 μm, so that the electrophotographic characteristics were changed to cause insufficiently decreased surface potential after printing of 50,000 sheets, resulting in a reduction in image density, although the initial image quality was good. A large number of streak-like scratches caused by contact with a developing agent or paper were observed on a surface of the photoreceptor, and appeared as image defects.

With respect to the photoreceptor of Comparative Example 2-2, the amount of thickness decreased after the continuous print test of 50,000 sheets was as small as 0.25 μm. However, the image density was decreased after printing of about 10,000 sheets, and images were scarcely obtained at the time when 50,000 sheets were printed. It is considered that this was caused by an increase in illuminated part potential (deterioration in electrophotographic characteristics) because the surface protective layer had no charge transporting property although it had the urethane bonding ratio of 1.7.

EXAMPLES 2-5 TO 2-8

Photoreceptors were prepared in the same manner as with Example 2-1 with the exception that example compound (I-1) described in Table 2-1 was used in Example 2-5, that example compound (I-7) described in Table 2-1 was used in Example 2-6, that example compound (I-7) described in Table 2-1 was used in Example 2-7, that example compound (I-10) described in Table 2-1 was used in Example 2-8, respectively, in place of example compound (I-12) described in Table 2-1 used in the surface protective layer in Example 2-1. The coating solutions were each prepared so that the mixing ratio of the total molar number of OH groups of example compound (C) to the total molar number of isocyanate groups of the biuret modified compound represented by structural formula (2-II) showed about 45:55.

The photoreceptors of Examples 2-5 to 2-8 were evaluated in the same manner as with Example 2-1, and results thereof are shown in Table 2-12. As apparent from Table 2-12, the urethane bonding ratio (A) of these photoreceptors were each in the range of from 1.6 to 1.8, the amounts of thickness decreased after the continuous print test of 50,000 sheets were as small as 0.34 μm to 0.66 μm, the initial image characteristics were good, and good image quality characteristics were maintained even after printing of 50,000 sheets.

EXAMPLE 2-9

A conductive base material was laminated with a charge generating layer and a charge transporting layer in the same manner as with Example 2-1.

Then, 1 part of example compound (I-12) used in Example 2-1, 0.5 part of 1,4-butanediol and 4 parts of an isocyanurate modified compound represented by the above-mentioned structural formula (2-III) were dissolved in 70 parts of cyclohexanone to prepare a coating solution. The resulting coating solution was applied onto the above-mentioned charge transporting layer by spray coating, and dried at room temperature for 10 minutes, followed by heating at 150° C. for 60 minutes to form a surface protective layer having a thickness of 4 μm. This coating solution was prepared so that the mixing ratio of the total molar number of OH groups of example compound (I-12) to the total molar number of isocyanate groups of the isocyanurate modified compound represented by structural formula (2-III) showed about 45:55.

The photoreceptor was evaluated in the same manner as with Example 2-1, and results thereof are shown in Table 2-12. As apparent from Table 2-12, the urethane bonding ratio (A) of this photoreceptor was 1.6, the amount of thickness decreased after the continuous print test of 50,000 sheets was as small as 0.60 μm, the initial image characteristics were good, and good image quality characteristics were maintained even after printing of 50,000 sheets.

TABLE 2-12

| | Initial Image Quality | A | Image Quality After Printing of 50,000 Sheets | Wear Amount (μm) |
|---|---|---|---|---|
| Example 2-5 | Good | 1.7 | Good | 0.34 |
| Example 2-6 | Good | 1.8 | Good | 0.42 |
| Example 2-7 | Good | 1.7 | Good | 0.55 |
| Example 2-8 | Good | 1.7 | Good | 0.65 |
| Example 2-9 | Good | 1.6 | Good | 0.60 |

EXAMPLE 2-10

An underlayer was formed on an aluminum pipe (30 mm in outer diameter) in the same manner as with Example 2-1. On the other hand, 1 part of chlorogallium phthalocyanine having a specific crystal form obtained in Synthesis Example 2-1 was mixed with 1 part of a polyvinyl butyral resin (Esleck BM-S, manufactured by Sekisui Chemical Co., Ltd.) and 100 parts of n-butyl acetate, and the resulting mixture was dispersed together with glass beads by the use of a paint shaker for 1 hour to prepare a coating solution. This coating solution was applied onto the above-mentioned underlayer by dip coating, and dried by heating at 100° C. for 10 minutes to form a charge generating layer having a thickness of about 0.15 μm.

Then, 2 parts of example compound (IV-27) of structural formula (2-IV) described in Table 2-7, 1 part of example compound (V-28) of structural formula (2-V) described Table 2-9 and 3 parts of a polymer (viscosity average molecular weight: 39,000) having repeating structure units represented by the above-mentioned structural formula (a) were dissolved in 12 parts of chlorobenzene to prepare a coating solution. This coating solution was applied onto the above-mentioned charge generating layer by dip coating, and dried by heating at 110° C. for 40 minutes to form a charge transporting layer having a thickness of 20 μm. A protective layer having a thickness of 5 μm was further formed thereon in the same manner as with Example 2-1, thereby obtaining an electro-photographic photoreceptor of Example 2-10.

EXAMPLE 2-11

An electrophotographic photoreceptor was obtained in the same manner as with Example 2-10 with the exception that hydroxygallium phthalocyanine having the specific crystal form obtained in Synthesis Example 2-2 was used in place of chlorogallium phthalocyanine.

The photoreceptors of Examples 2-10 and 2-11 were mounted on a modified Able 1321 printer manufactured by Fuji Xerox Co., Ltd.) having a printing speed (A 4, lateral) of 30 sheets per minute, and the press life test was conducted in the same manner as with Example 2-1. Results thereof are shown in Table 2-13.

The above-mentioned modified printer is an electrophotographic image forming apparatus having a structure similar to that of the printer shown in FIG. 1, but has no LED for charge elimination. The printing speed of this modified printer is 30 lateral A-4 sheets per minute, and higher than that of the modified XP-11 printer (about 11 A-4 lateral sheets per minute). Accordingly, the voltage applied to the charging roll was increased to 1.8 kVpp (1 kHz), so that the wear amount after printing of 50,000 sheets was increased. However, both the image density ad the resolution had no problem at all in the visual functional evaluation.

TABLE 2-13

| | Initial Image Quality | A | Image Quality After Printing of 50,000 Sheets | Wear Amount (μm) |
|---|---|---|---|---|
| Example 2-10 | Good | 1.7 | Good | 3.50 |
| Example 2-11 | Good | 1.7 | Good | 3.50 |

In the present invention, the charge transporting materials are incorporated into the three-dimensional crosslinked structures of the surface protective layers of the electrophotographic photoreceptors by employing the above-mentioned constitution. The electrophotographic photoreceptors can be therefore provided which have good electrophotographic characteristics, excellent wear resistance and high durability to the external stress such as the application of the alternating current voltage or the gases generated by discharge. According to the image forming apparatuses using these photoreceptors, it has become possible to maintain good image quality even after printing of a large number of sheets.

EXAMPLE 3-1

A solution of 10 parts of a zirconium compound (Orgnotics ZC540, manufactured by Matsumoto Seiyaku Co.) and 1 part of a silane compound (A1110, manufactured by Nippon Unicar Co., Ltd.) in 40 parts of isopropanol and 20 parts of butanol was applied onto an aluminum pipe (40 mm in outer diameter) by dip coating, and dried by heating at 150° C. for 10 minutes to form an underlayer having a thickness of 0.1 μm. Then, 1 part of x type nonmetallic phthalocyanine crystals and 1 part of a polyvinyl butyral resin (Esleck BM-S, manufactured by Sekisui Chemical Co., Ltd.) was mixed with 100 parts of cyclohexanone, and the mixture was dispersed together with glass beads in a sand mill for 1 hour to prepare a dispersion. The resulting dispersion was applied onto the above-mentioned underlayer by dip coating, and dried by heating at 100° C. for 10 minutes to form a charge generating layer having a thickness of about 0.15 μm.

Then, 2 parts of example compound (IV-27) of structural formula (3-IV) described in Table 3-8 and 3 parts of a polymer (viscosity average molecular weight: 39,000) having repeating units represented by the following structural formula (3-a) were dissolved in 20 parts of chlorobenzene to prepare a coating solution. The resulting coating solution was applied onto the above-mentioned charge generating layer by dip coating, and dried by heating at 110° C. for 40 minutes to form a charge transporting layer having a thickness of 20 μm.

(3-a)

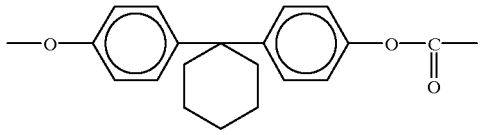

Then, 3 parts of example compound (I'-1) of structural formula (D) described in Table 3-5 and 4 parts of a solution of a modified polyisocyanate of biuret represented by the above-mentioned structural formula (3-II) (solid content: 67% by weight) were dissolved in 50 parts of cyclohexanone to prepare a coating solution. The resulting coating solution was applied onto the above-mentioned charge transporting layer by spray coating, and dried at room temperature for 10 minutes, followed by heating at 150° C. for 60 minutes to form a surface protective layer having a thickness of 4 μm. The mixing ratio of the total molar number of OH groups of example compound (I'-1) to the total molar number of isocyanate groups of the compound represented by structural formula (3-II) in the coating solution used herein was about 45:55.

COMPARATIVE EXAMPLE 3-1

A photoreceptor was prepared in the same manner as with Example 3-1 with the exception that the thickness of the charge transporting layer was changed to 24 μm, and the surface protective layer was omitted.

COMPARATIVE EXAMPLE 3-2

A conductive base material was laminated with a charge generating layer and a charge transporting layer in the same manner as with Example 3-1. Then, 2 parts of a compound represented by the following structural formula (3-b) in place of example compound (I'-1) described in Table 3-5 and 4.5 parts of a solution of the hexamethylene diisocyanate-modified compound of biuret represented by the above-mentioned structural formula (3-II) (solid content: 67% by weight) were dissolved in 50 parts of cyclohexanone to prepare a coating solution. The resulting coating solution was applied onto the above-mentioned charge transporting layer by spray coating, and dried at room temperature for 10 minutes, followed by heating at 150° C. for 60 minutes to form a surface protective layer having a thickness of 4 μm. The mixing ratio of the total molar number of OH groups of the compound represented by structural formula (3-b) to the total molar number of isocyanate groups of the compound represented by structural formula (3-II) in the coating solution used herein was about 45:55.

(3-b)

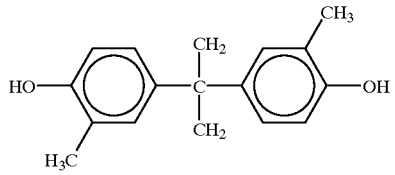

(Evaluation)

The electrophotographic photoreceptors thus obtained in Example 3-1 and Comparative Examples 3-1 and 3-2 were mounted on a modified XP-11 printer manufactured by Fuji Xerox Co., Ltd., and the following test was conducted. This modified XP-11 printer is an electrophotographic printer comprising a contact charging unit 3 using a charging roll, an exposure optical system 4 having a semiconductor laser, a developing unit 5 having a magnetic one-component toner, a corotron 6 for transfer, an LED 10 for charge elimination, a cleaning blade 7 and a pair of fixing rolls 9, as shown in FIG. 1.

Using this printer, the initial image quality was evaluated, and thereafter, the continuous print test of 50,000 sheets was conducted. Then, the image quality after the test was evaluated again. Further, the amount of thickness decreased after the continuous print test of 50,000 sheets was measured to evaluate the wear resistance. Results thereof are shown in Table 3-11. In charging, the charge voltage in which the alternating current voltage (1.5 kVpp (800 Hz)) is superimposed on the direct current voltage (−550 V) was applied to the charging roll.

Results of the evaluation are shown Table 3-12. When the photoreceptor of Example 3-1 was used, the initial image characteristics were good, and the good image quality characteristics were maintained even after printing of 50,000 sheets. The reason why good image quality characteristics were maintained after printing of 50,000 sheets is considered to be that the wear amount of the photoreceptor was small, that scratches were difficult to be developed on the surface, and further that incorporation of the charge transporting material into the crosslinked structure of the surface protective layer caused good electrophotographic characteristics of the photoreceptor and little deterioration in characteristics by continuous printing.

On the other hand, in Comparative Example 3-1, the wear amount of the photoreceptor was large, so that the electrophotographic characteristics were changed to cause insufficiently decreased surface potential, resulting in a reduction in image density. Further, a large number of streak-like scratches caused by contact with a developing agent or paper were observed on a surface of the photoreceptor, and appeared as image defects.

In Comparative Example 3-2, the wear amount of the photoreceptor was small. However, the image density was decreased after printing of about 10,000 sheets, and images were scarcely obtained at the time when 50,000 sheets were printed. This was caused by an increase in illuminated part potential (deterioration in electrophotographic characteristics) because the surface protective layer had no charge transporting property.

TABLE 3-12

| | Initial Image Quality | Image Quality After Printing of 50,000 Sheets | Amount of Thickness Decreased (μm) |
|---|---|---|---|
| Example 3-1 | Good | Good | 0.31 |
| Comparative Example 3-1 | Good | The image density was slightly reduced. Image defects due to surface scratches were frequently developed. | 10.5 |
| Comparative Example 3-2 | Good | The image density was reduced after printing 10,000 sheets. | 0.25 |

EXAMPLES 3-2 TO 3-5

Photoreceptors of Examples 3-2 to 3-5 were prepared and evaluated in the same manner as with Example 3-1 with the exception that example compounds (I'-8), (I'-9), (I'-10) and (I'-11) of structural formula (D) described in Table 3-5 were each used in place of example compound (I'-1) of structural formula (D) used in the surface protective layer in Example 3-1. The coating solutions were each prepared so that the mixing ratio of the total molar number of OH groups to the total molar number of isocyanate groups also showed about 45:55, similarly to Example 3-1.

EXAMPLE 3-6

A conductive base material was laminated with a charge generating layer and a charge transporting layer in the same manner as with Example 3-1. Then, 3 part of example compound (I'-9) of structural formula (D) described in Table 3-5, 0.5 part of 1,4-butanediol and 3.5 parts of a hexamethylene diisocyanate-modified compound of biuret represented by the above-mentioned structural formula (3-II) (solid content: 67% by weight) were dissolved in 50 parts of cyclohexanone to prepare a coating solution. The resulting coating solution was applied onto the above-mentioned charge transporting layer by spray coating, and dried at room temperature for 10 minutes, followed by heating at 150° C. for 60 minutes to form a surface protective layer having a thickness of 4 μm. The mixing ratio of the total molar number of OH groups of example compound (I'-9) to the total molar number of isocyanate groups of the compound represented by structural formula (3-II) in the coating solution used herein was about 45:55, similarly to Example 3-1.

EXAMPLE 3-7

A conductive base material was laminated with a charge generating layer and a charge transporting layer in the same manner as with Example 3-1. Then, 2 part of example compound (I'-9) of structural formula (D) described in Table 3-5 and 3 parts of hexamethylene diisocyanate-modified compound of an isocyanurate represented by the above-mentioned structural formula (3-III) were dissolved in 40 parts of cyclohexanone to prepare a coating solution. The resulting coating solution was applied onto the above-mentioned charge transporting layer by spray coating, and dried at room temperature for 10 minutes, followed by heating at 150° C. for 60 minutes to form a surface protective layer having a thickness of 4 μm. The mixing ratio of the total molar number of OH groups of example compound (I'-9) to the total molar number of isocyanate groups of the compound represented by structural formula (3-III) in the coating solution used herein was about 45:55, similarly to Example 3-1.

(Evaluation)

The photoreceptors of Examples 3-2 to 3-7 were evaluated in the same manner as with Example 3-1, and results thereof are shown in Table 3-13. As apparent from Table 3-13, the photoreceptors of Examples 3-2 to 3-7 exhibited amounts of thickness decreased after printing of 50,000 sheets as small as 0.34 μm to 0.65 μm, and both the initial image characteristics and the image quality characteristics after printing of 50,000 sheets were also maintained good.

TABLE 3-13

| | Initial Image Quality | Image Quality After Printing of 50,000 Sheets | Amount of Thickness Decreased (μm) |
|---|---|---|---|
| Example 3-2 | Good | Good | 0.40 |
| Example 3-3 | Good | Good | 0.34 |
| Example 3-4 | Good | Good | 0.42 |
| Example 3-5 | Good | Good | 0.55 |
| Example 3-6 | Good | Good | 0.65 |
| Example 3-7 | Good | Good | 0.60 |

EXAMPLE 3-8

An underlayer was formed on an aluminum pipe (30 mm in outer diameter) in the same manner as with Example 3-1.

On the other hand, 1 part of chlorogallium phthalocyanine having a specific crystal form obtained in Synthesis Example 3-1 was mixed with 1 part of a polyvinyl butyral resin (Esleck BM-S, manufactured by Sekisui Chemical Co., Ltd.) and 100 parts of n-butyl acetate, and the resulting mixture was dispersed together with glass beads by the use of a paint shaker for 1 hour to prepare a coating solution. This coating solution was applied onto the above-mentioned underlayer by dip coating, and dried by heating at 100° C. for 10 minutes to form a charge generating layer having a thickness of 0.15 μm.

Then, 2 parts of example compound (IV-27) of structural formula (3-IV) described in Table 3-8, 1 part of example compound (V-28) of structural formula (3-V) described Table 3-10 and 3 parts of a polymer (viscosity average molecular weight: 39,000) having repeating structure units represented by the above-mentioned structural formula (3-a) were dissolved in 12 parts of chlorobenzene to prepare a coating solution. This coating solution was applied onto the above-mentioned charge generating layer by dip coating, and dried by heating at 110° C. for 40 minutes to form a charge transporting layer having a thickness of 20 μm. A protective layer having a thickness of 5 μm was further formed thereon in the same manner as with Example 3-1, thereby obtaining an electrophotographic photoreceptor of Example 3-8.

EXAMPLE 3-9

An electrophotographic photoreceptor was obtained in the same manner as with Example 3-8 with the exception that hydroxygallium phthalocyanine having the specific crystal form obtained in Synthesis Example 3-2 was used in place of chlorogallium phthalocyanine.

(Evaluation)

The photoreceptors of Examples 3-8 and 3-9 were mounted on a modified Able 1321 printer manufactured by Fuji Xerox Co., Ltd.) having a printing speed (A 4, lateral) of 30 sheets per minute, and the press life test was conducted in the same manner as with Example 3-1. Results thereof are shown in Table 3-14.

The above-mentioned modified printer is an electrophotographic image forming apparatus having a structure similar to that of the printer shown in FIG. 1, but has no LED for charge elimination. The printing speed of this modified printer is 30 lateral A-4 sheets per minute, and higher than that of the modified XP-11 printer (about 11 A-4 lateral sheets per minute). Accordingly, the voltage applied to the charging roll was increased to 1.8 kVpp (1 kHz), so that the wear amount after printing of 50,000 sheets was increased. However, both the image density ad the resolution had no problem at all in the visual functional evaluation.

TABLE 3-14

| | Initial Image Quality | Image Quality After Printing of 50,000 Sheets | Amount of Thickness Decreased (μm) |
|---|---|---|---|
| Example 3-8 | Good | Good | 3.5 |
| Example 3-9 | Good | Good | 3.5 |

According to the present invention, the three-dimensional crosslinked structures containing the charge transporting materials in the bonds of the surface protective layers of the electrophotographic photoreceptors can be formed by employing the above-mentioned constitution. The electrophotographic photoreceptors have therefore good electrophotographic characteristics, excellent wear resistance and high durability to the external stress such as the application of the alternating current voltage and the gases generated by discharge, and it has become possible to maintain good image quality even after printing of a large number of sheets.

EXAMPLE 4-1

A coating solution comprising 10 parts of a zirconium compound (Orgatix ZC540, available from Matsumoto Chemical Industry Co., Ltd.), 1 part of a silane compound (A1110, available from Nippon Unicar Co., Ltd.), 40 parts of i-propanol and 20 parts of butanol was prepared, applied to an aluminum substrate by a dip coating method, and then heated and dried at a temperature of 150° C. for 10 minutes to form a subbing layer having a thickness of 0.1 μm.

1 part of X type metal-free phthalocyanine crystal and 1 part of a polyvinyl butyral (S-LEC BM-S, available from Sekisui Chemical Co., Ltd.) were mixed with 100 parts of cyclohexanone. The mixture was subjected to dispersion with glass beads in a sandmill for 1 hour, dip-coated onto the foregoing subbing layer, and then heated to a temperature of 100° C. for 10 minutes to form an electric charge-generating layer having a thickness of about 0.15 μm.

2 parts of a benzidine compound represented by the following structural formula (4-a) and 3 parts of a polymer (viscosity-average molecular weight: 39,000) represented by the following structural formula (4-b) in 20 parts of chlorobenzene to prepare a coating solution. The coating solution thus prepared was applied to the foregoing electric charge-generating layer by a dip coating method, and then heated to a temperature of 115° C. for 60 minutes to form an electric charge-transporting layer having a thickness of 20 μm thereon.

(4-a)

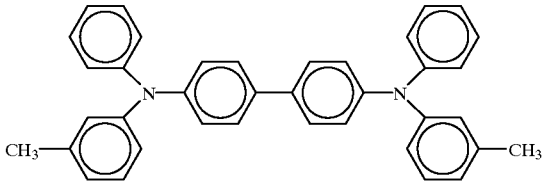

(4-b)

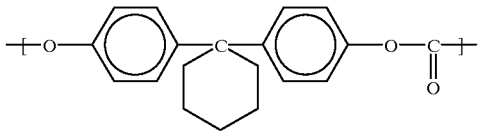

3 parts of Exemplary Compound (A-1) shown in Table 4-1 and 4 parts of a solution of a burette-modified polyisocyanate (solid content: 67% by weight) represented by the foregoing structural formula (4-D) as an electric charge-transporting material containing hydroxyl group and 0.3 parts of Exemplary Compound (F-4) shown in Table 4-8 as a compound having a hindered phenol structure were dissolved in 15 parts of cyclohexanone to prepare a coating solution. The coating solution thus prepared was spray-coated onto the foregoing electric charge-transporting layer, dried at ordinary temperature for 10 minutes, and then heated to a temperature of 150° C. for 60 minutes to form a surface protective layer having a thickness of 4 μm thereon. Thus, a photoreceptor was obtained.

COMPARATIVE EXAMPLE 4-1

The procedure of Example 4-1 was followed except that the thickness of the electric charge-transporting layer was as great as 25 μm and no surface protective layer was provided. Thus, a photoreceptor was obtained.

COMPARATIVE EXAMPLE 4-2

A subbing layer, an electric charge-generating layer and an electric charge-transporting layer were formed on an aluminum substrate in the same manner as in Example 4-1. A coating solution was prepared by dissolving 3 parts of a bisphenol compound (H-1) shown in Table 4-7 instead of Exemplary Compound (A-1) used in Example 4-1 and 9 parts of the solution of a burette-modified polyisocyanate (solid content: 67% by weight) represented by the foregoing structural formula (4-D) in 25 parts of cyclohexanone. The coating solution thus prepared was spray-coated onto the foregoing electric charge-transporting layer, dried at ordinary temperature for 10 minutes, and then heated to a temperature of 150° C. for 60 minutes to form a surface protective layer having a thickness of 4 μm. Thus, a photoreceptor was obtained. The surface protective layer thus obtained had a three-dimensional crosslinked structure but was free of electric charge-transporting material.

COMPARATIVE EXAMPLE 4-3

A subbing layer, an electric charge-generating layer and an electric charge-transporting layer were formed on an aluminum substrate in the same manner as in Example 4-1. A coating solution was prepared by dissolving 3 parts of Exemplary Compound (A-1) as an electric charge-transporting material containing hydroxyl group and 2 parts of 4,4'-diphenylmethanediisocyanate having two functional groups as a compound having isocyanate group in 10 parts of cyclohexanone. The coating solution thus prepared was spray-coated onto the foregoing electric charge-transporting layer, dried at ordinary temperature for 10 minutes, and then heated to a temperature of 150° C. for 60 minutes to form a surface protective layer having a thickness of 4 μm. Thus, a photoreceptor was obtained.

COMPARATIVE EXAMPLE 4-4

The procedure of Example 4-1 was followed except that the surface protective layer was formed free of Exemplary Compound (F-4). Thus, an electrophotographic photoreceptor was obtained.

(Evaluation)

The electrophotographic photoreceptor obtained in Example 4-1 and Comparative Examples 4-1 to 4-4 were each then mounted in a testing apparatus (remodelled version of Type XP-11 image forming apparatus available from Fuji Xerox Co., Ltd.). Under these conditions, the following experiment was carried out. The results are set forth in Table 4-13. This testing apparatus is an electrophotographic printer comprising a contact charging machine made of charging roll, a laser exposure optical system, a developing machine using a magnetic unitary toner, a scorotron for transferring an image, destaticizing LED, a cleaning blade and a fixing roll as shown in FIG. 1.

Using this apparatus, duplicated images were prepared. The occurrence of image defects were visually evaluated. Subsequently, a continuous duplication test of 100,000 sheets was effected. A duplicated image was again prepared. Image defects and image density change from that of initial image were visually evaluated. Further, using an eddy current film thickness meter, the thickness of the photosensitive layer before and after continuous test were measured. The abrasion on the photoreceptor was then evaluated from the change thus determined. The charging was carried out by applying a charging voltage comprising a d.c. voltage of −550 V with an a.c. voltage of 1.5 $kV_{pp}$ (800 Hz) superimposed thereon to the charging roll.

TABLE 4-14

| | Evaluation after 100,000 sheets of duplication test | | |
|---|---|---|---|
| | Conditions of duplicated image | | Abrasion (μm) |
| Example No. | Image density change | Image defect | on photoreceptor |
| Example 4-1 | No change | None | 0.65 |
| Comparative Example 4-1 (free of protective layer) | Image density drop | Many defects due to scratch on surface of photoreceptor (ends with 50,000th sheet) | 14.5 (50,000 sheets of duplication) |
| Comparative Example 4-2 (free of electric charge-transporting material in protective layer) | Image density begins to drop at 10,000th sheet; no image at 100,000th and after | | 0.45 |
| Comparative Example 4-3 (number of functional groups in isocyanate: 2) | | Many defects due to scratch on surface of photoreceptor | 6.5 |
| Comparative Example 4-4 (free of oxidation inhibitor) | Image density begins to drop somewhat at 70,000th sheet | Blurred image | 0.58 |

The photoreceptor of Example 4-1 showed an abrasion as small as 0.65 μm after 100,000 sheets of duplication. Further, images obtained at 100,000th and subsequent sheets showed neither defects nor image changes and thus maintained the same conditions as the initial image. The maintenance of good image properties even after 100,000 sheets of printing is attributed to the fact that the surface protective layer of the present invention not only exhibits an excellent mechanical strength and a small abrasion but also can be hardly scratched on the surface thereof. Further, it is also attributed to the fact that since the surface protective layer comprises an electric charge-transporting material uniformly incorporated in a three-dimensional crosslinked structure, the resulting photoreceptor exhibits good photoelectric properties as well as less deterioration of properties after continuous printing.

In Comparative Example 4-1, the photoreceptor exhibited an abrasion as great as 14.5 μm after 50,000 sheets of printing. Thus, the photoreceptor showed a change in photoelectric properties that makes it impossible to reduce the surface potential thereof thoroughly. As a result, an image density drop was observed. Further, many stripe-like damages occurred on the surface of the photoreceptor probably due to the contact with the developer, transferring paper, etc. to cause image defects. Since the abrasion on the photoreceptor was so significant, the test ended at the 50,000th sheet.

In Comparative Example 4-2, the photoreceptor showed an abrasion as small as 0.45 μm, but the image density began to drop at about 10,000th sheet. Little or no images could be obtained at 100,000th or subsequent sheets. This is attributed to the fact that the surface protective layer is not capable of transporting electric charge, causing a rise in the potential at bright area and hence a deterioration of photoelectric properties.

In Comparative Example 4-3, the photoreceptor showed an abrasion as great as 6.5 μm after 100,000 sheet printing test. Further, many stripe-like damages occurred on the surface of the photoreceptor to cause image defects. In Comparative Example 4-3, an isocyanate compound having two functional groups was used. As a result, the crosslink density of the surface protective layer could not be raised, making it impossible to enhance thoroughly the durability against a.c. voltage applied during contact charging.

In Comparative Example 4-4, the photoreceptor showed an abrasion as small as 0.58 μm after 100,000 sheet printing test. However, the image density began to drop at about 70,000th sheet, causing frequent occurrence of blurred image.

EXAMPLES 4-2 to 4-3

The procedure of Example 4-1 was followed except that as the electric charge-transporting material containing hydroxyl group to be incorporated in the surface protective layer there were used Exemplary Compound (B-1) shown in Table 4-3 in Example 4-2 and Exemplary Compound (C-1) shown in Table 4-4 in Example 4-3. The photoreceptor thus prepared was then evaluated in the same manner as in Example 4-1.

EXAMPLE 4-4

The procedure of Example 4-1 was followed except that as the isocyanate compound to be incorporated in the surface protective layer there was used a solution of an isocyanurate-modified polyisocyanate represented by the foregoing structural formula (4-E) (solid content: 75% by weight) instead of the solution of a burette-modified polyisocyanate represented by the foregoing structural formula (4-D) (solid content: 67% by weight). The photoreceptor thus prepared was then evaluated in the same manner as in Example 4-1.

EXAMPLE 4-5

The procedure of Example 4-1 was followed except that 1 part of Exemplary Compound (A-1) and 1 part of Exemplary Compound (H-1) shown in Table 4-8 were used instead of 3 parts of Exemplary Compound (A-1). The photoreceptor thus prepared was then evaluated in the same manner as in Example 4-1.

EXAMPLE 4-6

The procedure of Example 4-5 was followed except that 2 parts of a glycol compound represented by Exemplary Compound (H-1) shown in Table 4-8 were used instead of 1 part of Exemplary Compound (H-1). The photoreceptor thus prepared was then evaluated in the same manner as in Example 4-5.

EXAMPLES 4-7 to 4-8

The procedure of Example 4-1 was followed except that as the compound having a hindered phenol structural unit or hindered amine structural unit to be incorporated in the surface protective layer there was used Exemplary Compound (F-1) shown in Table 4-3 in Example 4-7 and Exemplary Compound (G-1) shown in Table 4-10 in Example 4-8 instead of Exemplary Compound (F-4). The photoreceptor thus prepared was then evaluated in the same manner as in Example 4-1.

(Evaluation)

The photoreceptors obtained in Examples 4-2 to 4-8 were evaluated in the same manner as mentioned above. The results are set forth in Table 4-14. These photoreceptors provided a good image quality and showed an abrasion as small as 0.53 to 0.88 μm even after 100,000 sheets of printing.

TABLE 4-15

| | Evaluation after 100,000 sheets of duplication test | | |
|---|---|---|---|
| | Conditions of duplicated image | | |
| Example No. | Image density change | Image defect | Abrasion (μm) on photoreceptor |
| Example 4-2 | No change | None | 0.73 |
| Example 4-3 | No change | None | 0.58 |
| Example 4-4 | No change | None | 0.53 |
| Example 4-5 | No change | None | 0.69 |
| Example 4-6 | No chanqe | None | 0.75 |
| Example 4-7 | No change | None | 0.65 |
| Example 4-8 | No change | None | 0.88 |

As mentioned above, the electrophotographic photoreceptor of the present invention has the foregoing constitution and thus exhibits good photoelectric properties, excellent abrasion resistance and a high durability against an external stress such as application of a.c. voltage and gas produced by corona discharge. Thus, the electrophotographic photoreceptor of the present invention makes it possible to maintain good image quality even after many sheets of printing in an electrophotographic image forming method employing corona charge process or contact charge process.

While the invention has been described in detail and with reference to specific embodiments thereof, it will be apparent to one skilled in the art that various changes and modifications can be made therein without departing from the spirit and scope thereof.

What is claimed is:

1. An electrophotographic photoreceptor comprising an electrically-conductive substrate having thereon at least a photosensitive layer and a surface protective layer:

wherein the surface protective layer has a network structure formed by the reaction of hydroxyl group-containing compounds with an isocyanate group-containing compound; and wherein at least one of the hydroxyl group-containing compounds is an electric charge-transporting material containing a hydroxyl group.

2. The electrophotographic photoreceptor of claim 1, wherein the hydroxyl-group containing compound comprises at least one combination selected from: a combination of an electric charge-transporting material containing a hydroxyl group and a compound containing two or more hydroxyl groups; a combination of an electric charge-transporting material containing a hydroxyl group and a compound containing a hydroxyl group and a fluorine atom; a combination of an electric charge-transporting material containing a hydroxyl group and at least one of a glycol compound and a bisphenol compound.

3. The electrophotographic photoreceptor of claim 1, wherein the isocyanate group-containing compound has three or more functional groups, and the surface protective layer further comprises at least one compound selected from the group consisting of those having a hindered phenol structural unit and those having a hindered amine structure.

4. The electrophotographic photoreceptor of claim 1, wherein the electric charge-transporting material is represented by the following formula (A), (B), (C) or (D):

(A)

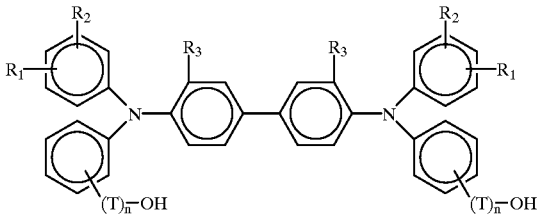

wherein $R_1$, $R_2$ and $R_3$ each represents a hydrogen atom, a halogen atom, an alkyl group, an alkoxy group or a substituted amino group; T represents a $C_{1-10}$ divalent aliphatic hydrocarbon group which may be branched; and n represents an integer of 0 or 1;

(B)

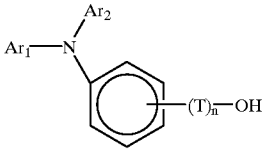

wherein $Ar_1$ and $Ar_2$ each represents a phenyl or condensed group which may be substituted by an alkyl group, a phenyl group, an alkoxy group or an alkyl-substituted phenyl group; T represents a $C_{1-10}$ divalent aliphatic hydrocarbon group which may be branched; and n represents an integer of 0 or 1;

(C)

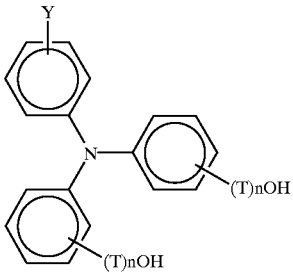

wherein Y represents a hydrogen atom, a halogen atom, an alkyl group having 1 to 5 carbon atoms which may be substituted by a halogen atom, an alkoxyl group having 1 to 5 carbon atoms, or a phenyl group which may be substituted by a halogen atom; an alkyl group having 1 to 5 carbon atoms which may be substituted by a halogen atom; or a phenyl group which may be substituted by an alkoxyl group having 1 to 5 carbon atoms; T represents a divalent aliphatic group having 1 to 10 carbon atoms which may be branched; and n represents 0 or 1;

(D)

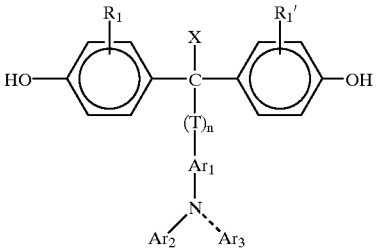

wherein $R_1$ and $R_1'$, which may be the same or different, each represents a hydrogen atom or an alkyl group having 1 to 5 carbon atoms; X represents a hydrogen atom, an alkyl group having 1 to 5 carbon atoms, or a phenyl group which may be substituted; T represents a divalent aliphatic group which may be branched; $Ar_1$, $Ar_2$ and $Ar_3$, which may be the same or different, each represents a phenyl group, a naphthyl group, or an anthracene group; and these substituent groups may each be substituted by one or more of a halogen atom, an alkyl group(s) having 1 to 5 carbon atoms and an alkoxyl group having 1 to 5 carbon atoms.

5. The electrophotographic photoreceptor of claim 4, wherein the isocyanate group-containing compound has three or more functional groups.

6. The electrophotographic photoreceptor of claim 5, wherein the network structure of the surface protective layer is formed in an inert binder resin.

7. The electrophotographic photoreceptor of claim 4, wherein the isocyanate group-containing compound has three or more functional groups, and the surface protective layer further comprises at least one compound selected from the group consisting of those having a hindered phenol structural unit and those having a hindered amine structure.

8. The electrophotographic photoreceptor of claim 7, wherein the isocyanate group-containing compound is at least one compound selected from the group consisting of adducts of polyol with an isocyanate, burette-modified products of a compound having a urea compound with an isocyanate, alophanate-modified products by the addition of isocyanate to a urethane group, isocyanurate-modified products and carboimide-modified products.

9. The electrophotographic photoreceptor of claim 4, wherein the surface protective layer comprises a three-dimensional crosslinking polymerized product of at least three of the charge-transporting materials represented by formulae (C) and (D), compounds having two or more hydroxyl groups, isocyanate compounds having three or more functional groups.

10. The electrophotographic photoreceptor of claim 9, wherein the compounds having two or more hydroxyl groups is a glycol compound or a bisphenol compound.

11. The electrophotographic photoreceptor of claim 9, wherein the isocyanate compound having three or more functional groups comprises at least one of the biuret modified product of a hexamethylene diisocyanate represented by the following structural formula (3-II) and the isocyanurate modified product of a hexamethylene diisocyanate represented by the following structural formula (3-III):

(3-II)

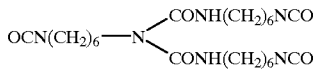

(3-III)

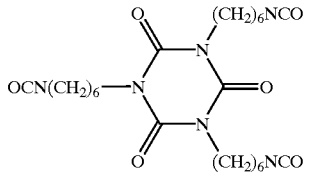

12. The electrophotographic photoreceptor of claim 1, wherein the photosensitive layer comprises a chlorogallium phthalocyanine or a hydroxygallium phthalocyanine.

13. The electrophotographic photoreceptor of claim 1, wherein the photosensitive layer comprises at least one of benzidine compounds represented by the following general formula (a) and triphenylamine compounds represented by the following general formula (b):

(a)

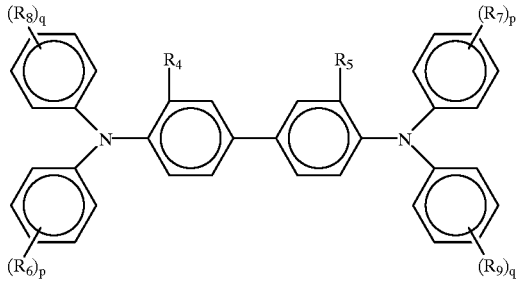

wherein $R_4$ and $R_5$ may be the same or different and each represents a hydrogen atom, a halogen atom or a $C_{1-5}$ alkyl or alkoxy group; $R_6$, $R_7$, $R_8$ and $R_9$ may be the same or different and each represents a hydrogen atom, a halogen atom, a $C_{1-5}$ alkyl or alkoxy group or an amino group substituted by $C_{1-2}$ alkyl group; and p and q each represent an integer of 1 or 2;

(b)

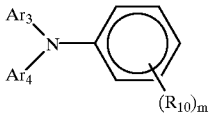

wherein $R_{10}$ represents a hydrogen atom or a methyl group; $Ar_3$ and $Ar_4$ each represents an unsubstituted aryl group or an aryl group substituted by a halogen atom, a $C_{1-5}$ alkyl or alkoxy group, or amino group substituted by a $C_{1-3}$ alkyl group; and m represents an integer or 1 or 2.

14. A preparation process of an electrophotographic photoreceptor comprising the steps of:

providing an electrically conductive substrate having thereon a photosensitive layer;

applying a coating solution containing a hydroxyl group-containing compound and an isocyanate group-containing compound to a photosensitive layer; and then heating the photosensitive layer to effect crosslinking polymerization, to thereby form a surface protective layer on the photosensitive layer.

15. The process of claim 14, wherein the hydroxyl group-containing compound in the coating solution comprises at least one combination selected from: a combination of an electric charge-transporting material containing a hydroxyl group and a compound containing a hydroxyl group and a fluorine atom; a combination of an electric charge-transporting material containing a hydroxyl group and a bisphenol compound; a combination of a compound having two or more hydroxyl group and a compound represented by the following formula (C) or (D):

(C)

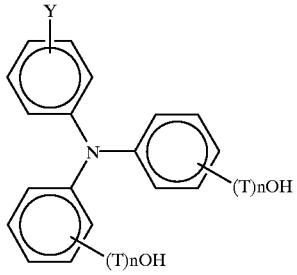

wherein Y represents a hydrogen atom, a halogen atom, an alkyl group having 1 to 5 carbon atoms which may be substituted by a halogen atom, an alkoxyl group having 1 to 5 carbon atoms, or a phenyl group which may be substituted by: a halogen atom; an alkyl group having 1 to 5 carbon atoms which may be substituted by a halogen atom; or a phenyl group which may be substituted by an alkoxyl group having 1 to 5 carbon atoms; T represents a divalent aliphatic group having 1 to 10 carbon atoms which may be branched; and n represents 0 or 1;

(D)

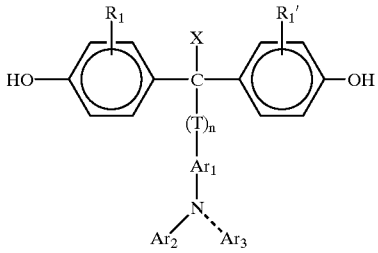

wherein $R_1$ and $R_1'$, which may be the same or different, each represents a hydrogen atom or an alkyl group having 1 to 5 carbon atoms; X represents a hydrogen atom, an alkyl group having 1 to 5 carbon atoms, or a phenyl group which may be substituted; T represents a divalent aliphatic group which may be branched; $Ar_1$, $Ar_2$ and $Ar_3$, which may be the same or different, each represents a phenyl group, a naphthyl group, or an anthracene group; and these substituent groups may each be substituted by one or more of a halogen atom, an alkyl group(s) having 1 to 5 carbon atoms and an alkoxyl group having 1 to 5 carbon atoms; and a combination of a bisphenol or glycol compound and a compound represented by the above described formula (C) or (D).

16. The process of claim 14, wherein the coating solution further comprises at least one compound selected from the group consisting of those having a hindered phenol structural unit and those having a hindered amine structure.

17. The process of claim 14:

wherein the hydroxyl group-containing compound comprises a compound represented by the following formula (C) or (D):

(C)

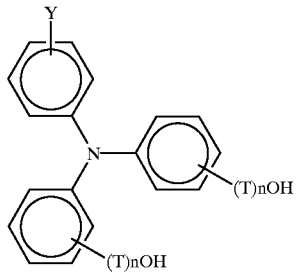

wherein Y represents a hydrogen atom, a halogen atom, an alkyl group having 1 to 5 carbon atoms which may be substituted by a halogen atom, an alkoxyl group having 1 to 5 carbon atoms, or a phenyl group which may be substituted by a halogen atom; an alkyl group having 1 to 5 carbon atoms which may be substituted by a halogen atom; or a phenyl group which may be substituted by an alkoxyl group having 1 to 5 carbon atoms; T represents a divalent aliphatic group having 1 to 10 carbon atoms which may be branched; and n represents 0 or 1;

(D)

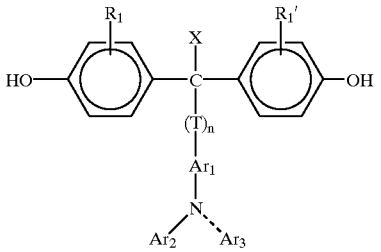

wherein $R_1$ and $R_1'$, which may be the same or different, each represents a hydrogen atom or an alkyl group having 1 to 5 carbon atoms; X represents a hydrogen atom, an alkyl group having 1 to 5 carbon atoms, or a phenyl group which may be substituted; T represents a divalent aliphatic group which may be branched; $Ar_1$, $Ar_2$ and $Ar_3$, which may be the same or different, each represents a phenyl group, a naphthyl group, or an anthracene group; and these substituent groups may each be substituted by one or more of a halogen atom, an alkyl group(s) having 1 to 5 carbon atoms and an alkoxyl group having 1 to 5 carbon atoms; and wherein the isocyanate group-containing compound comprises at least one of the biuret modified product of a hexamethylene diisocyanate represented by the following structural formula (3-II) and the isocyanurate modified product of a hexamethylene diisocyanate represented by the following structural formula (3-III):

(3-II)

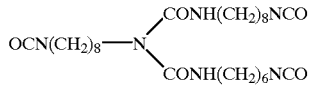

(3-II)

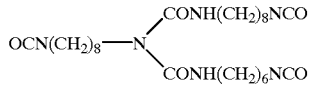

(3-III)

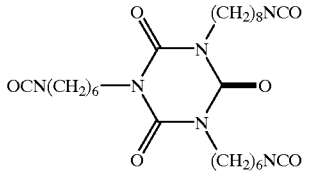

18. An image forming apparatus comprises an electrophotographic photoreceptor, and charging means, image forming exposing means, developing means and transferring means provided around the electrophotographic photoreceptor, wherein the electrophotographic photoreceptor is one according to claim 5.

19. The image forming apparatus of claim 18, wherein the charging means is of contact charging type.

20. The image forming apparatus of claim 19, wherein the charging means is operatable by applying a voltage having an alternating current component.

21. The electrophotographic photoreceptor of claim 4, wherein said network structure in said surface protective layer has a urethane bonding content ratio A of 1.5 or more:

$$A=x/y$$

wherein x represents an absorbence of the infrared absorption peak at from 1720 to 1740 $cm^{-1}$ attributed to the CO stretching vibration in the urethane bonding, and y represents an absorbence of the infrared absorption peak at 2973 $cm^{-1}$ attributed to the $CH_2$ stretching vibration.

22. The process of claim 15, wherein said surface protective layer has a network structure having a urethane bonding content ratio A of 1.5 or more:

$$A=x/y$$

wherein x represents an absorbence of the infrared absorption peak at from 1720 to 1740 $cm^{-1}$ attributed to the CO stretching vibration in the urethane bonding, and y represents an absorbence of the infrared absorption peak at 2973 $cm^{-1}$ attributed to the $CH_2$ stretching vibration.

* * * * *